US009208654B2

(12) United States Patent
Kondo et al.

(10) Patent No.: US 9,208,654 B2
(45) **Date of Patent: *Dec. 8, 2015**

(54) GAMING MACHINE REPRESENTING VARIOUS SYMBOLS IN RESPONSE TO COLOR OF LIGHT EMITTED FROM BACKLIGHT

(71) Applicants: Universal Entertainment Corporation, Tokyo (JP); Aruze Gaming America, Inc., Las Vegas, NV (US)

(72) Inventors: Yoshinori Kondo, Tokyo (JP); Akira Osawa, Tokyo (JP); Jun Hirato, Tokyo (JP); Kenta Kitamura, Tokyo (JP)

(73) Assignees: UNIVERSAL ENTERTAINMENT CORPORATION, Tokyo (JP); ARUZE GAMING AMERICA, INC., Las Vegas, NV (US)

( * ) Notice: Subject to any disclaimer, the term of this patent is extended or adjusted under 35 U.S.C. 154(b) by 38 days.

This patent is subject to a terminal disclaimer.

(21) Appl. No.: 13/892,754

(22) Filed: May 13, 2013

(65) Prior Publication Data

US 2013/0310143 A1 Nov. 21, 2013

(30) Foreign Application Priority Data

May 18, 2012 (JP) ..... 2012-115078

(51) Int. Cl.

| | |
|---|---|
| ***A63F 9/24*** | (2006.01) |
| ***G07F 17/34*** | (2006.01) |
| ***G07F 17/32*** | (2006.01) |

(52) U.S. Cl.

CPC ..... *G07F 17/34* (2013.01); *G07F 17/3213* (2013.01)

(58) Field of Classification Search

CPC ..... G07F 17/00; G07F 17/34; G07F 17/3213
USPC ..... 463/16, 20, 30, 31, 42; 273/138.1, 273/138.2, 143 R

See application file for complete search history.

(56) References Cited

U.S. PATENT DOCUMENTS

| | | | |
|---|---|---|---|
| 4,097,048 | A | 6/1978 | Poulsen |
| 4,508,345 | A | 4/1985 | Okada |
| 7,942,733 | B2 | 5/2011 | Sakuma |

(Continued)

FOREIGN PATENT DOCUMENTS

| | | |
|---|---|---|
| CN | 1589943 | 3/2005 |

OTHER PUBLICATIONS

The Office Action, State Intellectual Property Office of the P.R.C, Jul. 30, 2015, Chinese application No. 201310187467.7.

*Primary Examiner* — Jay Liddle
*Assistant Examiner* — Ryan Hsu
(74) *Attorney, Agent, or Firm* — Lex IP Meister, PLLC

(57) ABSTRACT

The present invention provides a gaming machine provided with a mechanical reel, which expands the variation of the pattern of rearrangement of symbols. The gaming machine includes a reel assembly M1 including a plurality of reels bearing a plurality of symbols on the outer surface thereof, and a backlight device M7 for illuminating each of the reels from inside. The plurality of symbols includes a variable symbol CS for representing various symbols in response to the color of light emitted from the backlight device M7. The variable symbol CS represents a first symbol upon the backlight device M7 emitting first color light, and represents a second symbol upon the backlight device M7 emitting second color light.

10 Claims, 47 Drawing Sheets

(56) References Cited

U.S. PATENT DOCUMENTS

| | | | | |
|---|---|---|---|---|
| 8,968,072 | B2 * | 3/2015 | Osawa et al. | 463/20 |
| 2004/0038726 | A1 * | 2/2004 | Inoue | 463/20 |
| 2005/0014548 | A1 * | 1/2005 | Thomas | 463/16 |
| 2005/0020349 | A1 * | 1/2005 | Tachikawa | 463/20 |
| 2005/0179836 | A1 * | 8/2005 | Shimoyama et al. | 349/106 |
| 2005/0255907 | A1 * | 11/2005 | Gauselmann et al. | 463/20 |
| 2008/0085755 | A1 * | 4/2008 | Okada | 463/20 |
| 2008/0227527 | A1 * | 9/2008 | Canterbury et al. | 463/20 |
| 2009/0143134 | A1 * | 6/2009 | Anderson et al. | 463/20 |
| 2009/0286589 | A1 * | 11/2009 | Rasmussen | 463/20 |
| 2010/0093424 | A1 * | 4/2010 | Kono et al. | 463/20 |
| 2012/0115566 | A1 * | 5/2012 | Fujisawa et al. | 463/20 |
| 2012/0206320 | A1 * | 8/2012 | Lee et al. | 345/4 |
| 2012/0257410 | A1 * | 10/2012 | Yokota et al. | 362/606 |
| 2012/0309492 | A1 * | 12/2012 | Osawa et al. | 463/20 |

* cited by examiner

FIG. 22

SYMBOL APPEARANCE PROBABILITY TABLE

| | SYMBOL | PROBABILITY |
|---|---|---|
| FS | FREE GAME | NORMAL GAME: 1/XXX<br>FREE GAME: 0/XXX |
| TS | 777 | NORMAL GAME: 0/XXX<br>FREE GAME: 1/XXX |
| BS | BONUS | NORMAL GAME: 1/XXX<br>FREE GAME: 0/XXX |
| SS | SEVEN RUSH | NORMAL GAME: 0/XXX<br>FREE GAME: 1/XXX |
| BDS | | NORMAL GAME: 1/XXX<br>FREE GAME: 0/XXX |
| TDS | | NORMAL GAME: 1/XXX<br>FREE GAME: 0/XXX |
| DDS | | NORMAL GAME: 1/XXX<br>FREE GAME: 0/XXX |
| SDS | | NORMAL GAME: 1/XXX<br>FREE GAME: 0/XXX |

FIG. 23

PAYOUT TABLE

| SYMBOL | PAYOUT | PROBABILITY |
|---|---|---|
| | XXX | X/XXX |
| | XXX | X/XXX |
| | XXX | X/XXX |
| | XXX | X/XXX |
| | XXX | X/XXX |
| | XXX | X/XXX |
| | XXX | X/XXX |
| | XXX | X/XXX |
| | XXX | X/XXX |
| | XXX | X/XXX |
| | XXX | X/XXX |
| | XXX | X/XXX |
| | XXX | X/XXX |
| | XXX | X/XXX |
| | XXX | X/XXX |
| | XXX | X/XXX |
| | XXX | X/XXX |
| | XXX | X/XXX |
| | XXX | X/XXX |
| 777 | XXX (ex. 20) | X/XXX |
| SEVEN RUSH | 0 | X/XXX |

FIG. 25

ADDING TABLE

| TABLE | PROBABILITY |
|---|---|
| SMALL | 95.00% |
| BIG | 5.00% |

SMALL TIME GAME NUMBER LOTTERY TABLE

| NUMBER OF GAMES | PROBABILITY | |
|---|---|---|
| 5 | 50.0% | 1/2.0 |
| 7 | 30.0% | 1/3.3 |
| 10 | 20.0% | 1/5.0 |

BIG TIME GAME NUMBER LOTTERY TABLE

| NUMBER OF GAMES | PROBABILITY | |
|---|---|---|
| 15 | 50.0% | 1/2.0 |
| 20 | 20.0% | 1/5.0 |
| 25 | 20.0% | 1/5.0 |
| 30 | 10.0% | 1/10.0 |

FIG. 40A

| | FIRST SURFACE | SECOND SURFACE |
|---|---|---|
| 1 | Chance | Chance |
| | Blank_2 | Blank_2 |
| 2 | Lose | Lose |
| | Blank_2 | Blank_2 |
| 3 | Ex_B | Ex_B |
| | Blank_2 | Blank_2 |
| 4 | ×10 | ×10 |
| | Blank_2 | Blank_2 |
| 5 | ×7 | ×7 |
| | Blank_2 | Blank_2 |
| 6 | ×5 | 12FG |
| | Blank_2 | Blank_2 |
| 7 | ×3 | 10FG |
| | Blank_2 | Blank_2 |
| 8 | ×2 | 8FG |
| | Blank_2 | Blank_2 |
| 9 | ×4 | 6FG |
| | Blank_2 | Blank_2 |
| 10 | ×3 | FG__2 |
| | Blank_2 | Blank_2 |
| 11 | ×2 | FG__1 |
| | Blank_2 | Blank_2 |

FIG. 40B-1

| NORMAL GAME | | |
|---|---|---|
| | EMISSION | SYMBOL |
| 1 | Colorful | Chance |
| | | Blank_2 |
| 2 | Colorful | Lose |
| | | Blank_2 |
| 3 | Colorful | Ex_B |
| | | Blank_2 |
| 4 | Colorful | ×10 |
| | | Blank_2 |
| 5 | Colorful | ×7 |
| | | Blank_2 |
| 6 | Red | ×5 |
| | | Blank_2 |
| 7 | Red | ×3 |
| | | Blank_2 |
| 8 | Red | ×2 |
| | | Blank_2 |
| 9 | Red | ×4 |
| | | Blank_2 |
| 10 | Red | ×3 |
| | | Blank_2 |
| 11 | Red | ×2 |
| | Blank_2 | |

FIG. 40B-2

| FREE GAME | | |
|---|---|---|
| | EMISSION | SYMBOL |
| 1 | Colorful | Chance |
| | | Blank_2 |
| 2 | Colorful | Lose |
| | | Blank_2 |
| 3 | Extinguishing | Blank_2 |
| | | Blank_2 |
| 4 | Colorful | ×10 |
| | | Blank_2 |
| 5 | Colorful | ×7 |
| | | Blank_2 |
| 6 | Red | ×5 |
| | | Blank_2 |
| 7 | Red | ×3 |
| | | Blank_2 |
| 8 | Red | ×2 |
| | | Blank_2 |
| 9 | Red | ×4 |
| | | Blank_2 |
| 10 | Green | FG__2 |
| | | Blank_2 |
| 11 | Green | FG__1 |
| | | Blank_2 |

FIG. 40B-3

| AT THE TIME OF FREE GAME NUMBER LOTTERY | | |
|---|---|---|
| | EMISSION | SYMBOL |
| 1 | Extinguishing | Blank_2 |
| | | Blank_2 |
| 2 | Extinguishing | Blank_2 |
| | | Blank_2 |
| 3 | Extinguishing | Blank_2 |
| | | Blank_2 |
| 4 | Extinguishing | Blank_2 |
| | | Blank_2 |
| 5 | Extinguishing | Blank_2 |
| | | Blank_2 |
| 6 | Green | 12FG |
| | | Blank_2 |
| 7 | Green | 10FG |
| | | Blank_2 |
| 8 | Green | 8FG |
| | | Blank_2 |
| 9 | Green | 6FG |
| | | Blank_2 |
| 10 | Extinguishing | Blank_2 |
| | | Blank_2 |
| 11 | Extinguishing | Blank_2 |
| | | Blank_2 |

GAMING MACHINE REPRESENTING VARIOUS SYMBOLS IN RESPONSE TO COLOR OF LIGHT EMITTED FROM BACKLIGHT

CROSS REFERENCE TO RELATED APPLICATIONS

This application claims priority of Japanese Patent Application No. 2012-115078 filed on May 18, 2012. The contents of this application are incorporated herein by reference in their entirety.

BACKGROUND OF THE INVENTION

1. Field of the Invention

The present invention relates to a gaming machine and, more particularly, to a gaming machine which rearranges symbols in each of unit games and awards a benefit when a winning pattern is established in the rearranged symbols.

2. Description of the Related Art

A gaming machine is a machine that rotates reels to rearrange symbols in a display area each time a game player presses an operation member such as a button located on a control panel to start playing a unit game. When the symbols are rearranged to form a winning pattern in the display area, a benefit (e.g., a payout) is awarded to the player (for example, refer to U.S. Pat. No. 4,097,048).

In consideration of players' diversified preferences, there have been developed a variety of gaming machines. For example, a variety of gaming machines has been developed which varies in symbol patterns, gaming scenarios, side effects (sound effects, effects using images, or effects by means of reel spinning). There has been developed a gaming machine which is provided with a bonus game and in which a player can enjoy a free game under a certain condition (for example, refer to U.S. Pat. Nos. 4,508,345 and 7,942,733).

The effect by means of an image is carried out in a liquid crystal display device. In this case, a reel for varying the symbol is constituted as a so-called video reel. A mechanical reel is used as the reel which is made of a ring-shaped reel belt bearing a symbol thereon.

SUMMARY OF THE INVENTION

A mechanical reel is for mechanically rotating the reel bearing a symbol, so that the pattern for rearranging the symbol tends to be monotonous compared with the video reel which displays the symbol by means of a liquid crystal display device and the like.

In light of the above-mentioned issues, the present invention is made, and the purpose thereof is to provide a gaming machine provided with a mechanical reel, which expands the variation of the pattern of rearrangement of symbols.

A feature of the present invention is a gaming machine, comprising:

a reel assembly including a plurality of reels bearing a plurality of symbols on the outer surface thereof, and a backlight for illuminating each of the reels from inside; and a controller for controlling color of light emitted from the backlight, wherein:

a game result is displayed by rotating and stopping the plurality of reels to rearrange the plurality of symbols; and the plurality of symbols includes a variable symbol for representing various symbols in response to the color of light emitted from the backlight.

In this way, with regard to the variable symbol, the selection of color of light emitted from the backlight enables the display of the plurality of types of symbols. Therefore, the symbol selected from the plurality of types of symbols in response to the emission light color is rearranged with regard to the variable symbol when the plurality of symbols is rearranged. As a result, the present invention can expand the variation of the rearrangement by the mechanical reel which tends to be monotonous, thanks to the variable symbol acting as two or more symbols.

Furthermore, the color of light emitted from the backlight is changed while the reel rotates, the lighting pattern of the backlight (a combination of lighting and extinguishing) is changed, or the emission light color is changed after the variable symbol is rearranged, and so on. It is thus possible to diversify the effect until the symbol is rearranged, or to make the type of symbol displayed as the variable symbol harder to expect until all the symbols are finally rearranged. The control of the backlight in this way enables the variation of the rearrangement of symbols to be expanded.

In addition to the above, a feature of the present invention is that the variable symbol represents a first symbol upon the backlight emitting first color light, and represents a second symbol upon the backlight emitting second color light. The variable symbol is made of a first sheet bearing the first symbol and a second sheet bearing the second symbol overlapped with each other.

In this way, the variable symbol capable of representing a plurality of types of symbols can be offered with a structure which is simple and easy to be manufactured. Therefore, it is possible to suppress increase in manufacturing cost upon employing the variable symbol.

In addition to the above, a feature of the present invention is that:

the first color light is red;

the second color light is green;

the first sheet is made of a translucent green base bearing a translucent white or transparent symbol, and displays the symbol in red upon being illuminated by the first color light; and the second sheet is made of a translucent red base bearing a translucent white or transparent symbol, and displays the symbol in green upon being illuminated by the second color light.

Red or green light that is emitted by an inexpensive light source is employed as the color that is emitted from the backlight. Therefore, an inexpensive general light source such as an LED can be used as a light source. It is thus possible to suppress increase in manufacturing cost upon employing the variable symbol.

In addition to the above, a feature of the present invention is that a vertical part on the periphery of at least one of sheets out of the first sheet or the second sheet is formed in blue.

In this way, when red or green light is irradiated to the variable symbol, at least a vertical part formed in blue becomes black to define the symbol. It is thus possible to improve the visibility of the symbol.

In addition to the above, a feature of the present invention is that one of symbols out of the first symbol and the second symbol is used in a normal game, and the other is used in a game other than the normal game, such as a free game.

In this way, the representation pattern of the variable symbol can be separated between the normal game and the other game other than the normal game, such as a free game. Since the rearrangement pattern of symbol in the game other than the normal game thus can be different from that in the normal game, it is possible to enhance the game element in the game other than the normal game, such as a free game.

EFFECT OF THE INVENTION

In the present invention, a gaming machine provided with a mechanical reel, can expand the variation of the pattern of rearrangement of symbols.

BRIEF DESCRIPTION OF THE DRAWINGS

FIG. 22 is a diagram showing an example of symbol appearance probability tables.

FIG. 23 is a diagram showing an example of payout tables.

FIG. 25 is a diagram showing an adding table and a game number lottery table.

FIG. 40A is a diagrams showing the alignment of symbols arranged on a fifth reel M3*e*' according to a second embodiment.

FIG. 40B-1 is a diagram showing the alignment of symbols appeared in the normal game.

FIG. 40B-2 is a diagram showing the alignment of symbols appeared in the free game.

FIG. 40B-3 is a diagram showing the alignment of symbols appeared in the free game number determination process.

FIG. 41 is a flowchart showing the process when the gaming machine 10' according to the second embodiment is turned on.

FIG. 45 is a subroutine for a process of determining/displaying magnification factor and the like.

DESCRIPTION OF THE PREFERRED EMBODIMENTS

[Overview of Gaming Machine According to Embodiments]

Figure 1:
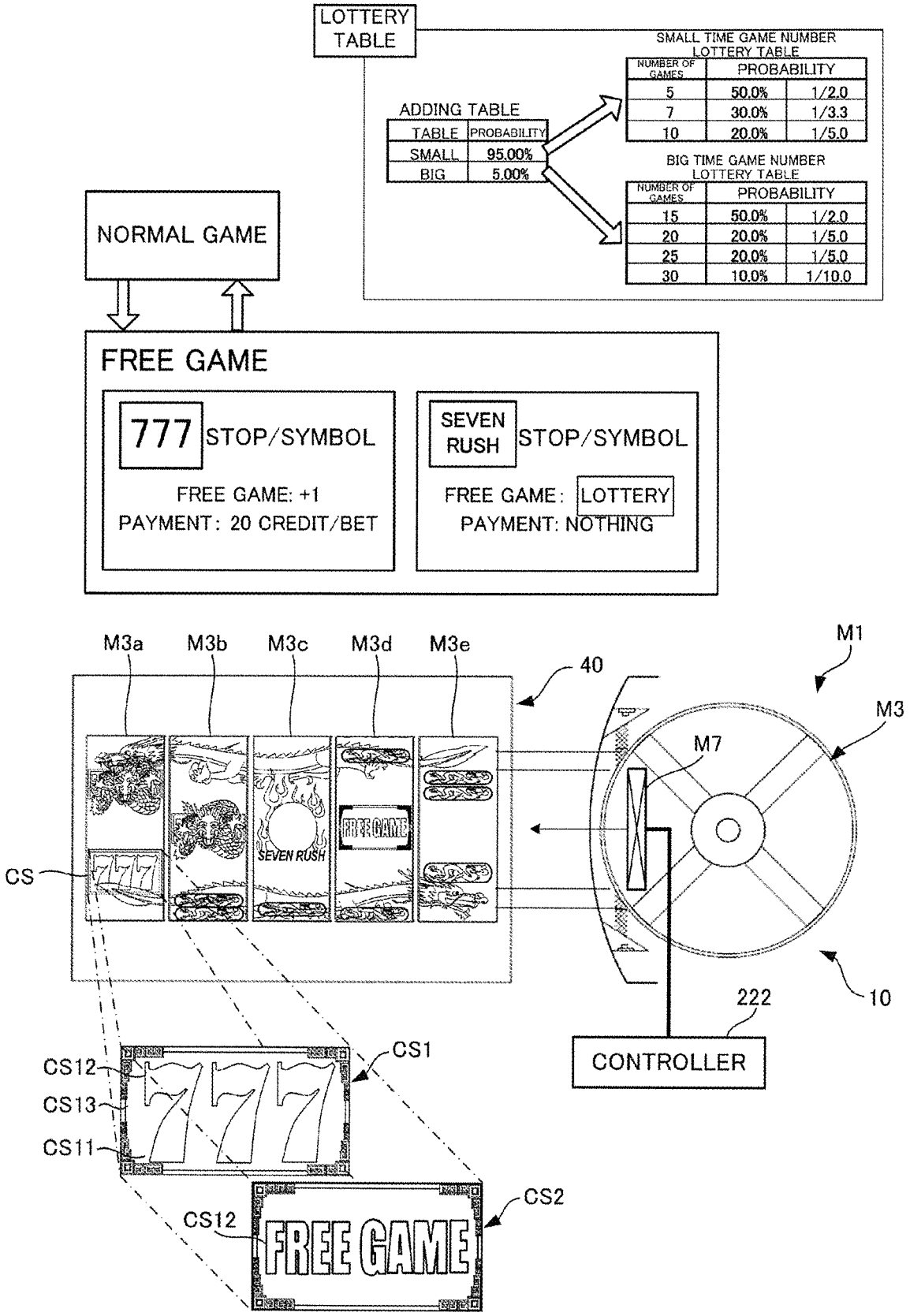
FIG. 1 is a diagram showing an overview of a gaming machine according to an embodiment of the present invention.

FIG. 1 is a diagram showing an overview of a gaming machine according to an embodiment of the present invention.

A gaming machine 10 according to the present embodiment is capable of obtaining a game result based on a plurality of rearranged symbols, and executes a normal game and a free game.

The gaming machine 10 is provided with a controller 222 (such as a main CPU) for executing the processes (1) and (2) described below, and a symbol display unit 40, the controller 222 executing the processes of;

(1) determining the number of adding free game based on the game number lottery table (such as a "small time game number lottery table" or a "big time game number lottery table") under the condition that a first symbol (such as a "SEVEN RUSH" symbol) is rearranged in the symbol display unit in the free game; and (2) adding a preset number of free game (such as one game) under the condition that a second symbol (such as a "777" symbol) is rearranged in the symbol display unit in the free game.

The game number lottery table includes a plurality of lottery tables (such as the "small time game number lottery table" and the "big time game number lottery table") having the different numbers of adding games of the free game to be assigned thereby, which is stored in a memory (such as a ROM 224 (refer to FIG. 18)). The memory further stores a table lottery table (such as an "adding table") for selecting a lottery table for use in determination of the number of adding games from the plurality of lottery tables. In this case, the controller 222 executes the process including the processes (1-1) and (1-2) described below as the process (1), the processes including the processes of:

(1-1) determining a lottery table from among the plurality of lottery tables based on the table lottery table under the condition that the first symbol is rearranged on the symbol display unit 40 in the free game; and (1-2) determining the number of adding games of the free game using the lottery table determined in the process (1-1).

The plurality of lottery tables includes a first lottery table having a larger expectation value of the number of adding games (such as the big time game number lottery table) and a second lottery table having an expectation value of the number of adding games smaller than that of the first lottery table (such as the small time game number lottery table). The expectation value of the number of adding games contained in the first lottery table is, for example, 19.5 games in the big time game number lottery table shown in FIG. 25, whereas the expectation value of the number of adding games contained in the second lottery table is, for example, 5.6 games in the small time game number lottery table shown in FIG. 25. Of course, the expectation value may be appropriately set for each lottery table.

The table lottery table includes a probability of winning the first lottery table (such as 5%) set lower than a probability of winning the second lottery table (such as 95%). The minimum value of the number of adding games in the first lottery table is set to be higher (such as 15 games) than the maximum value of the number of the adding games in the second lottery table (such as 10 games).

The first symbol is the symbol representing the fact that no payout should be done and more than one free game (such as 5 to 30) is to be added when rearranged in the symbol display unit 40, and the second symbol is the symbol representing the fact that payout should be done (such as 20 credits per one bet) and one free game is to be added when rearranged in the symbol display unit 40.

The symbol display unit 40 is provided with a plurality of reels M3*a* to M3*e* each of which includes a plurality of symbols (such as a "777" symbol, a "FREE GAME" symbol, a "SEVEN RUSH" symbol, and a "BONUS" symbol) put on the outer peripheral surface thereof, and a backlight device M7 that illuminates the reels M3*a* to M3*e* from inside. The emission light color of the backlight device M7 is controlled by the controller 222.

A plurality of symbols put on the reels M3*a* to M3*e* includes a variable symbol CS in which different symbols are displayed in accordance with the emitted light color from the backlight device M7.

In the variable symbol CS, the first symbol (such as the "777" symbol) is displayed when the emission light color of the backlight device M7 is a first emission light color (such as red), and the second symbol (such as the "FREE GAME" symbol) is displayed when the emission light color of the backlight device M7 is a second emission light color (such as green).

The variable symbol CS is composed of a first sheet CS1 having the first symbol (such as the "777" symbol) put thereon, and a second sheet CS2 having the second symbol (such as the "FREE GAME" symbol) put thereon, the first sheet CS1 and the second sheet CS2 being overlapped with each other.

The first sheet CS1 displays the symbol in red when illuminated by the first emission light color, in which an outlined 777 symbol CS12 is formed with no color on a green foundation CS11. A frame part CS12 of the first sheet CS1 is formed in blue.

The second sheet CS2 displays the symbol in green when illuminated by the second emission light color, which is formed so that all of the characters "FREE GAME" become green, which is the same color as the foundation CS1 of the first sheet CS1, when overlapped with the first sheet CS1. A detailed description will be made below on that note. In the first symbol and the second symbol, one is used in the normal game, and the other is used in the game other than the normal game (such as a free game).

Embodiments will be described below with reference to the drawings.

[First Embodiment of the Gaming Machine]

(Mechanical Structure of the Gaming Machine)

An overall structure of a gaming machine 10 will be described with reference to FIG. 2.

The gaming machine 10 uses a coin, a bill, or electrical valuable information corresponding thereto as gaming media. In particular, the present embodiment uses credit-related data such as cash data stored in an IC card 500.

The gaming machine 10 is equipped with a cabinet 11, a top box 12 installed at the top of the cabinet 11, and a main door 13 mounted in front of the cabinet 11.

A reel device M1 is provided on the main door 13. A reel cover 134 is provided on the front of the reel device M1. As shown in FIGS. 3 to 6, the reel cover 134 is provided with a transparent panel 1341, a panel frame 1342 including the transparent panel 1341 provided on the front thereof, and a panel support body 1343 for supporting the panel frame 1342. A light irradiation device R1 is provided on the panel support body 1343. The light irradiation device R1 has a transparent panel R11 provided at an opening 1343*a* of the panel support body 1343, and a light source device R12 that emits a visible light 901. A detailed description with regard to the light irradiation device R1 will be made below.

Figure 2:
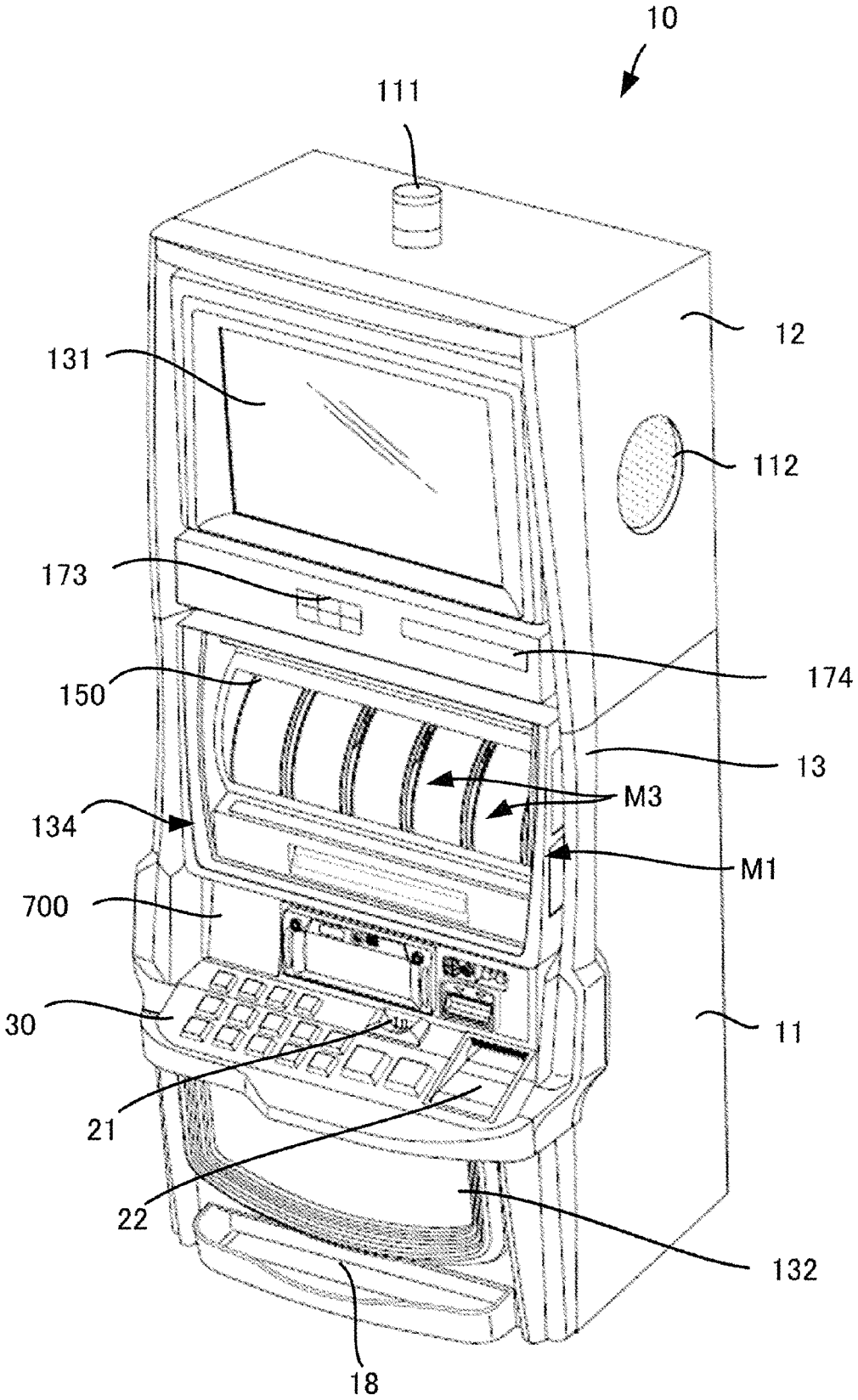
FIG. 2 is a perspective view of a gaming machine.
Figure 3:
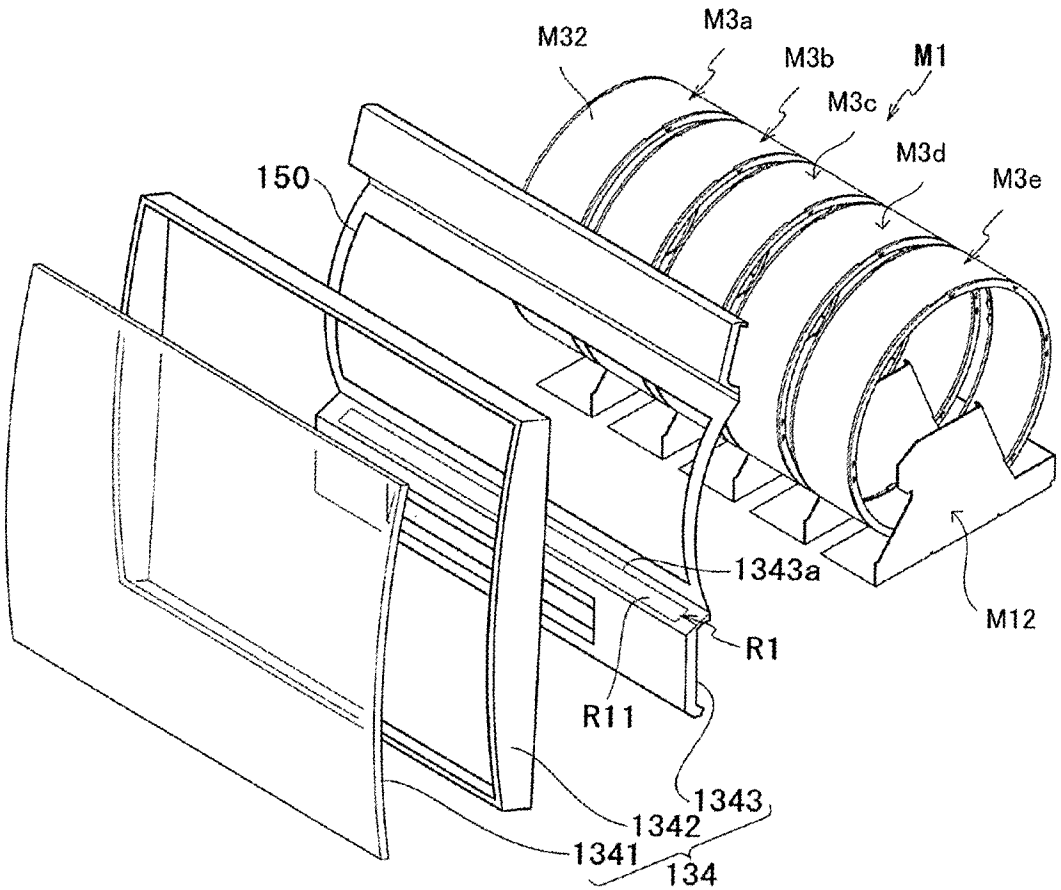
FIG. 3 is an exploded perspective view of a reel unit and a reel cover.
Figure 4:
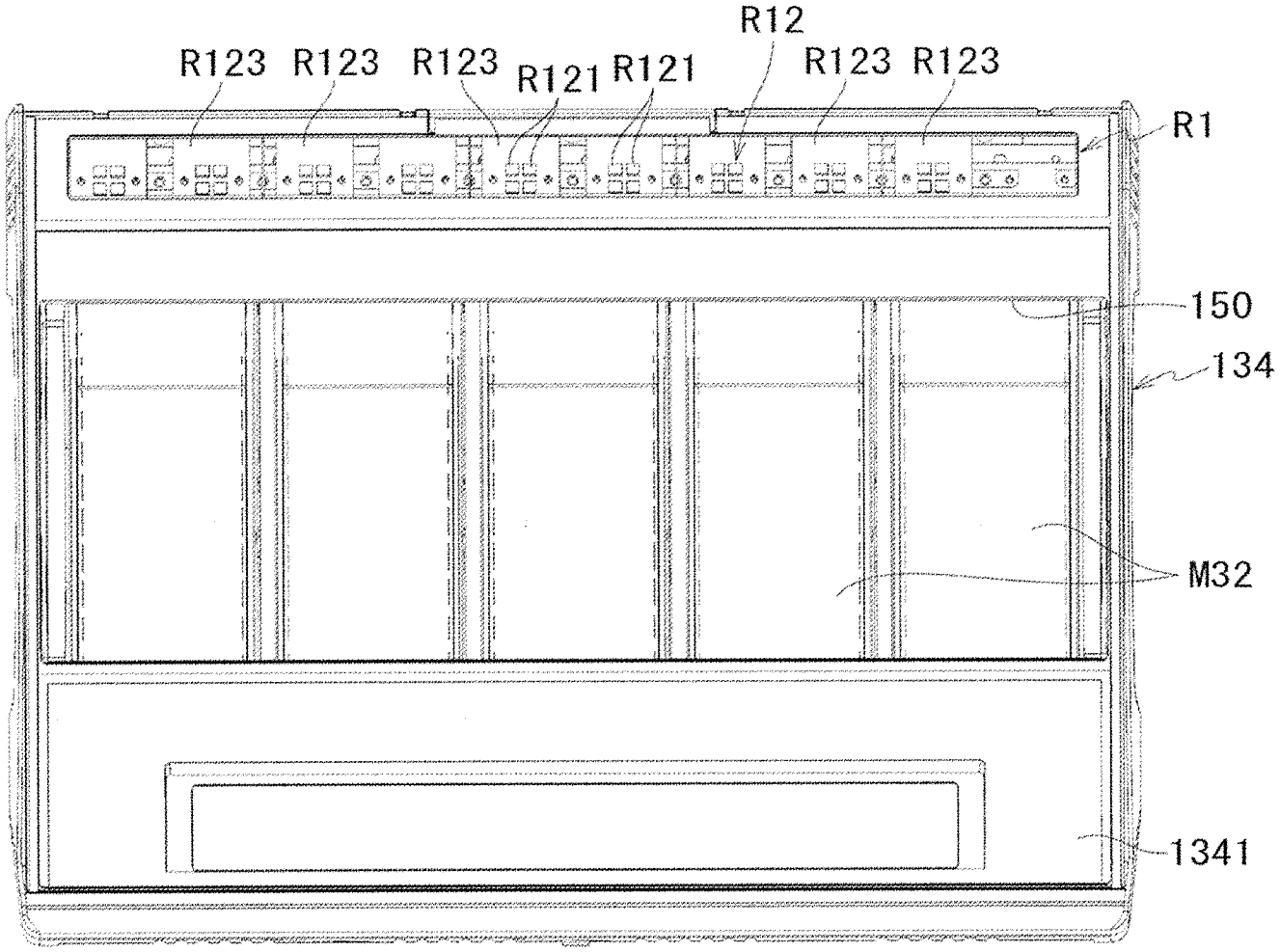
FIG. 4 is a front view of a reel cover.

The reel cover 134 has a display window 150 at the center thereof as shown in FIG. 2. The display window 150 makes 15 symbols 501 with three rows and five columns visible from the outside. Three symbols 501 in each column are a part of a group of symbols arranged on the peripheral surface of each of the reels M3*a* to M3*e*. Each of the reels M3*a* to M3*e* can carry out the rearrangement in which three symbols 501 are moved and displayed upward and downward with changing the speed thereof as a whole, and the displayed symbols 501 are rotated vertically and then stopped.

Although the present embodiment describes the case where the gaming machine 10 is provided with a mechanical-reel type reel device M1, a video reel in which a false reel is displayed may coexist with a mechanical reel in the gaming machine 10 of the present embodiment. Furthermore, the reel cover 134 may be provided with a touch panel. In this case, a player can operate the touch panel to input a variety of instructions. An input signal is transmitted from the touch panel to a main CPU 71. Furthermore, the reel cover may have a transparent liquid crystal panel instead of the transparent panel 1341. When the transparent liquid crystal panel is provided, the effect is feasible in which the symbol of the reel device M1, visible information 902 by means of visible light 901 from the light irradiation device R1, and an effect image by means of the transparent liquid crystal panel are combined.

A backlight device M7 is arranged inside of the reel device M1. A detailed description regarding the backlight device M1 will be made below with reference to FIG. 7.

A control panel 30 is arranged on the lower side of the reel device M1. The control panel 30 is provided with various buttons, a coin entry 21 for receiving a coin into a cabinet 11, and a bill entry 22.

Figure 8:
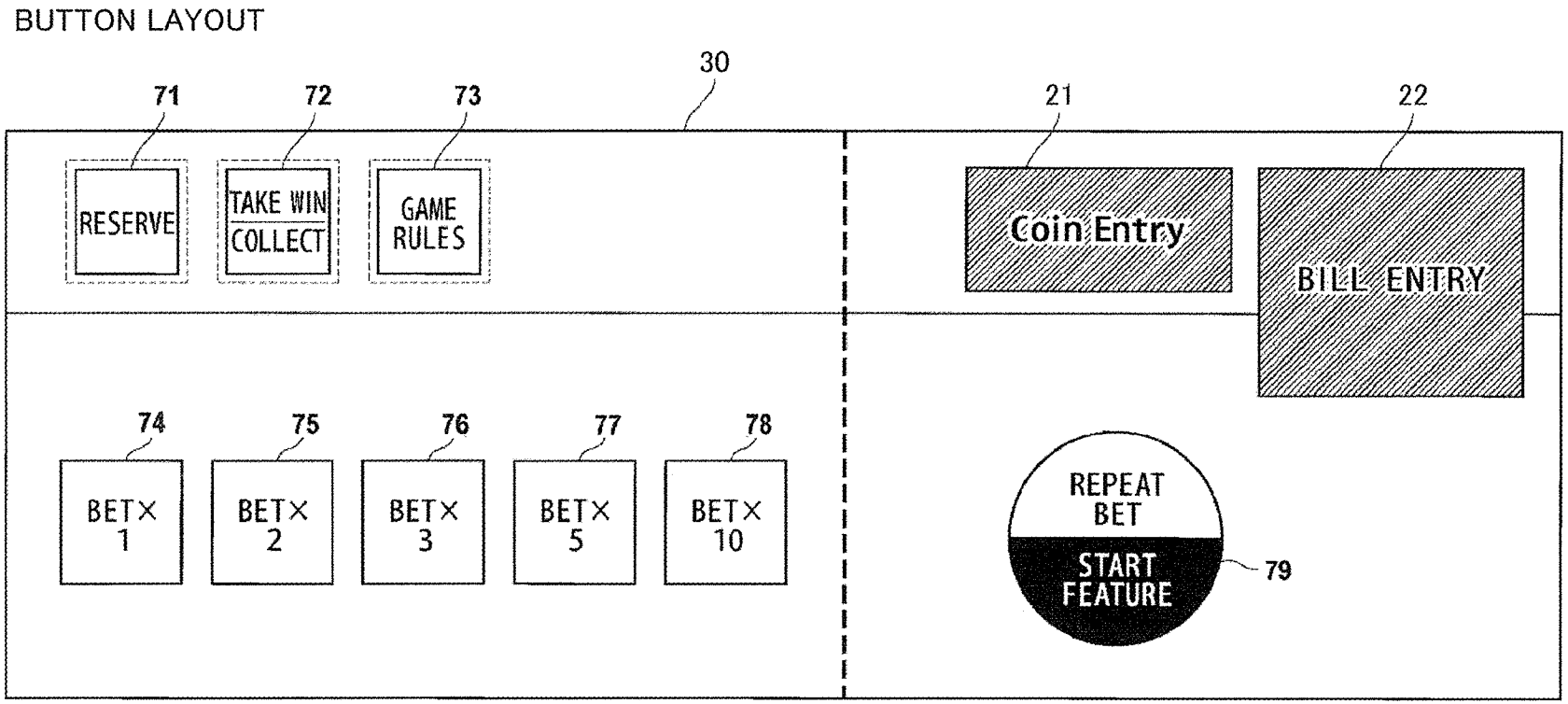
FIG. 8 is a schematic diagram showing a layout of buttons of a control panel of the gaming machine shown in FIG. 2.

Specifically, as seen in a part of the control panel 30 that is schematically shown in FIG. 8, the control panel 30 is provided with a "RESERVE" button 71, a "COLLECT" button 72, a "GAME RULES" button 73, a "1-BET" button 74, a "2-BET" button 75, a "3-BET" button 76, a "5-BET" button 77, and a "10-BET" button 78. The "RESERVE" button 71, the "COLLECT" button 72, and the "GAME RULES" button 73 are provided on an upper left area of the control panel 30. The "1-BET" button 74, the "2-BET" button 75, the "3-BET" button 76, the "5-BET" button 77, and the "10-BET" button 78 are provided on a lower left area of the control panel 30. Also, the "START" button 79 is provided on the lower center area of the control panel 30.

The "RESERVE" button 71 is used when the player temporarily leaves the seat or when the player wants to ask a staff of the game facility to exchange money, etc. Also, the "RESERVE" button 71 can be used to store credits remaining in an IC card inserted into the IC card reader 60. The "COLLECT" button 72 is used to instruct the gaming machine 10 to pay out credited coins to a coin tray 92. The "GAME RULES" button 73 is used when the player is not acquainted with game rules or operation method. When the "GAME RULES" button 73 is pressed, various types of help information is displayed on a video display unit 110.

The "BET" buttons 74 to 78 are used to set the betting amount. Each time the "1-BET" button 74 is pressed, one credit among the current credits owned by the player is bet for each of the active pay lines. When the "2-BET" button 75 is pressed, the game starts on condition that two credits are bet for each of the active pay lines. When the "3-BET" button 76 is pressed, the game starts on condition that three credits are bet for each of the active pay lines. When the "5-BET" button 77 is pressed, the game starts on condition that five credits are bet for each of the active pay lines. When the "10-BET" button 78 is pressed, the game starts on condition that ten credits are bet for each of the active pay line. The "START" button 79 is used to instruct the initiation of spinning the reels M3*a* to M3*e* under the betting condition that is set in advance.

As shown in FIG. 2, on a lower front face of the main door 13, i.e., at the lower part of the control panel 30, there are provided a coin receiving opening 18 for receiving a coin, and a belly glass 132 on which a character of the gaming machine 10 is painted.

An upper side image display panel 131 is provided on the front surface of the top box 12. The upper side image display panel 131 is composed of a liquid crystal panel, which constitutes a display. The upper side image display panel 131 displays the image for the effect, and the image showing the introduction of contents of the game and the explanation of rules. Furthermore, the top box 12 is provided with a speaker 112 and a lamp 111. The gaming machine 10 executes the effect by displaying the image, outputting the sound and outputting a ray of light.

A data display unit 174 and a key pad 173 are provided in the lower part of the upper image display unit 131. The data display unit 174 is composed of a luminescent displayer LED and the like, and is for displaying data relating to a member that is read from the IC card 500 inserted by way of a PTS terminal 700, and data input by a player via the key pad 173. The key pad 173 is used for inputting data.

(Reel Device M1)

The reel device M1 provided in the gaming machine 10 has the structure for supporting the plurality of reels M3*a* to M3*e* in the horizontal direction so that they have collinear rotation axis, as shown in FIGS. 3 to 6. More specifically, the reel device M1 has a reel assembly M11 which rotationally drives the reels M3*a* to M3*e*, each of which has symbols arranged on the outer peripheral surface thereof, to rearrange the symbols, and a reel unit holding mechanism M12 for detachably holding the reel assembly M11. In addition, in the description below, the reel assemblies will be referred to as first to fifth reel assemblies M11*a* to M11*e* in order from front to back when the installed location of each reel assembly M11 should be specified.

The reel assembly M11 has the reels M3*a* to M3*e* each of which has the symbol 501 aligned on the outer peripheral surface thereof, and the reel supporting mechanism M6 for supporting the reels M3*a* to M3*e*. Each of the reels M3*a* to M3*e* has a circular reel belt M32 on which more than one symbols is aligned.

Figure 9:
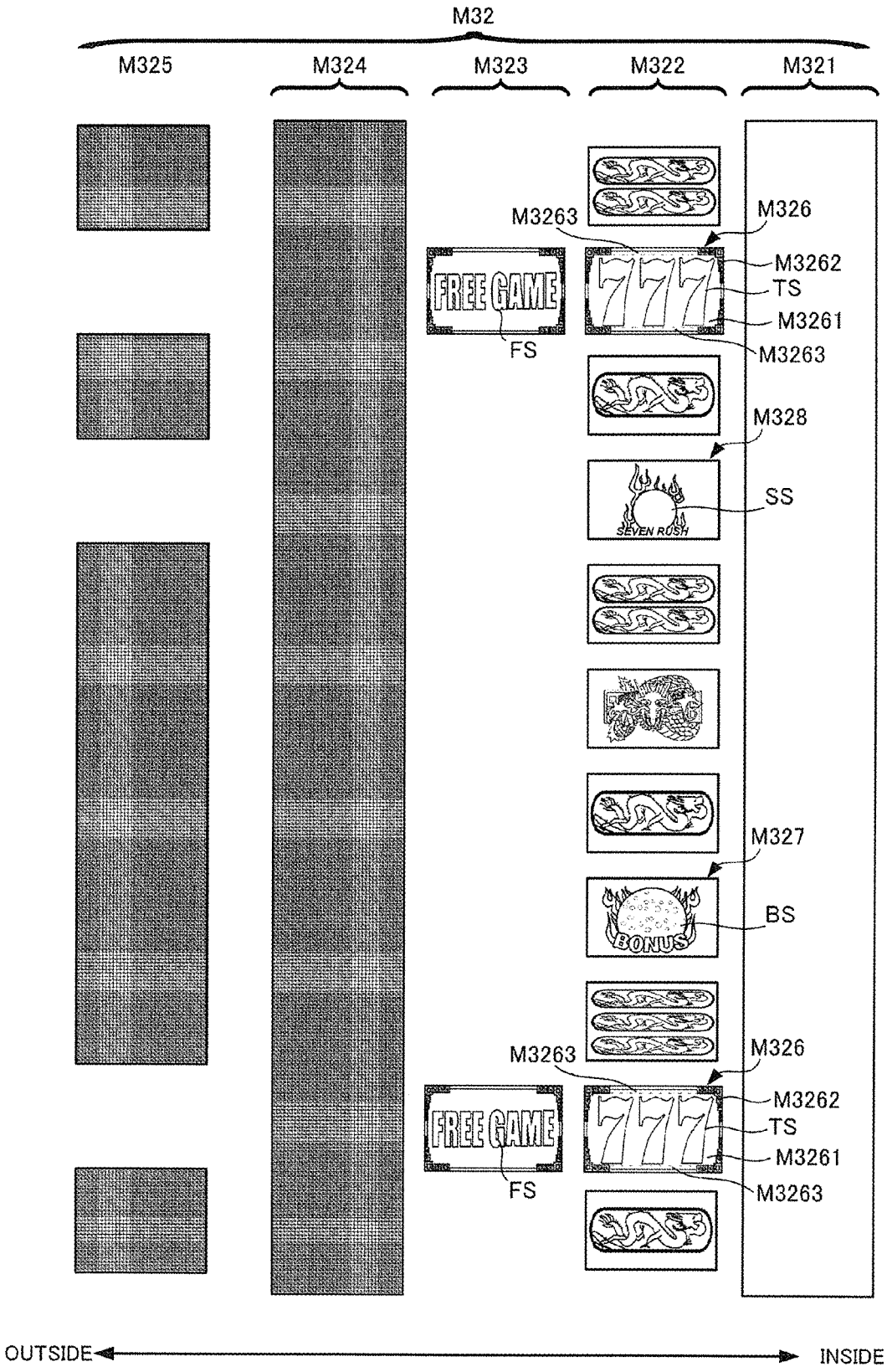
FIG. 9 is a plan view showing a reel belt in an exploded fashion.
Figure 10:
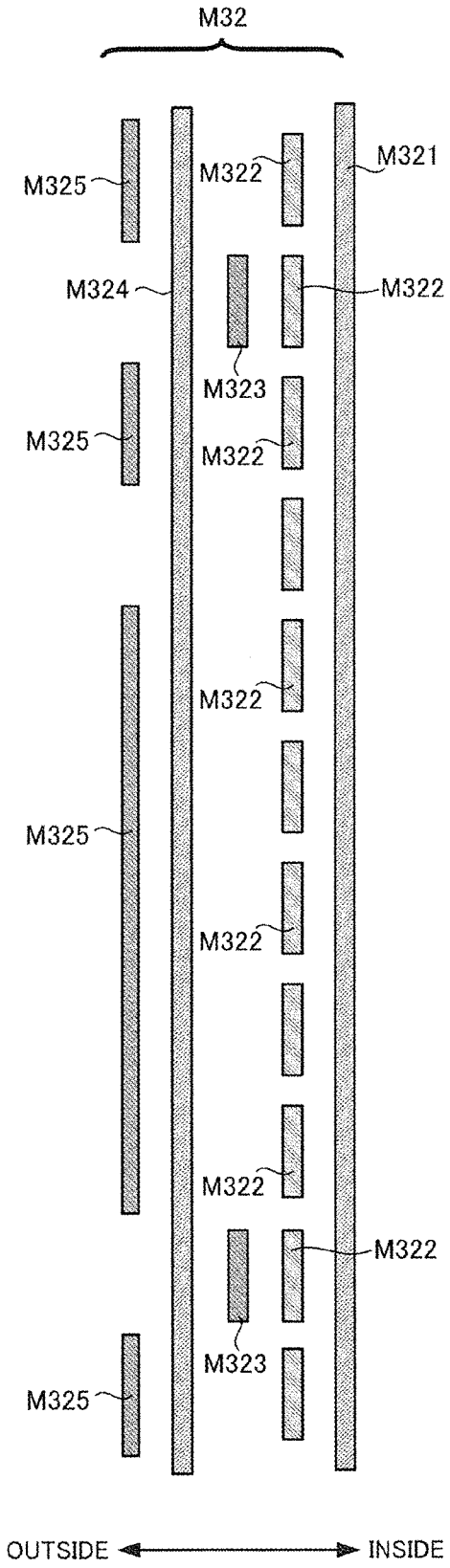
FIG. 10 is a cross sectional view showing a reel belt in an exploded fashion.

As shown in FIGS. 9 and 10, the reel belt M32 is composed of a plurality of symbol sheets M322, a plurality of symbol sheets M323, a half mirror layer 324, and a smoke layer M325 which are laminated on a base layer M321 in this order. The reel belt M32 may be provided with a protection layer on the outer surface.

The symbol sheets M322 and M323 are the sheets with a predetermined color on which a symbol is printed.

The plurality of symbol sheets M322 includes a three seven symbol sheet M326, a BONUS symbol sheet M327, a SEVEN RUSH symbol sheet M328 and a dragon-type symbol.

As shown in FIG. 9, the three seven symbol sheet M326 out of the symbol sheets M322 corresponds to the first symbol sheet CS1 (refer to FIG. 1), in which an outlined "777" symbol (a three seven symbol TS) is formed with no color on a foundation M3261. Although the outlined "777" number symbol is formed with no color, it may be formed as a part with slightly whitish color. The foundation M3261 is formed in translucent green and blue. More specifically, at least a part of the foundation M3261, namely a vertical region M3263 the foundation M3261 which is in the vicinity of the frame part M3262 and along the frame M3262 is formed in blue. Of course, a horizontal region along the frame part M3262 may be formed in blue. Furthermore, the other part of the foundation M3261, i.e., the region around the "777" number symbol is formed in green. The region around the "777" number symbol corresponds to the region in the FREE GAME symbol sheet M323 in which the letters "FREE GAME" are formed when the symbol sheet M322 is overlapped with the FREE GAME symbol sheet M323 described below. In the three seven symbol sheet M323 described above, the "777" number symbol (a three seven symbol TS) is displayed in red when red light is irradiated by the backlight device M7 described below (refer to FIG. 4).

On the other hand, the plurality of symbol sheets M323 (two sheets in the present embodiment) is the FREE GAME symbol sheet constituting a free game symbol FS. The symbol sheet M323 corresponds to the second symbol sheet CS2 (refer to FIG. 1), which is arranged to be overlapped with the three seven symbol sheet M326 as shown in FIGS. 11A and 11B.

Figure 11A:
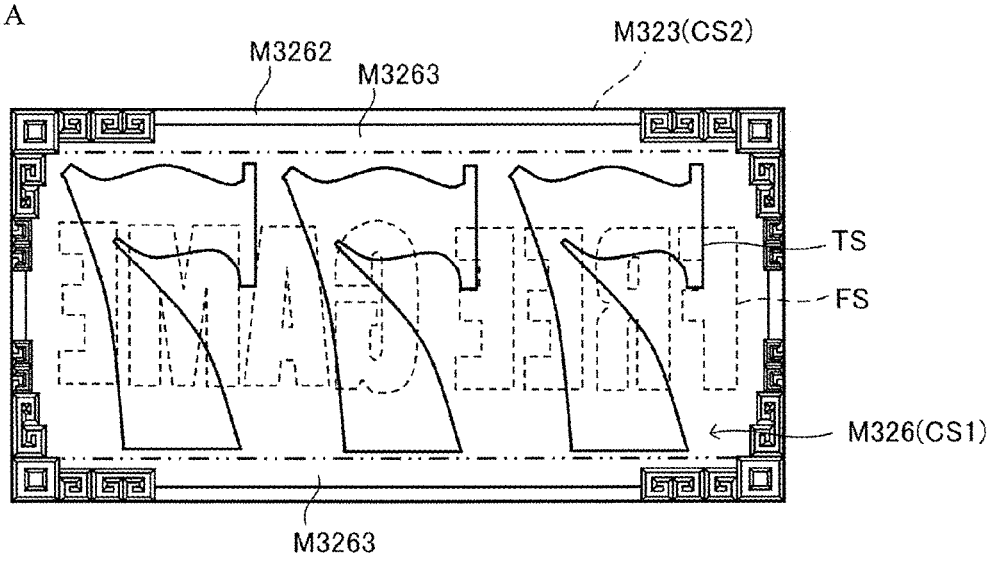
FIG. 11A is a front view showing the status in which a symbol sheet (a 777 symbol sheet) and a free game symbol sheet are overlapped with each other.

As shown in FIG. 11A, in the state where the three seven symbol sheet M326 and the FREE GAME symbol sheet M323 are overlapped with each other, the FREE GAME symbol FS arranged on the front side is clearly visible when viewed from the front side (a player's side), and the free seven symbol TS arranged behind thereof is invisible or almost invisible.

Figure 11B:
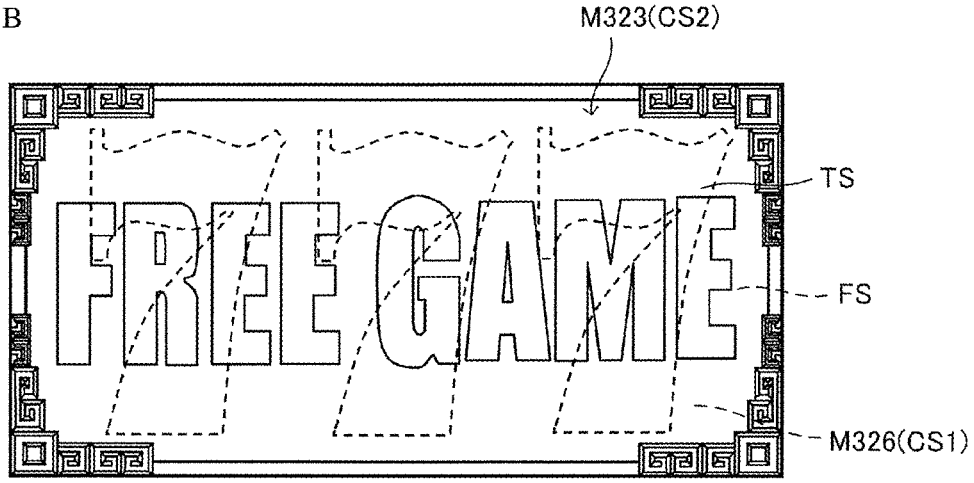
FIG. 11B and FIG. 11C are back views thereof.

On the other hand, as shown in FIG. 11B, the free seven symbol TS arranged at the inner side is clearly visible when viewed from the back side (inside of the reel), and the FREE GAME symbol FS arranged at the outer side is invisible or almost invisible.

Figure 11C:
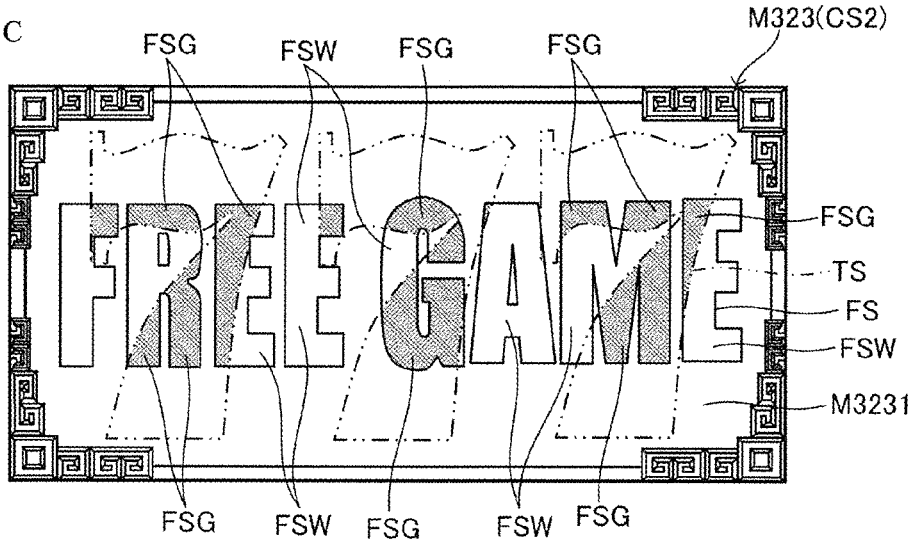

As shown in FIG. 11C, in the FREE GAME symbol sheet M323, the other part of the foundation M3231 than, for example, the letter symbol "FREE GAME" is formed in translucent red. The letter symbol (the FREE GAME symbol FS) includes a transparent part FSW having the translucency, and a green part FSG having the translucency that is the same color as the foundation M3261 of the three seven symbol sheet M326. The green part FSG is the part indicated by cross hatching in FIG. 11C, which corresponds to the number symbol (the three seven symbol TS) of the three seven symbol sheet M326. Here, if the letter symbol free game symbol FS is entirely formed to be transparent, only the part of the FREE GAME symbol FS that overlaps with the foundation M3261 of the three seven symbol sheet M326 is green. Then, a green part FSG is formed on the FREE GAME symbol sheet M323, so that the FREE GAME symbol FS can be entirely green, the same color as the foundation M3261 of the three seven symbol sheet M326, when overlapping the FREE GAME symbol sheet M323 with the symbol sheet M322. In the three seven symbol sheet M326 described above, the letter symbol "FREE GAME" (the FREE GAME symbol FG) is displayed in green when green light is irradiated by the backlight device M7 described below (refer to FIG. 7).

Furthermore, when red light or green light is irradiated by the backlight device M7 described below (refer to FIG. 7) while the FREE GAME symbol sheet M323 and the symbol sheet M322 are overlapped with each other, the visibility of the symbol can be enhanced thanks to the vertical region M3263 formed in blue along the frame part M3262 of the three seven symbol sheet M326. More specifically, the blue part becomes a shadowed region that a player recognizes as being black when green light or red light is irradiated by the backlight device M7, so that the symbol sheet M326 and the boundary of M326 (the frame of the symbol) are defined, thereby enabling the visibility of the symbol to be enhanced.

Of course, instead of forming the frame M3262 of the three seven symbol sheet M326 in blue, the frame part of the FREE GAME symbol sheet M323 may be formed in blue, both the FREE GAME symbol sheet M323 and the three seven symbol sheet M326 may be formed in blue.

Figure 39A:
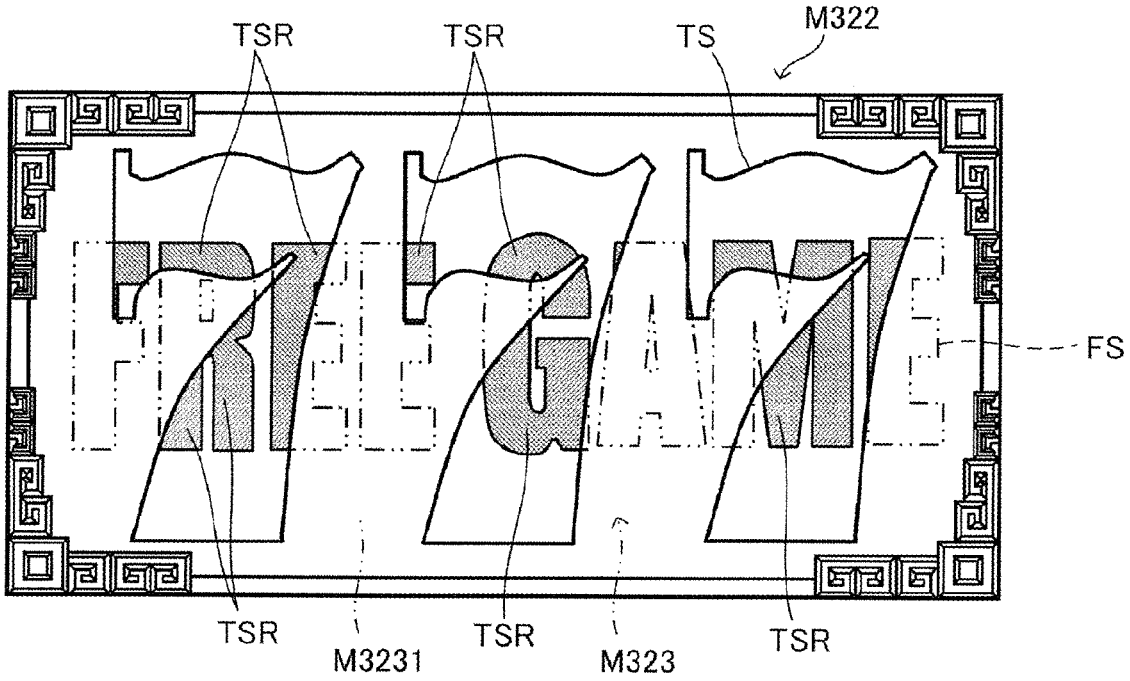
FIG. 39A is a plan view for explaining a modification of the symbol sheet (the 777 symbol sheet)

Furthermore, instead of providing the green part FSG in the letter symbol (the FREE GAME symbol FS) of the FREE GAME symbol sheet M323, the part TSR (cross-hatching part) overlapped with the letter symbol of the FREE GAME symbol sheet M323 (the FREE GAME symbol FS) may be formed in red having the translucency, which is the same color as the foundation M3231 of the FREE GAME symbol sheet M323, with regard to the number symbol (the three seven symbol TS), as shown in FIG. 39A. In this case, the number symbol (the three seven symbol TS) is entirely in red when the FREE GAME symbol sheet M323 and the three seven symbol sheet M326 are overlapped with each other.

Figure 12A:
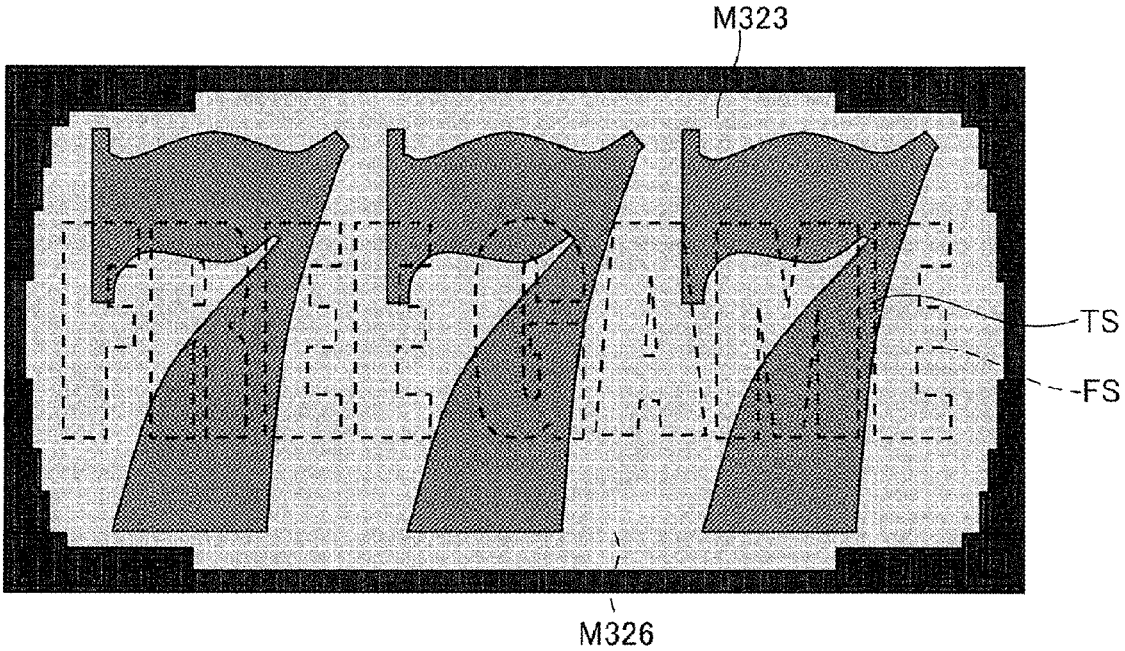
FIG. 12A shows the status in which three seven symbols are displayed.
Figure 12B:
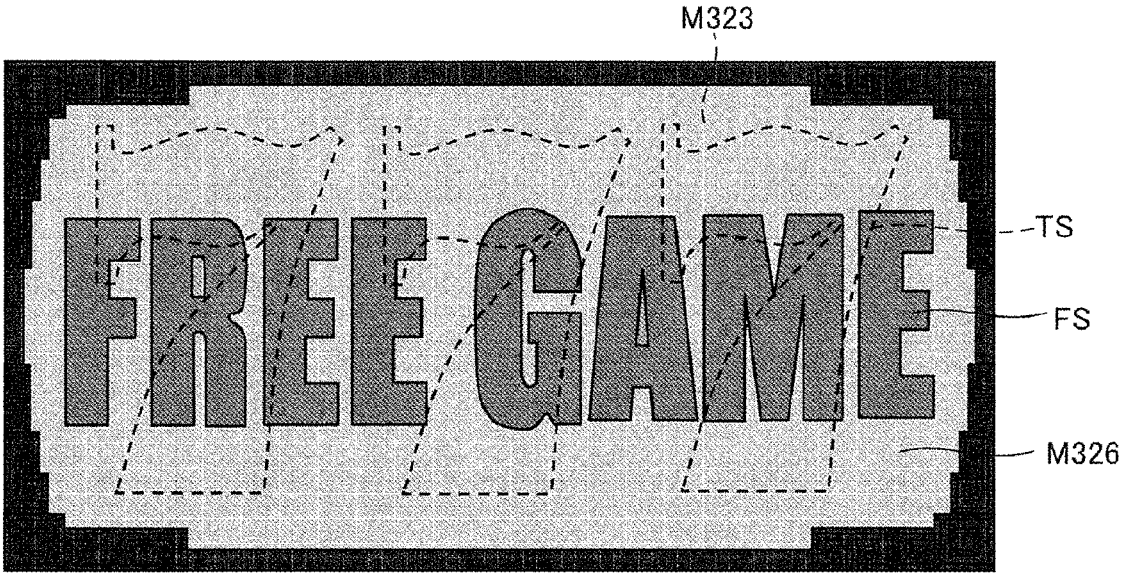
FIG. 12B shows a free game symbol.

As shown in FIGS. 12A and 12B, the reel belt M32 is structured so as to be able to selectively display any of the letters "FREE GAME" (the FREE GAME symbol FS) and the number symbol "777" (the three seven symbol TS) by controlling the backlight device M7 by means of a controller 222 described below to select the irradiation light from the backlight device M7 to be green or red.

Here, FIG. 12A shows the state where red light is irradiated to display the three seven symbol TS in red, whereas FIG. 12B shows the state where green light is irradiated to display the FREE GAME symbol FS in green. The three seven symbol TS is displayed in a free game described below, whereas the FREE GAME symbol FS is displayed in a normal game described below.

Figure 39B:
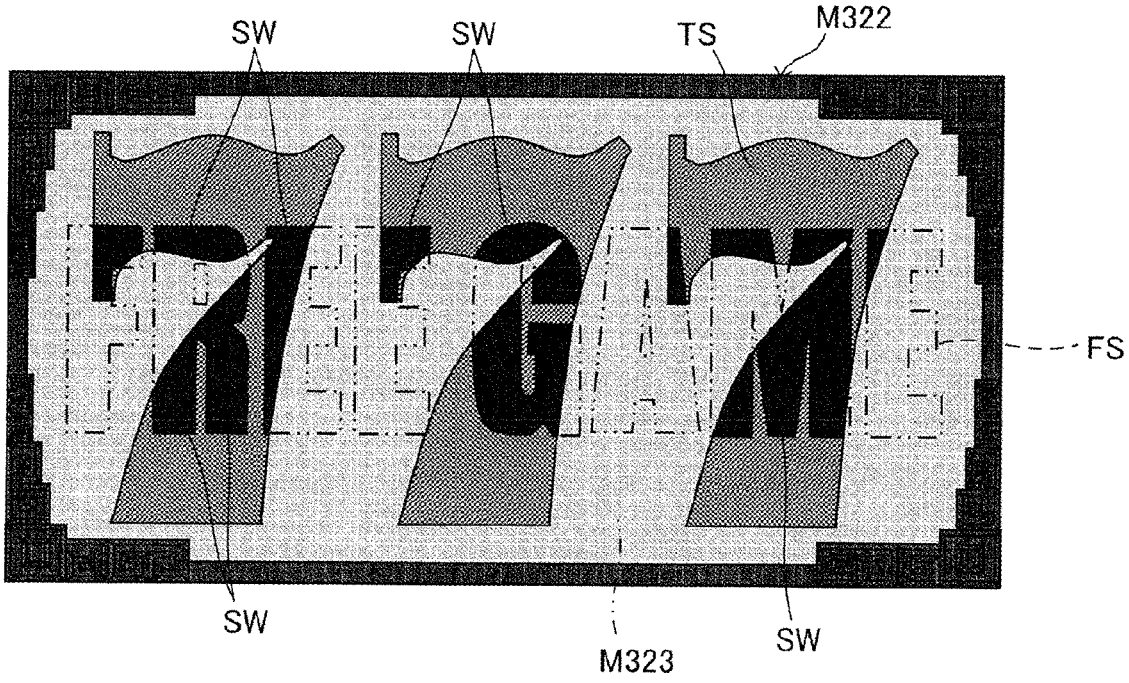
FIG. 39B is a plan view showing the status in which the three seven symbols are displayed.

In addition, when the FREE GAME symbol sheet M323 and the symbol sheet M322 are overlapped with each other, a part SW (a black painted part in figure) of the number symbol "777" part (the three seven symbol TS) that is overlapped with the letters "FREE GAME" (the FREE GAME symbol FS) is displayed in green because the green part provided in part of the letter symbols "FREE GAME" of the FREE GAME symbol sheet M323 is located in front thereof, as shown in FIG. 39B. Furthermore, the rest of the part of number symbol "777" other than the SW is the region in which red color of the FREE GAME symbol sheet M323 overlaps with the part of the three seven symbol sheet M326 which is transparent with no color. Then, it is structured that the FREE GAME symbol sheet M323 and a part of the green part of the symbol sheet M322 are slightly overlapped with each other at the outline part of the number of the number symbol "777".

In the present embodiment, the color arrangement and superimposing structure as described above is employed with regard to the FREE GAME symbol sheet M323 and the symbol sheet M322. Therefore, when red light is irradiated from inside of the reel belt M32 so as to visibly display the three seven symbol TS, the green part of the "777" number symbol that is not the red part may not be able to be recognized as the region of the number symbol, similar to the state where the FREE GAME symbol becomes invisible due to the overlapped part SW being green. In actuality, however, the symbols do not become impossible to be recognized or almost invisible because the letters are missing as shown in FIG. 12A.

As described above, it is possible to reduce the effect in which a part thereof seems to be missing and cannot be recognized to be exerted on the green part of the number symbol "777" (the three seven symbol TS) described above. It is because of the adjustment of intention of amount of red light of the backlight, as well as the fact that the overlapped green part of the front and back sheets M322 and M323 constitutes the outline part of the three seven symbol TS when the part of the three seven symbol TS is composed of the other color (green in the case of the three seven symbol TS) which may be impossible to be distinguished from the color for displaying the region of the symbol itself (red in the case of the three seven symbol TS).

Furthermore, the other reason may be the effect of the size and the position of overlapping. More specifically, a missing symbol that is likely to be displayed is made larger than the other symbols, and the other symbol is overlapped with the larger symbol at the center part thereof.

Therefore, the structure of the present embodiment does not produce the state in which no color is displayed in the overlapped part SW of the 7 symbol or the 7 symbol cannot visibly be seen in the symbol to be actually viewed by a player, so that it becomes hardly noticeable whether no color is displayed as shown in FIG. 12A.

Of course, it may be appropriately selected which of the three seven symbol TS or the FREE GAME symbol FS is displayed. Furthermore, the method may be employed in which the three seven symbol TS and the FREE GAME symbol FS are displayed by switching them alternately.

The half mirror layer M324 reflects light irradiated form an illumination device R1 described below (refer to FIGS. 4 to 6), and the reflected light makes it possible to display an image on the reels M3*a* to M3*e*. The half mirror layer M324 is structured to pass the light from the backlight device M7 (refer to FIGS. 4 and 15) and to reflect light from the illumination device R1 (refer to FIGS. 4 to 6).

Figure 13A:
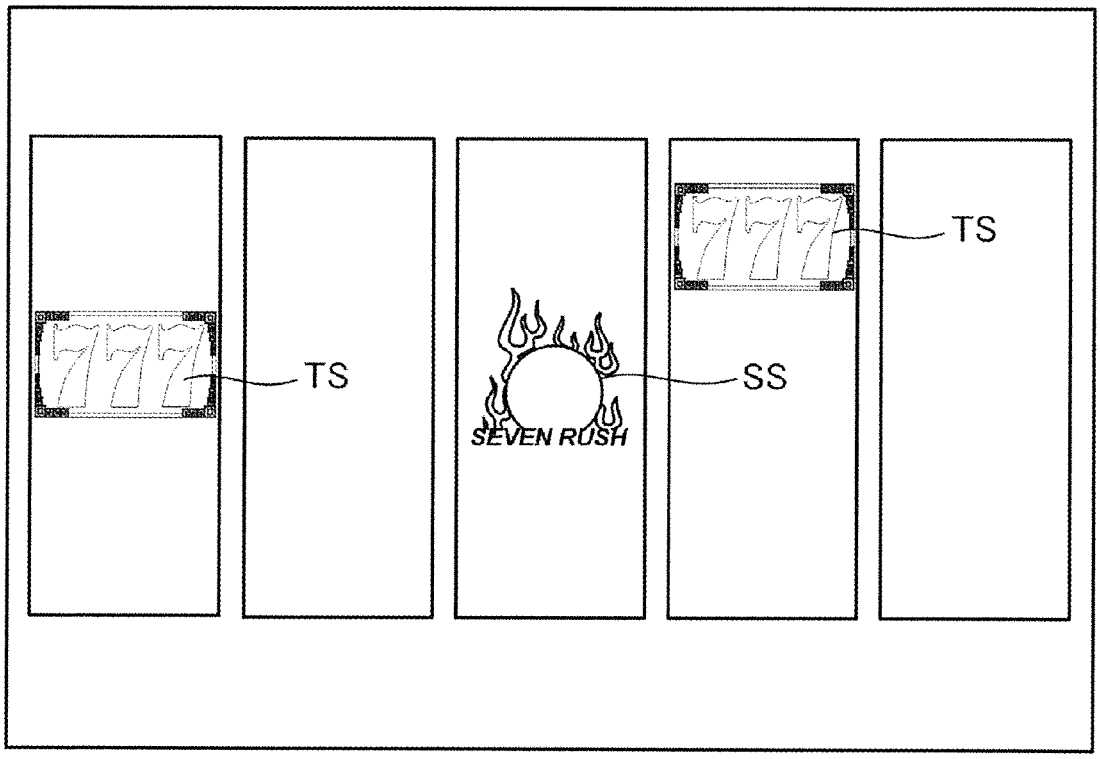
FIGS. 13A and 13B are front views showing the status in which a specific symbol is displayed prominently.

The smoke layer M325 is for making a specific symbol more noticeable than the other symbols. In the reel belt M32 shown in FIGS. 9 and 10, the smoke layer M325 is formed at the part in which the three seven symbol TS and the FREE GAME symbol FS are overlapped with each other, and the part except for the SEVEN RUSH symbol SS. Therefore, in the reel belt M32, for example, the three seven symbol TS and the SEVEN RUSH symbol SS can be made noticeable compared with the other symbols, as shown in FIG. 13A. As described below, since the three seven symbol TS and the SEVEN RUSH symbol SS play an important role in the free game, the symbols TS and SS are made noticeable in the free game.

Figure 13B:
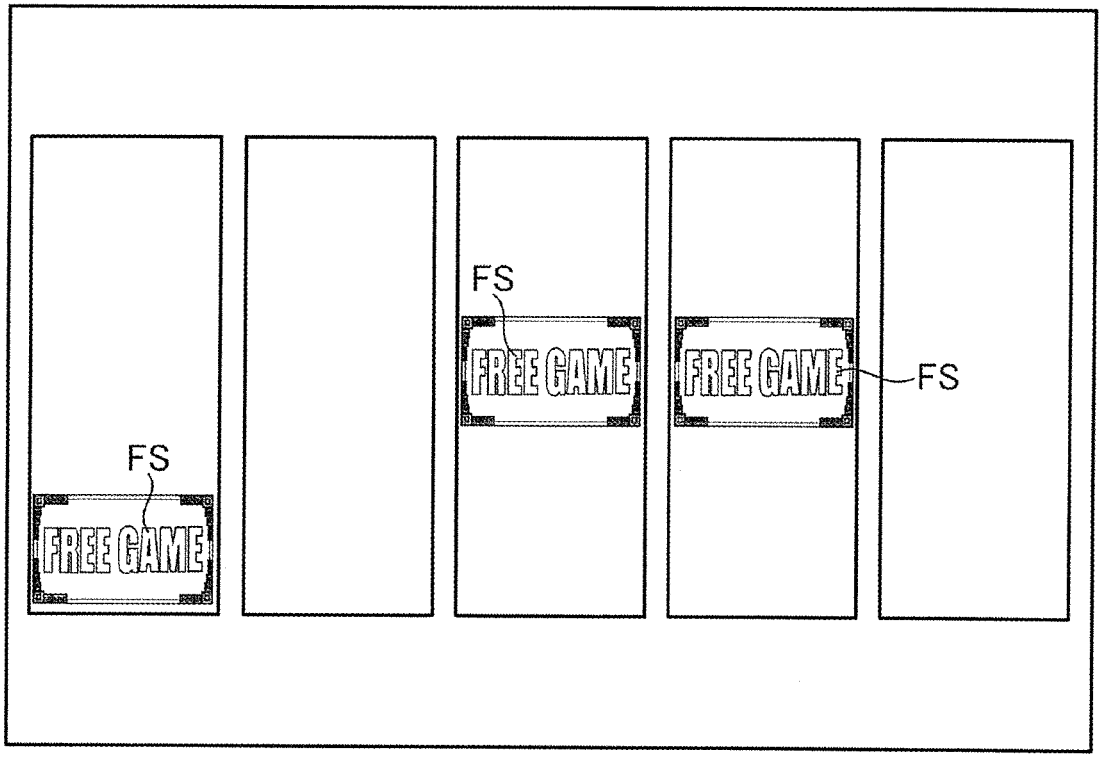

On the other hand, the smoke layer M325 is not formed at the part in which the three seven symbol TS and the FREE GAME symbol FS are overlapped with each other, so that the FREE GAME symbol FS can be made more noticeable than the other symbols, as shown in FIG. 13B. As described below, since the FREE GAME symbol FS plays the important role in the normal game, the FREE GAME symbol FS is made noticeable in the normal game.

Of course, the three seven symbol TS and the SEVEN RUSH symbol SS, or the symbols except for the FREE GAME symbol FS may be structure to be made noticeable. Furthermore, the way of making a specific symbol noticeable is not limited to the method using the smoke layer, but the other method may be used. In addition, in the present embodiment, a modification example of the method for making a specific symbol will be described below with reference to FIGS. 35 to 38.

The structure of the reel belt M3 is not limited to that shown in FIGS. 9 and 10, but the structure in which a transmission limiting layer and a diffusion layer are provided on the front surface and back surface of the base layer M321.

The transmission limiting layer is to avoid passing too much amount of light. The transmission limiting layer is made of a white sheet having a slight transparency, for example, and is located between the half mirror layer M324 and the diffusion layer if the diffusion layer is provided.

The diffusion layer is the sheet for diffusing the light that is shaped into the symbol. The diffusion layer may be composed of a single layer or a plurality of layers.

Figure 14A:
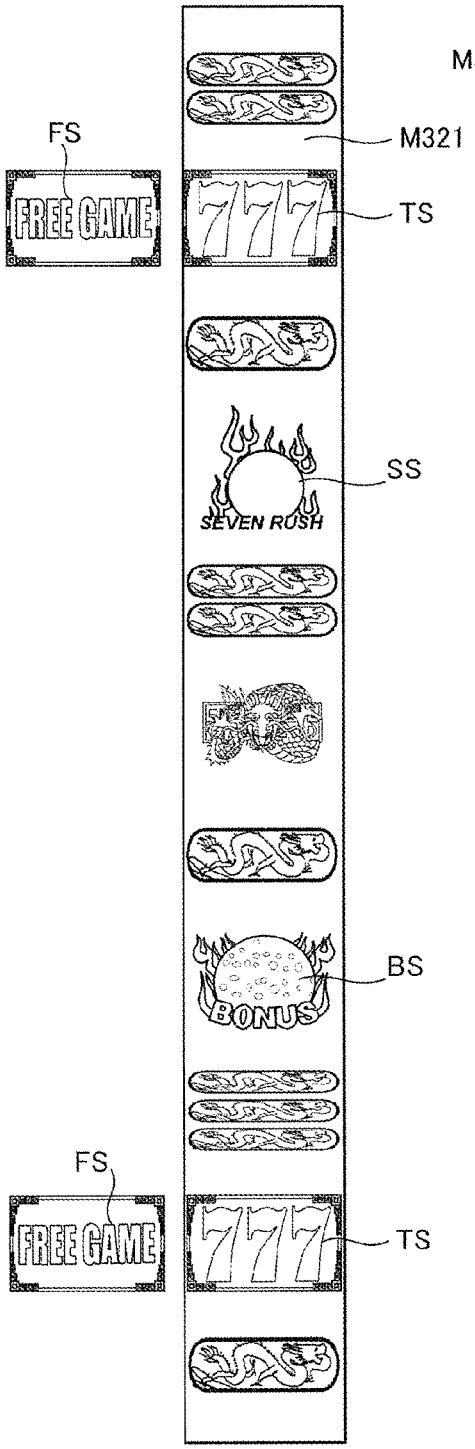
FIGS. 14A and 14B are explanatory views showing the other example in which the FREE GAME symbol and the three seven symbols are overlapped on the reel belt.
Figure 14B:
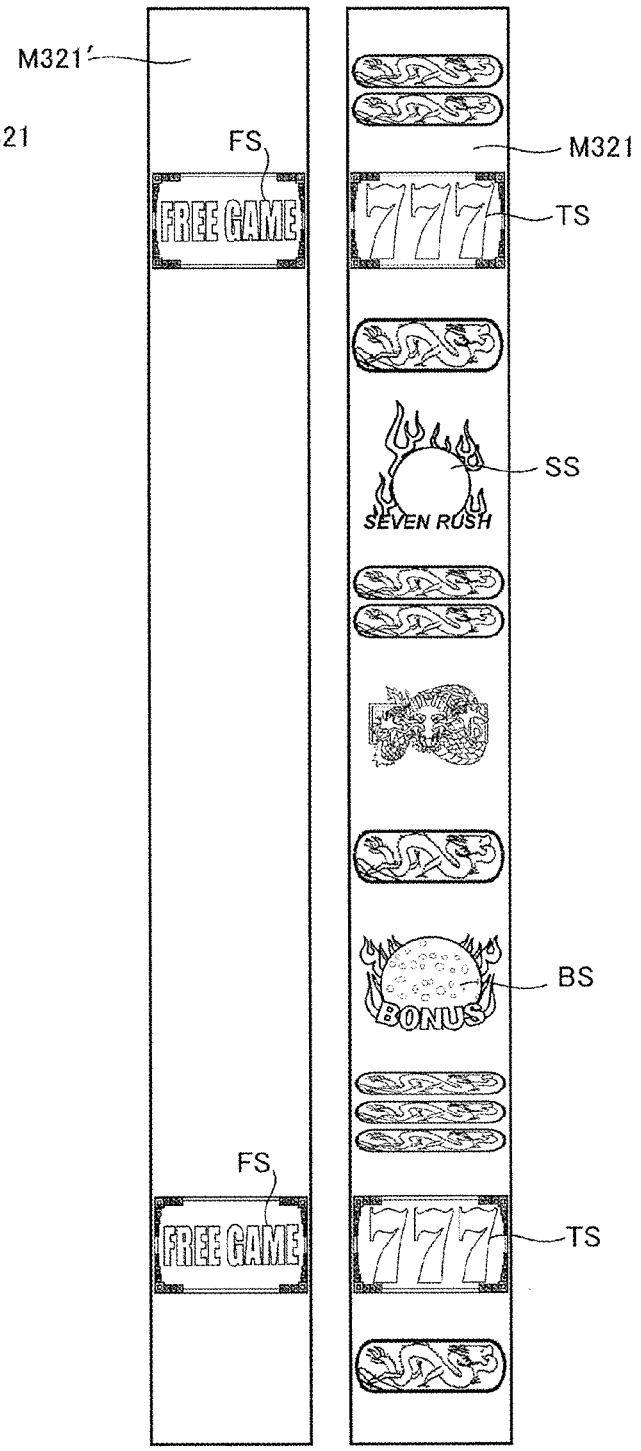

The structure in which the three seven symbol TS and the FREE GAME symbol FS are overlapped with each other in the reel belt M3 is not limited to that shown in FIGS. 9 and 10, but can be changed as shown in FIGS. 14A and 14B, for example.

In the example shown in FIG. 14A, the symbol corresponding to the plurality of symbol sheets M322 may be fabricated on the base layer M321. In this case, each of the symbols is formed by printing them on the base layer M321. Of course, a sheet of the FREE GAME symbol FS may be formed and stuck on the base layer M321 while fabricating the three seven symbol TS on the base layer M321.

In the example shown in FIG. 14B, the base layers M321 and M321' may be stuck with each other while fabricating the symbol corresponding to the plurality of symbol sheets M322 on the base layer M321 and fabricating the three seven symbol TS on the other base layer M321'.

(Reel Assembly M11: Backlight Device M7)

Figure 5:
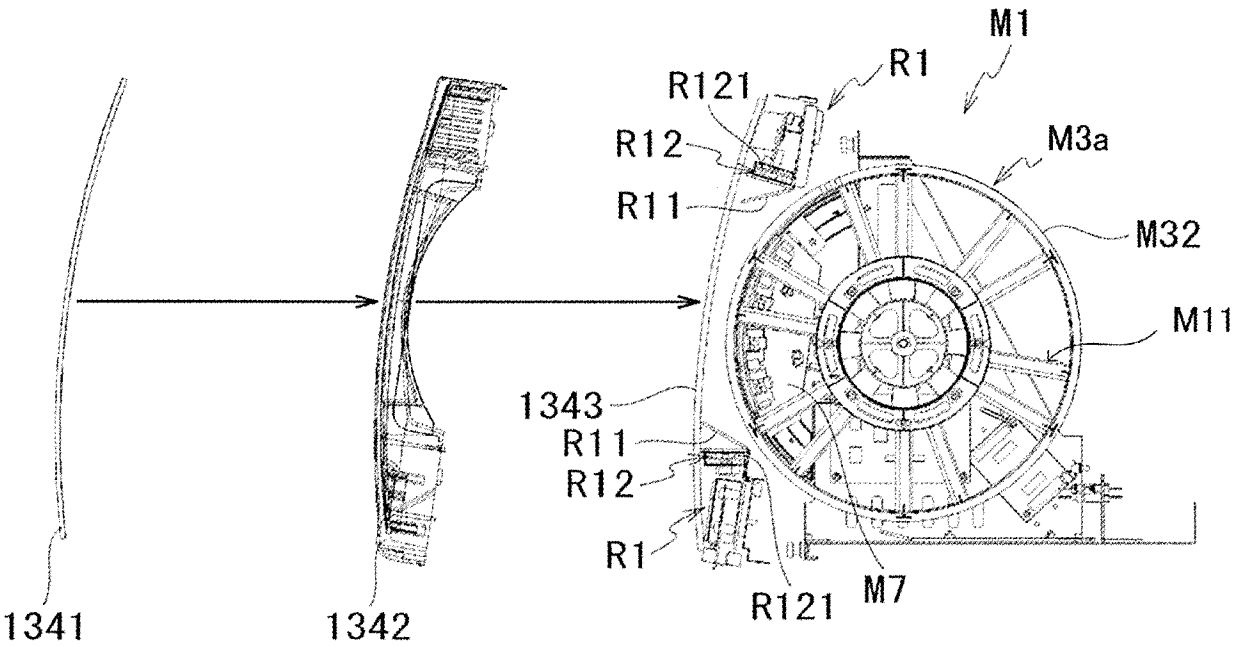
FIG. 5 is an exploded perspective view of a reel unit and a reel cover.

As shown in FIG. 5, the backlight device M7 is provided at the inner peripheral side of the reels M3*a* to M3*e* structured as described above. The backlight device M7 is provide so that illumination light is emitted from the inner peripheral side of the reels M3*a* to M3*e* in the direction of the reel belt M32, and the illumination light passed through the reel belt M32 is visible from outside of the gaming machine 10. Thus, a player recognizes the symbol 501 as being displayed on the reel belt M32.

Figure 7:
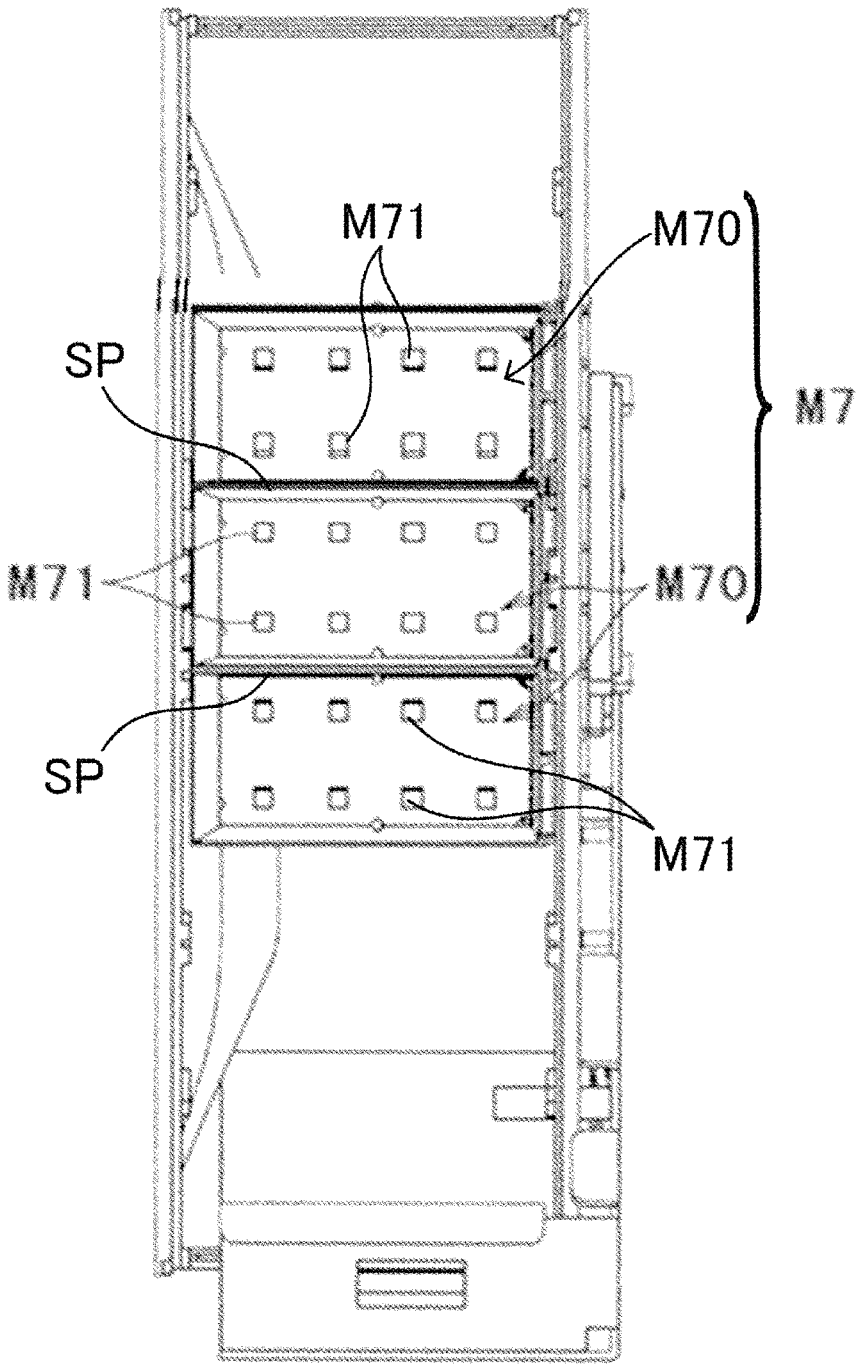
FIG. 7 is a front view showing a part of a backlight device.

The backlight device M7 is provided for corresponding to each of the reels M3*a* to M3*e*, which is not accurately shown in the figure. As shown in FIG. 7, the backlight device M7 includes a unit composed of a plurality of modules M70 (three in the present embodiment) in which a plurality of light source devices M71 is arranged in matrix. Each of the light source devices M71 is a full-color LED in which a red LED element capable of emitting red light, a blue LED element capable of emitting blue light, and a green LED element capable of emitting green light are packaged. In each of the light source devices M71, the main CPU 222 controls the lighting and extinguishing of the red LED element, the blue LED element, and the green LED element, and the individual amount of light at the time of lighting for each LED element. More specifically, the light source device M71 can form a visible light with an arbitrary color by adjusting the amount of light of each of the LED elements.

For example, the three seven symbol TS is displayed in red by receiving the irradiation with red light, and the FREE GAME symbol FS is displayed in green by receiving the irradiation with green. Therefore, each of the light source devices M71 controls the light emission status so as to light the red LED element and extinguish the other LED elements when displaying the three seven symbol TS, and so as to light the green LED element and extinguish the other LED elements when displaying the FREE GAME symbol FS.

(Irradiation Light Device R1)

As shown in FIGS. 4 to 6 and 15, the irradiation light device R1 for emitting visible information 902 toward each of the reels M3*a* to M3*e* of the reel device M1 is arranged. The irradiation light device R1 is arranged at the upper position and the lower position of the reel device M1 that is provided with the plurality of reels M3*a* to M3*e*. Thus, the irradiation light device R1 is arranged at the position out of the line of sight region in which a player can visibly recognize the reels M3*a* to M3*e* from outside of the cabinet 11 through a display window 150. The irradiation light device R1 makes it possible to carry out the effect in the display window 150 by reflected light of the visible light 901 irradiated on each of the reels M3*a* to M3*e*, as in the case of carrying out the effect in the display window 150 by means of the transparent liquid crystal panel and a half mirror arranged in front of the reels M3*a* to M3*e*. Therefore, the irradiation light device R1 makes it possible to carry out the effect in the display window 150 without saving the space for arranging the transparent liquid crystal panel and the like in front of each of the reels M3*a* to M3*e*.

In addition, the irradiation light device R1 may be arranged at least one of the upper position and the lower position of the reel device M1. More specifically, the irradiation light device R1 may be structured to be arranged in the outer side region of at least one of the upper position and the lower position relative to the display window 150, and to emit the visible light 901 that is longer than the width of all of the reels M3*a* to M3*e* supported by the reel device M1.

The irradiation light device R1 is also provided in the reel cover 134 that acts as the front wall on the side of the display window 150. The irradiation light device R1 and the reel cover 134 are combined as a single unit. Therefore, the irradiation light device R1 can be attached simultaneously with the attachment of the reel cover 134 to the cabinet 11.

In addition, the irradiation light device R1 is set to emit the visible light 901 on the surface of the reel device M1. In other words, it is set to emit the visible light 901 to the region at the side of non-effective range except for the effective range of the symbol 501.

More specifically, the irradiation light device R1 has a translucent panel R11 (a translucent member) provided at the opening 1343*a* of the panel support body 1343, and the light source device R12 that emits the visible light 901. The translucent panel R11 is tinted so as to form visible information 902 with a predetermined color by passing the visible light 901 therethrough. The translucent panel R11 has substantially same dimension as the width of the reel device M1. Furthermore, the light source device R12 is formed to emit the visible light 901 across the entire width of the translucent panel R11.

Figure 6:
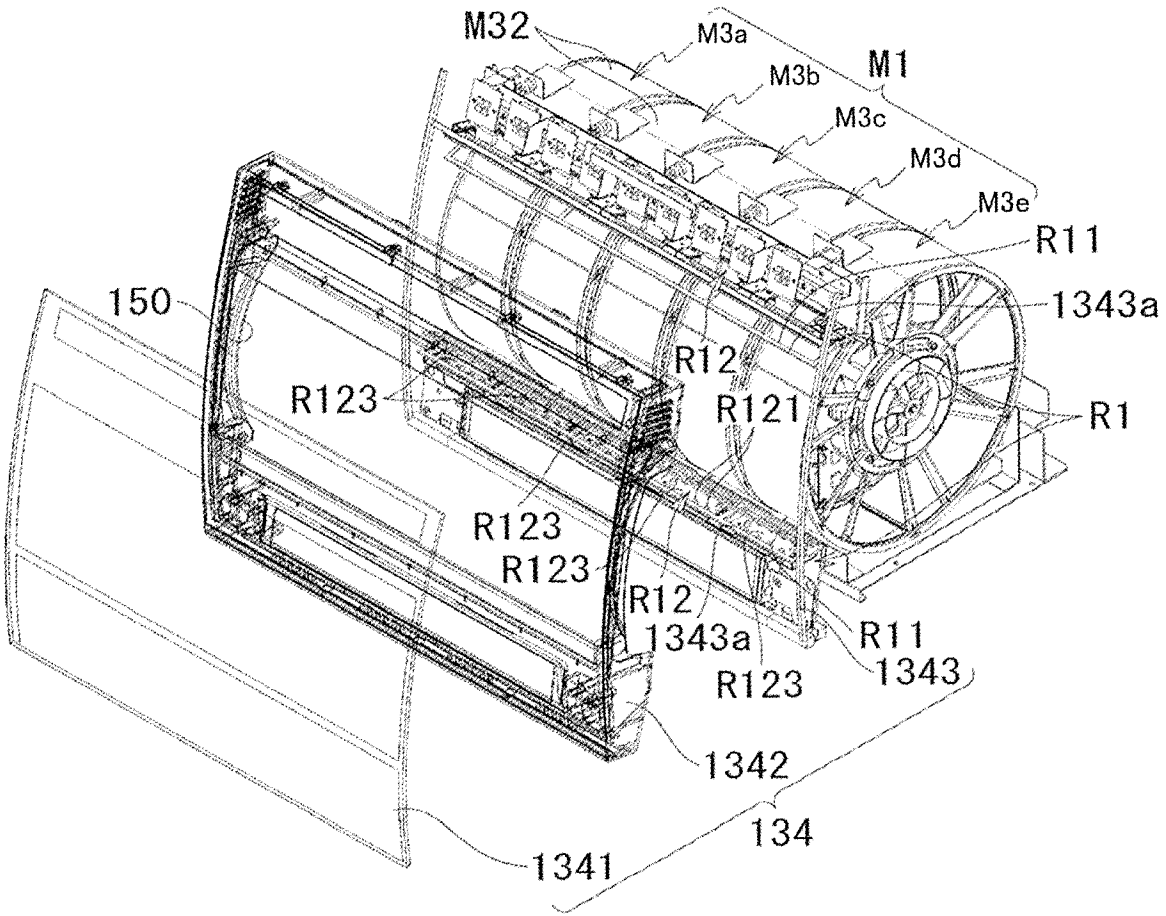
FIG. 6 is an exploded perspective view of a reel unit and a reel cover.

The light source device R12 has a plurality of full-color LEDRs 121, which is the structure similar to that of the light source device M71 of the backlight device M7. These full-color LEDRs 121 are aligned in the width and depth directions to form a matrix. More specifically, as shown in FIG. 6, the light source device R12 is structured so that an LED unit R123 is provided in which two pairs of four full-color LEDRs 121 aligned in two rows and two columns are arranged in the direction of the width of the reel belt M32, and the LED unit R123 is arranged to correspond to each of the reels M3*a* to M3*e*. Thus, the control of the position of lighting the full-color LEDs makes it possible to adjust the position of emitting light to the reel device M1.

Figure 15:
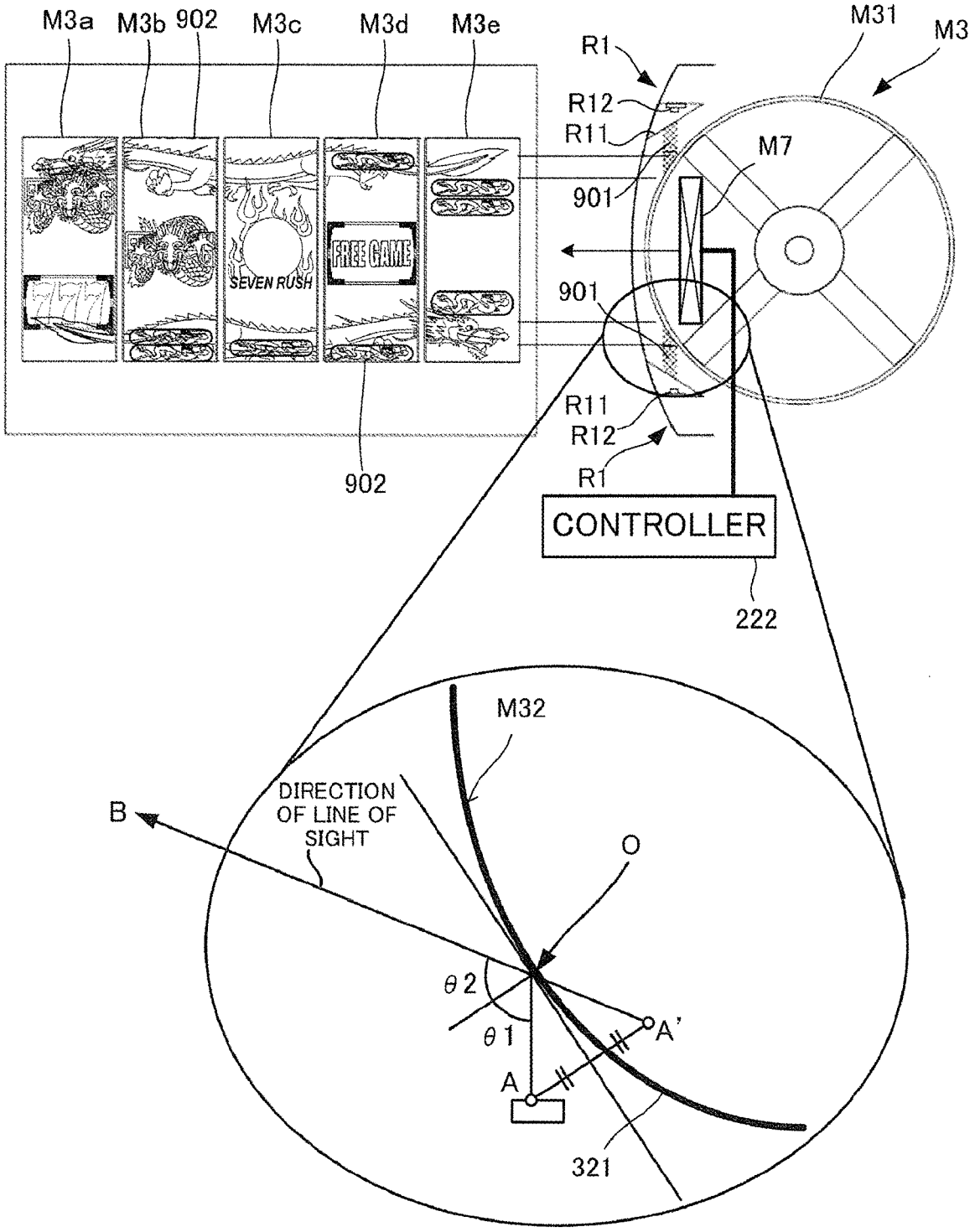
FIG. 15 is an explanatory view of the way of displaying the effect utilizing the reel.

The light source device R12 selectably emits the visible light 901 that is a complementary color to the tint of the translucent panel R11, and the visible light 901 which has a color other than that complementary color. More specifically, if the translucent panel R11 is tinted red, the visible light 901 in green that is a complementary color to red and the visible light 901 in red other than green are selectably emitted. Thus, the irradiation light device R1 switches the visible light 901 with the complementary color and the visible light 901 with the color other than the complementary color, so that it is possible to disable or enable the showing of the visible information 902 (a picture of a dragon) on the reels M3*a* to M3*e* as shown in FIG. 15.

In addition, the light source device R12 of the present embodiment makes it possible to easily form the visible light 901 with the color as being the complementary color and the visible light 901 with the color other than the complementary color by means of a single full-color LED. However, it is not limited to the full-color LED, but it can be formed by an LED with a single color for outputting the visible light 901 with the complementary color and an LED with a single color for outputting the visible light 901 with the color other than the complementary color.

(Depth Display by the Irradiation Light Device R1)

The irradiation light device R1 structured as described above is arranged at the position out of the line of sight region in which a player can visibly recognize the reels M3*a* to M3*e* from outside of the cabinet 11 through a display window 150, so that it is possible to display the depth of the visible information 902.

A detailed description will be made with regard to displaying the depth based on the FIG. 15. The term "viewing" to a player refers to the visible light 901 that is irradiated on and reflected from an object and then enters into a player's eyes. Here, the visible light 901 has the property of traveling in a straight line if there is no obstacle. Then, if there is any obstacle, the visible light 901 is reflected by the obstacle. The reflection follows the rule of reflection in which an angle of incident θ1 and an angle of incident θ2 are same as each other.

In the present embodiment, the visible light 901 is reflected by the half mirror layer M324 of the reel belt M32. Accordingly, the symbol 501 of the reel belt M32 is viewed by means of the reflected light of the visible light 901 reflected at the reel belt M32.

On the other hand, the visible information 902 of the visible light 901 is viewed over a route described below because the half mirror layer M324 is a mirror. More specifically, a point A', which is symmetric with a point A where the visible information 902 is formed, is drawn with respect to a tangent of the reels M3*a* to M3*e* at the position where the visible light 901 is reflected. That is, the reflection of an image appears at A'. Then, the symmetric point A' is connected with a position of a player's point of view B reached by a ray of light. Then, the straight line connecting the symmetric point A' and the position of point of view B is connected with an intersection point O of the reels M3*a* to M3*e*, and thus the visible light 901 is reflected at the intersection point O to reach the position of point of view B.

At that time, since a player seeing the incoming visible light 901 does not recognize the visible light 901 as entering into his/her eyes after being reflected at the point O, and assumes that the light travels straight to his/her eyes, the visible information 902 seems to be displayed at the position of the point A' in the depth side.

Thus, in the case where the visible information 902 is displayed at the position of the symbol upon viewing the symbol 501 of the reels M3*a* to M3*e* from outside of the cabinet 11 through the window 150, since the visible information 902 is the reflection light of the visible light 901 from the irradiation light device R1 which is arranged at the position out of the direction of line of sight, the visible information is viewed to be arranged at the position in the direction of line of sight (the depth side) extending into the inner peripheral side of the reel by the distance from the position of the symbol to the position where the irradiation light device R1 is arranged.

In addition, the reel belt M32 of the reel device M1 may have a blank symbol as one of the symbols 501. In this case, the irradiation light device R1 is structured to display the visible information 902 by irradiating the visible light 901 in the region for forming the blank symbol, so that the visible information 902 can be formed on the reel belt M32 in addition to the symbol 501 of the reel belt M32. Therefore, it is possible to drastically change and increase the design of the reel belt M32 and the types of the symbol 501.

Figure 16A:
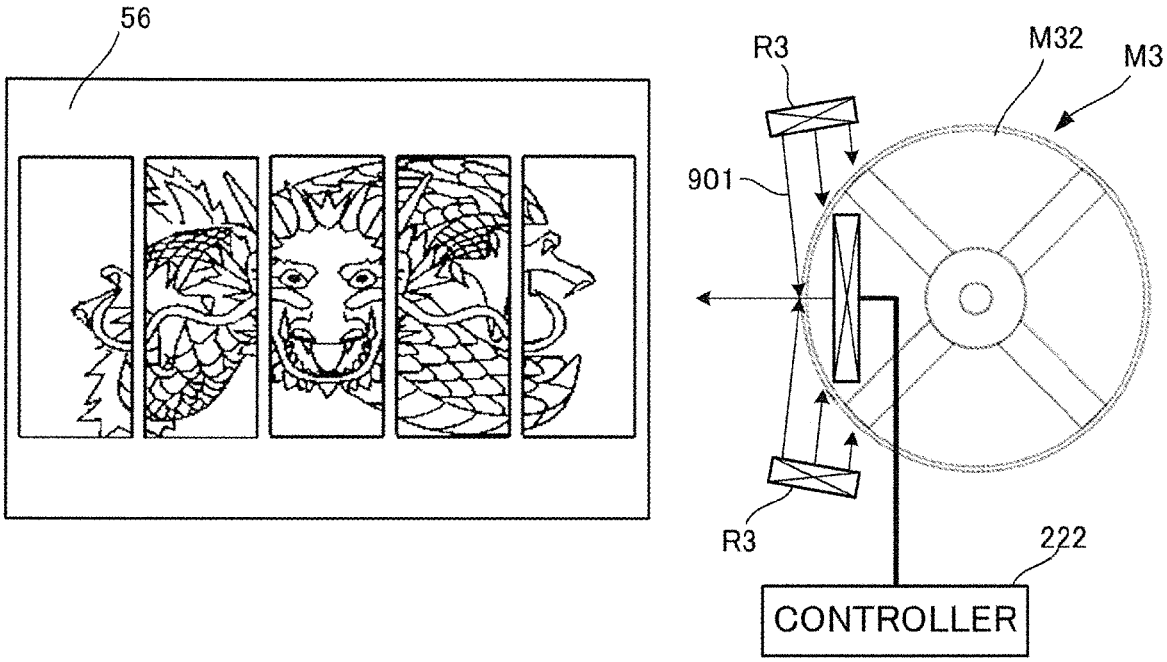
FIG. 16A is a schematic diagram for explaining the other example of the way of displaying the effect utilizing the reel.
Figure 16B:
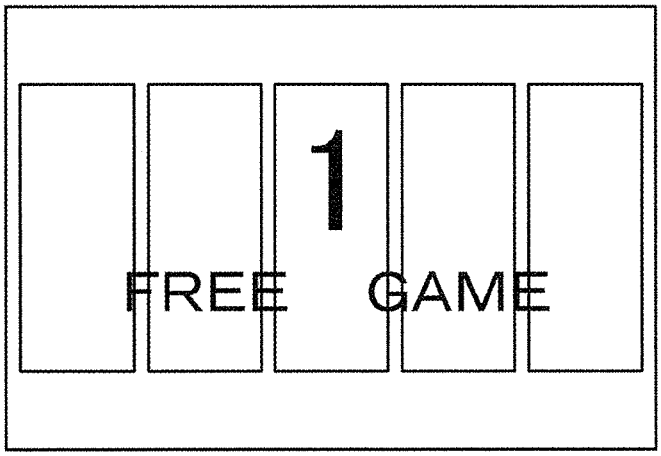
FIG. 16B is a schematic diagram for explaining the other example of the way of displaying.

Furthermore, as shown in FIG. 16A, the visible light 901 may be irradiated by the irradiation light device R3 on the region of the reel belt M32 which is visible from the display window 56 so as to display an image within the whole of the visible region. In this case, the image may be the symbol put on the reel belt M32, whereas the number of free games which is added in the free game may be displayed as shown in FIG. 16B, for example.

Figure 17A:
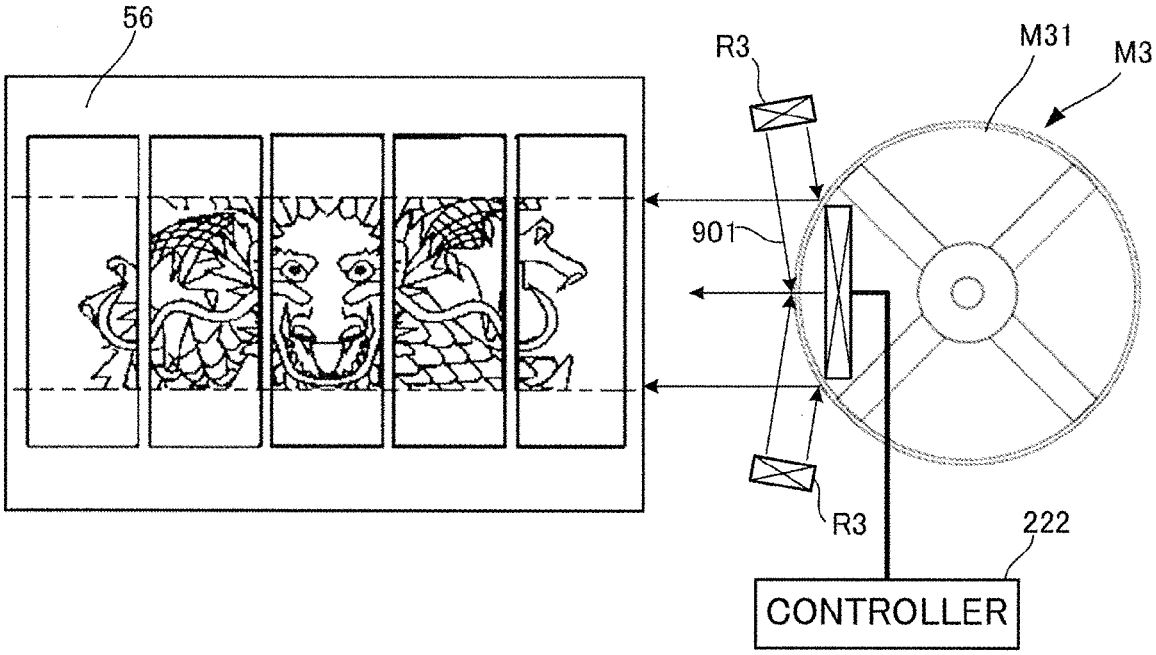
FIG. 17A is a schematic diagram showing for explaining the other example of the way of displaying the effect utilizing the reel.
Figure 17B:
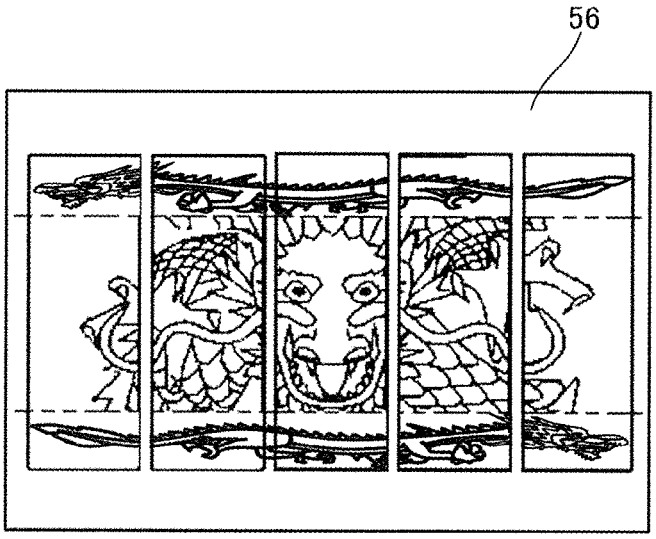
FIG. 17B is a schematic diagram for explaining the other example of the way of displaying.

As shown in FIG. 17A, the irradiation light device R3 may emit the visible light 901 to the central part of the region in the reel belt M32 that is visible from the display window 56 so as to display an image within the whole of the visible region. In this case, the image may be displayed by using the different illumination devices R1 and R3 for the central part and the vertical end part in the region that is visible from the display window 56, along with the illumination device R1 shown in FIG. 15, as shown in FIG. 17B.

[Electrical Configuration of the Slot Machine]

Figure 18:
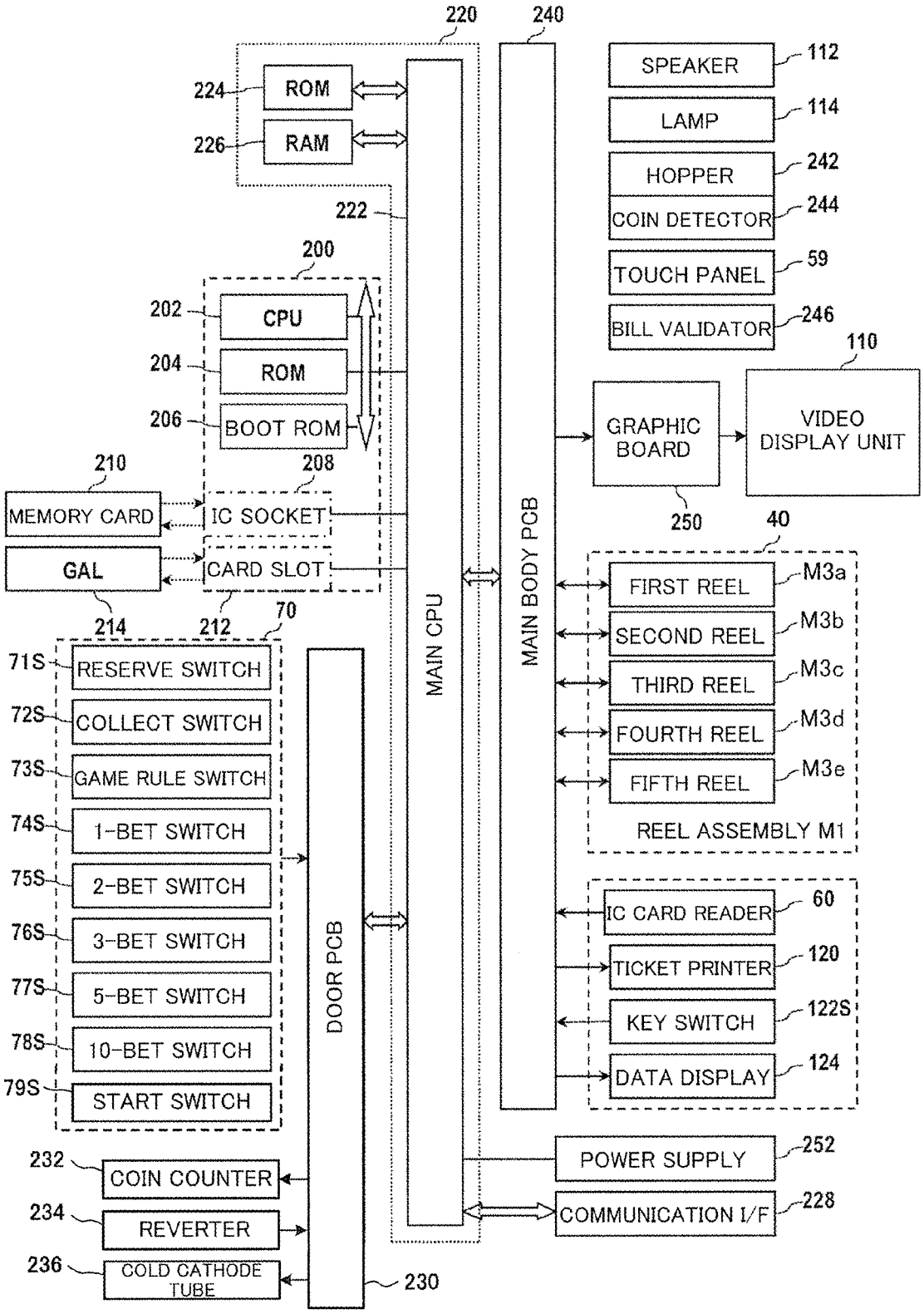
FIG. 18 is an electrical block diagram of the gaming machine shown in FIG. 2.

FIG. 18 is an electric block diagram of the gaming machine 10 shown in FIG. 2. The gaming machine 10 includes a game board 200, a motherboard 220, a door PCB 230, and a main body PCB 240.

A game board 200 includes a CPU 202, a ROM 204 accessible from the CPU 202 through an internal bus, and a boot ROM 206 accessible from the CPU 202 by an internal bus. The game board 200 includes an IC socket 208 which can accommodate a memory card 210 and communicate therewith, and a card slot 212 provided corresponding to a Generic Array Logic (GAL) 214.

The memory card 210 includes a non-volatile memory and stores a game program and a game system program.

The IC socket 208 is configured to be removably attached by the memory card 210. The IC socket 208 is connected to a motherboard 220 by an IDE bus. The game executed in the gaming machine 10 can be changed by replacing the memory card 210 with another one. The game executed in the gaming machine 10 also can be changed by withdrawing the memory card 210 from the IC socket 208, writing another program into the memory card 210, and then inserting the memory card 210 into the card slot 208 again.

The GAL 214, which is a type of a Programmable Logic Device (PLD) having a fixed OR array structure, has a plurality of input ports and output ports. Upon receiving a predetermined data through the input ports, the GAL 214 outputs data corresponding to the input data through the output ports.

The card slot 212 is configured in such a manner that the GAL 214 can be inserted into the card slot 212 or detached from the IC socket 212, and is connected to the motherboard 220 by a PCI bus.

The CPU 202, the ROM 204, and the boot ROM 206 interconnected by the internal bus are connected to the motherboard 220 by the PCI bus. The PCI bus enables signal transmission between the motherboard 220 and the game board 200, and supply of power from the motherboard 220 to the game board 200.

The ROM 204 stores a program. The boot ROM 206 stores a preliminary authentication program, a boot code to be used by the CPU 202 for activating the preliminary authentication program, and the like. The authentication program is a falsification check program for authenticating that the game program and the game system program are legitimate. The preliminary authentication program is a program for authenticating that the authentication program is legitimate. The authentication program and the preliminary authentication program are written in a process of verifying that the program of interest is not falsified.

A commonly available main board is used as the motherboard 220, and thus the motherboard 220 executes the game program and the game system program. The motherboard 220 includes a main CPU 222, a ROM 224, a RAM 226, and a communication interface 228.

The ROM 224 is a memory device for storing a program to be executed by the main CPU 222, and is maintained permanently along with the other data, like BIOS. The ROM 224 may be a flash memory. The BIOS program initializes peripheral devices when executed by the main CPU 222. Also, the BIOS program loads the game program and the game system program stored in the memory card 210 through the game board 200. The ROM 224 may be rewritable. However, write-protected one might be used as the ROM 224 as well.

The RAM 226 stores data and programs which are used while the main CPU 222 is in operation. For example, when the game program, the game system program, or the authentication program is to be loaded, the RAM 224 can store such programs. Also, the RAM 226 is provided with working space for the execution of the programs. For example, the space stores the number of bets, the payout amount, the credit amount, etc., which are maintained during the execution of the game. Also, a plurality of tables for defining symbols, symbol codes, winning combinations, and their probabilities is maintained during the execution of the game. Further, the RAM 226 stores a symbol code determination table. The symbol code determination table stores mapping information between symbol codes and random number which are used for determining symbols based on random numbers. In particular, the RAM 226 maintains a mode flag along with a game counter. The mode flag is the flag indicating the game mode. The game counter is the count value indicating the number of unit games which has already been executed in the chance mode or the number of remaining unit games in the chance mode.

Also, the RAM 226 stores count values of a plurality of counters. The plurality of counters include a bet counter, a payout amount counter, a credit amount counter, and a chance mode game counter which counts the number of unit games in the chance mode. In addition, some of the count values may be maintained in an internal register of the main CPU 222.

The main CPU 222 communicates with an external controller through a communication interface 228. The external controller includes, for example, a server connected through a communication channel (not shown).

The motherboard 220 is connected to the door PCB 230 and the main body PCB 240. The motherboard 220 can communicate by means of USB with the door PCB 230 and the main body PCB 240. The motherboard 220 is connected to a power supply 252. The main CPU 222 of the motherboard 220 boots up and operates using the power supplied from the power supply 252. The motherboard 220 passes a part of power to the game board 200 through the PCI bus so as to boot up the CPU 202. The door PCB 230 and the main body PCB 240 are connected to an input device. The input device includes a switch, a sensor, and peripheral devices of which operation are controlled by the main CPU 222. The door PCB 230 is connected with a control panel 70, a coin counter 232, a reverter 234, and a cold cathode tube 236.

The control panel 70 has a reserve switch 71S, a collect switch 72S, a game rule switch 73S, a 1-BET switch 74S, a 2-BET switch 75S, a 3-BET switch 76S, a 5-BET switch 77S, a 10-BET switch 78S, and a start switch 79S, each of which is provided corresponding to various buttons 71-79. Upon detecting the fact that the various buttons 71 to 79 are pressed, each of the switches 71S to 79S outputs a signal to the main CPU 222.

The coin counter 232 and the reverter 234 are provided in the coin insertion unit 80. The coin counter 232 determines whether or not the coin inserted into coin insertion unit 80 is legitimate in terms of material, shape, or the like. The coin counter 232 outputs a signal to the main CPU 222 if detecting a legitimate coin. The coins which are determined as being illegitimate are discharged to the coin tray 92. The reverter 234 operates based upon a control signal from the main CPU 222. The reverter 234 distributes the coins that are determined by the coin counter 232 as being legitimate into either a hopper 242 or a cash box (not shown). The coins are guided into the hopper 242 when the hopper 242 is not filled with coins. Contrarily, the coins are guided into the cash box when the hopper 242 is filled with coins.

The cold cathode tube 236 is provided on the rear surface of the video display unit 110. The cold cathode tube 236 functions as a backlight as well as lights based on a control signal from the main CPU 222.

The main body PCB 240 is connected to the speaker 112, the lamp 114, the hopper 242, a coin detector 244, the touch panel 59, a bill validator 246, the reel assembly M1, the IC card reader 60, a graphic board 250, the ticket printer 120, a key switch 122S, and the data display 124.

The lamp 114 is turned on/off based upon a control signal from the main CPU 222. The speaker 112 outputs a sound such as BGM based upon the control signal from the main CPU 222.

The hopper 242, which operates based upon a control signal from the main CPU 222, pays out the designated payout amount of coins to the coin tray 92 through a coin payout outlet (not shown) formed between the lower glass part 90 and the coin tray 92. The coin detector 244 detects coins paid out from the hopper 242 to output a detection signal to the main CPU 222.

The touch panel 59 detects a position touched by the player, and then provides the main CPU 222 with a position detection signal corresponding to the detected position. Upon detection of a legitimate bill, the bill validator 246 provided in the bill insertion unit 82 provides the main CPU 222 with a bill detection signal corresponding to the bill amount.

The graphic board 250 controls both the video display unit 110 and the display panel 58 of the symbol display unit 40 corresponding to a control signal from the main CPU 222. The graphic board 250 includes a Video Display Processor (VDP) for generating video data, and a video RAM for temporarily storing the video data. The video data may be generated from the game program stored in the RAM 224.

The IC card reader 60 reads out data stored in the IC card inserted into the IC card socket 208 to provide the read-out data to the main CPU 222. The IC card reader 60 writes the data supplied to the main CPU 222 into the ID card.

The ticket printer 120 prints on a ticket the barcode containing information of the credit amount stored in the RAM 226, date and time, the identification number of the gaming machine 10, and the like, corresponding to the control signal from the main CPU 222 in order to output the barcoded ticket.

The key switch 122S, which is provided behind the keypad 122, outputs a key detection signal to the main CPU 222 when the keypad 122 is pressed by the player.

The data display 124 displays information on the information that is input through the keypad 122 corresponding to a control signal from the main CPU 222.

The main body PCB 240 is electrically connected to the reel assembly M1. The reel assembly M1 includes the first to fifth reels M3*a* to M3*e* as mentioned above.

Figure 19:
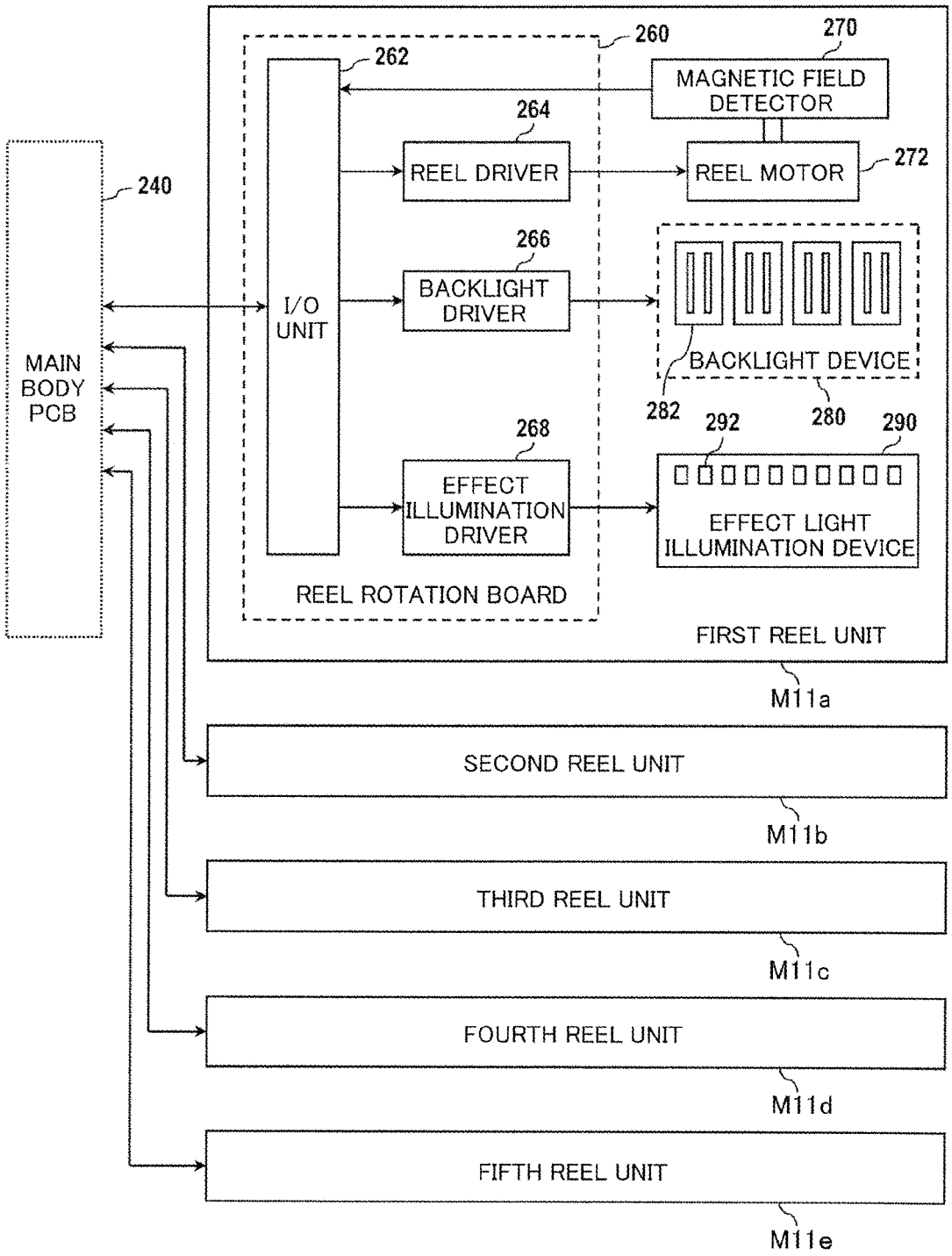
FIG. 19 is a block diagram of an electric circuit in the reel assembly.

FIG. 19 is a block diagram of an electric circuit in the reel assembly M1. Each of the reels M3*a* to M3*e* is provided on a reel rotation board base plate 260. The reel rotation board 260 includes a 20 input/output (I/O) unit 262 capable of communicating with the main body PCB 240, a reel driver 264 connected to the I/O unit 262, a backlight driver 266, and an effect illumination driver 268.

The I/O unit 262 is connected to a magnetic field detector 270. The magnetic field detector 270 includes a magnetic sensor for sensing magnetic field intensity to output a magnetic detection signal proportional to the magnetic field intensity, and a sensor fixation part for fixing the magnetic sensor to a predetermined position. The magnetic sensor detects the intensity of the magnetic field generated by a magnet. The magnet is provided at a rotating axis of a reel motor 272 to rotate with the reel 52A.

The reel driver 264 supplies electric power to the reel motor 272. The backlight driver 266 supplies electric power individually to each light source 282 in a backlight device M7. The effect light illumination driver 268 supplies electric power individually to each light source 292 of an effect light illumination device 290.

Since the second to fifth reels M3*b* to M3*e* have the same configuration as the first reel M3*a*, detailed description thereof will be omitted.

[Function of the Game Program]

Figure 20:
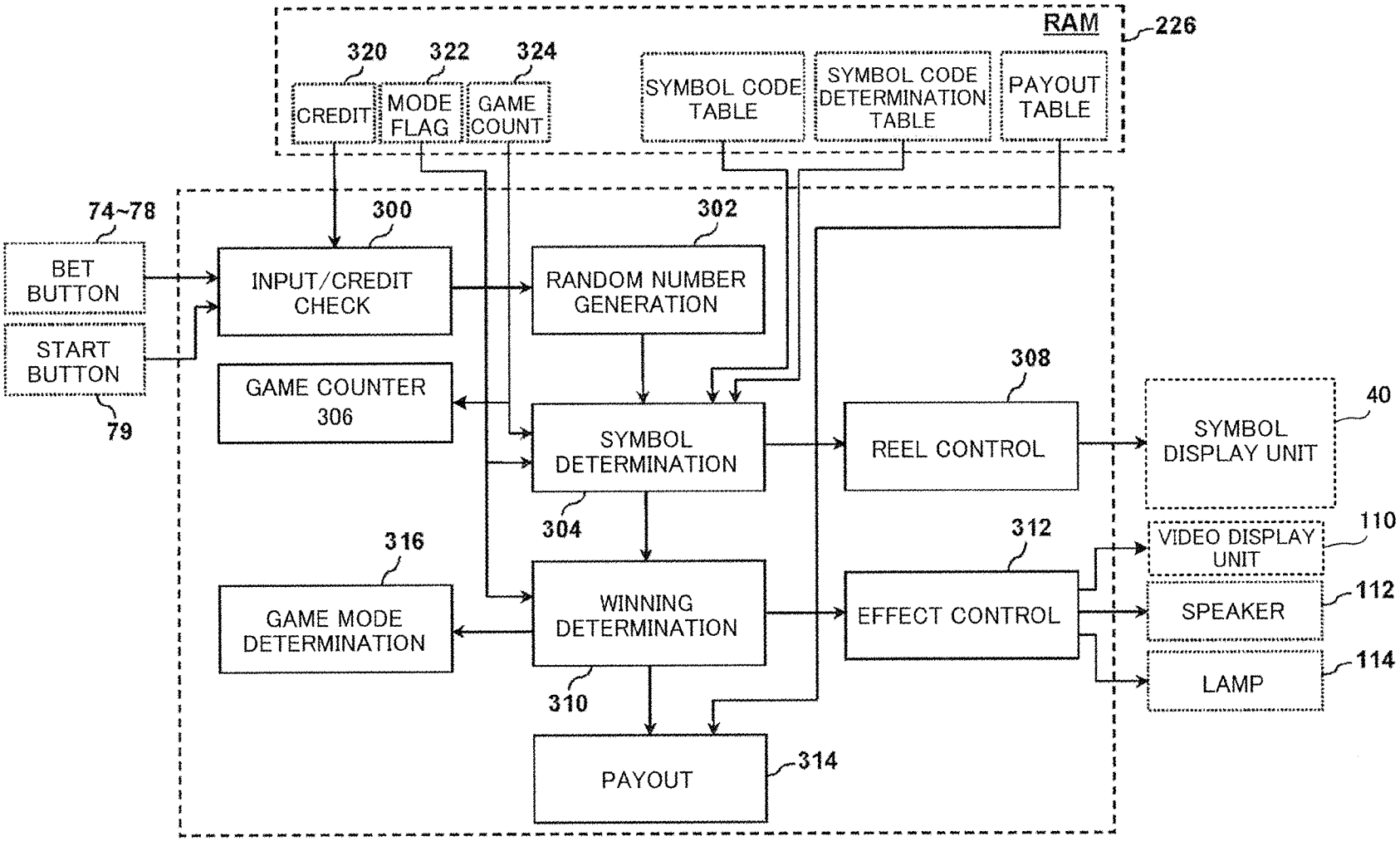
FIG. 20 is a block diagram showing the process of a game program executed by a main CPU 222 on the mother board 220.
Figure 21:
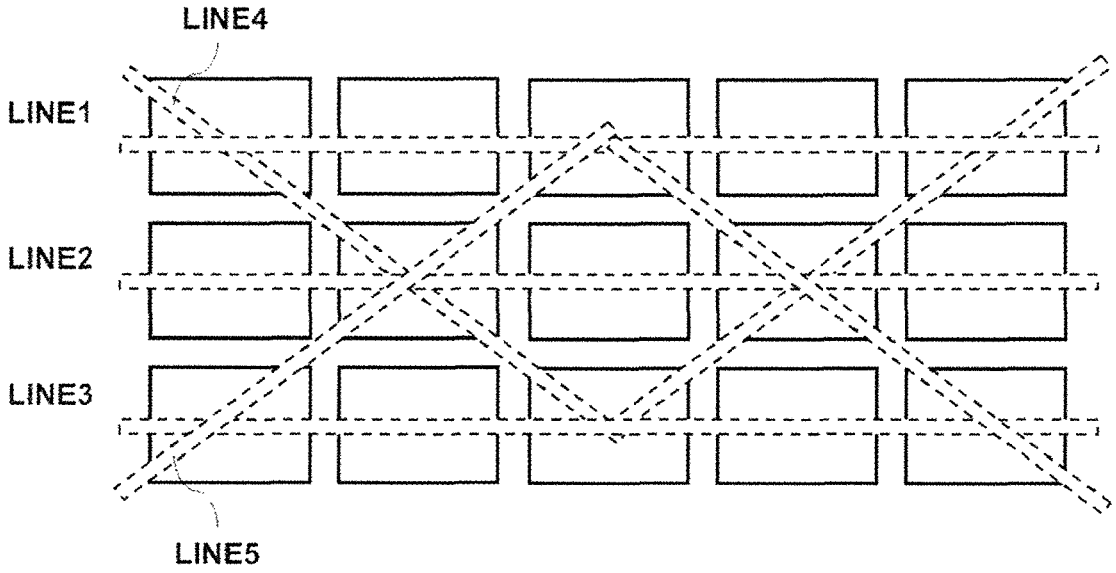
FIG. 21 is a diagram showing pay lines of the gaming machine according to the present embodiment.

FIG. 20 is a functional block diagram of the game program executed in the main CPU 222 of the motherboard 220. When the power is supplied to the gaming machine 10, the main CPU 222 reads the authenticated game program and game system program from the memory card 210 through the game board 200, and writes the programs into the RAM 226. The game program is executed in a state being loaded into the RAM 226 in such a manner.

According to the preferred embodiment, the game program includes a input/credit check process part 300, a random number generating process part 302, a symbol determination process part 304, a game counter process part 306, a reel control process part 308, a winning determination process part 310, an effect control process part 312, a payout process part 314, and a game mode determination process part 316.

(Input/Credit Check Process Part 300)

The input/credit check process part 300, in an idle state where the reels M3*a* to M3*e* are stopped, continuously checks whether or not any of the "BET" buttons 74 to 78 or the "START" button 20 79 is pressed. If the "BET" buttons 74 to 78 or the "START" button 79 is pressed, the input/credit check process part 300 checks whether or not there remains any credit for the player on the basis of the credit data 320 stored in the RAM 226. If at least one credit for the player remains, the input/credit check process part 300 call the random number generating process part 302.

Subsequently, the random number generating process part 302 generates random numbers which are used in the symbol determination process part 304. In the present embodiment, the random number generating process part 302 generates five random numbers. Each of the five random numbers is used in the first to fifth reels M3*a* to M3*e*, respectively.

After five random numbers are completely extracted, the symbol determination process part 304 determines a to-be-stopped symbol for each of the reels M3*a* to M3*e* with reference to the symbol code determination table stored in the RAM 226. The symbol determination process part 304 uses five random numbers to determine five to-be-stopped symbols for the reels M3*a* to M3*e* to be appeared in the display window 56 of the symbol display unit 40 for each of the reels M3*a* to M3*e*.

In particular, the symbol determination process part 304 checks the current gaming mode with reference to the mode flag 322 stored in the RAM 226. The process of determining symbols in the normal mode is different from the process of determining symbols in the chance mode. In the normal mode, the symbol determination process part 304 uses a predetermined symbol code determination table to determine the symbol using the random number in accordance with a predetermined process. Contrarily, in the chance mode, the symbol determination process part 304 continuously changes the symbol code determination table for each unit game to vary the symbol determination process. The continuous varying of the symbol code determination table can increase winning combinations including at least one specific symbol as the chance mode game continues. The number of chance mode games executable within a single session is limited to a predetermined number of times, e.g., seven times. In order to limit the number of times of chance mode games, the game counter process part 306 counts the number of times of chance mode games which have already been executed and the number of times of chance mode games which remain in that session. The value of the game count 324 is stored in the RAM 226. The game counter process part 306 may reside in the symbol determination process part 304.

The reel control process part 308 controls the reel assembly M11 by providing stop position information corresponding to the determined symbols. In this way, the reels M3*a* to M3*e* spins, followed by stopping at the position designated by the stop position information. More specifically, the symbols scroll along with the spinning of the reels M3*a* to M3*e*. Then, the reels M3*a* to M3*e* are stopped in such a manner that the determined symbols are rearranged in the central position vertically in the window 56 of the symbol display unit 40.

The winning determination process part 310 determines whether or not a predetermined winning combination is achieved by the rearranged symbols. In case that a winning combination is achieved by the rearranged symbols, the effect control process part 312 controls the symbol display unit 40 and the other devices. The other devices include the speaker 112, the lamp 114, the video display unit 110, etc. The effect includes video and audio effect, backlight change, and lighting effect. Also, the payout process part 314 determines payout amount corresponding to the achieved winning combination to give the player that payout amount.

Furthermore, each time the unit game is completed, the game mode determination process part 316 determines the game mode of the next unit game. The game mode determination process part 316 changes the mode from the normal mode into the chance mode when a trigger event occurs in the rearranged symbols. On the other hands, the game mode determination process part 316 changes the mode from the chance mode into the normal mode when an end condition is satisfied. In the other cases, the game mode determination process part 316 maintains the previous game mode. The game mode determination process part 316 may be run in the winning determination process part 310.

(Pay Line)

FIG. 9 shows pay lines employed in the gaming machine 10. In the gaming machine 10, five pay lines are set for the symbol matrix. First to third pay lines extend horizontally across the symbol stop positions in the first to third rows, respectively, in the symbol matrix. A fourth pay line extends in a "V"-shaped line joining the symbol stop position in the first row and the first column, the symbol stop position in the second row and the second column, the symbol stop position in the third row and the third column, the symbol stop position in the second row and the fourth column, and the symbol stop position in the first row and the fifth column A fifth pay line extends in a "reversed V"-shaped path joining the symbol stop position in the third row and the first column, the symbol stop position in the second row and the second column, the symbol stop position in the first row and the third column, the symbol stop position in the second row and the fourth column, and the symbol stop position in the third row and the fifth column Each of the pay lines can be activated depending on the player's choice. However, all the five pay lines can be activated irrespective of the betting amount or the player's choice. The total number of pay lines can vary depending on the size of the symbol matrix, and the other pay lines can be set appropriately.

(Symbol Appearance Probability Table)

FIG. 22 shows an example of a symbol appearance probability table.

The symbol appearance probability table is the table that determines the probability of appearance of the symbols. The symbol appearance probability table specifies the probabilities that each symbol appears in the pay lines. The symbol determination table defines the appearance probability for each of the normal game and the free game.

In the symbol appearance probability table, the probabilities of the three seven symbol TS and the SEVEN RUSH symbol SS in the normal game is set to be "0", while only the three seven symbol TS and the SEVEN RUSH symbol SS can win a prize as the winning hand in the free game and the probability for the other symbols is set to be "0". More specifically, the winning combination relating to the three seven symbol TS and the SEVEN RUSH symbol SS is not established in the normal game, while only the winning combination relating to the three seven symbol TS and the SEVEN RUSH symbol SS is established in the free game.

In addition, the probabilities of the winning hand and losing of the game may be appropriately set in response to the contents of the game.

(Payout Table)

FIG. 23 shows an example of a payout table.

The payout table is the table in which the relationships between the winning combinations and respective payouts and probabilities are summarized. In this payout table, the payout of the three seven symbol TS which is the important winning combination in the free game is defined to be "20" credits, and a single SEVEN RUSH is defined to induce no pay out. The payout may be appropriately set with regard to the other winning combinations, and the winning combinations also may be appropriately set.

In the gaming machine 10, the winning determination process part 310 refers to the payout table to determine whether or not any winning combination is achieved in the pay lines each time the unit game is executed. If the winning combination defined in the payout tables is included in one of the pay lines, the winning determination process part 310 detects the winning combination and checks the payout amount with reference to the payout tables. The payout process part 314 pays out the determined amount. On the other hand, the winning determination process part 310 determines that the game is so-called losing when determining that no winning combination is achieved by the symbols appeared on the pay line. The benefit of payout can be provided for the player by discharging coins to the coin tray 92, or adding the credits by the amount equivalent to the payout.

In addition, although FIG. 23 shows only one payout table, the payout tables may be provided separately for the normal game and the free game.

(Game State Transition)

Figure 24:
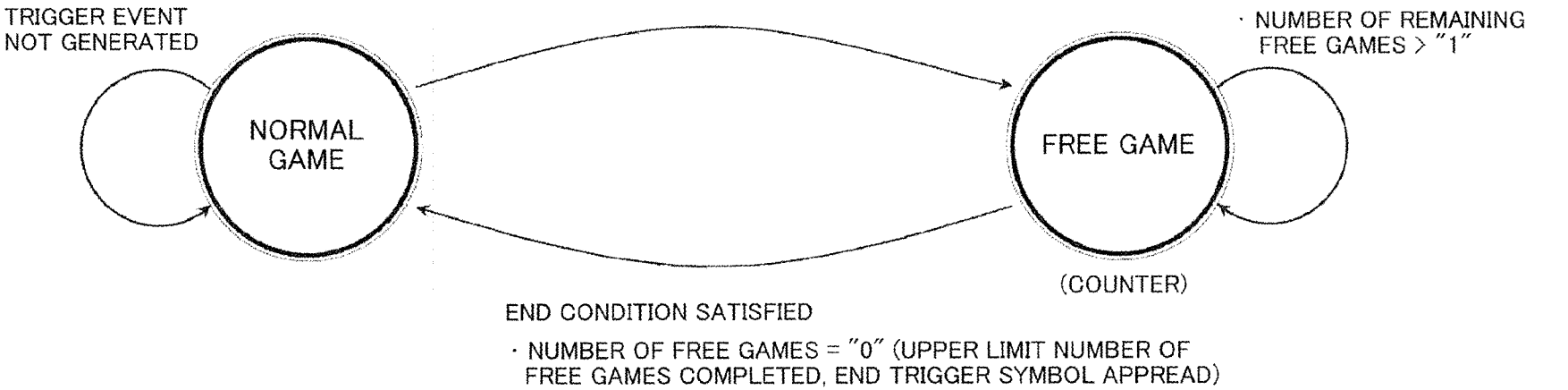
FIG. 24 is a state transition view in the gaming machine according to the present embodiment.

FIG. 24 is a state transition view in the gaming machine 10.

The gaming machine 10 executes at least two types of games including the normal game and the free game. The gaming machine 10 also executes a bonus game actually although it is not shown in FIG. 24. A variety of known bonus games can be employed as the bonus game.

The gaming machine 10 executes the normal game as being a main game, and shifts to the free game when a trigger event occurs in the normal game.

In the present embodiment, the trigger event is set to meet the condition in which more than the predetermined number of (such more than one or more than three) free game symbols FS are rearranged in the symbol display unit 40.

Of course, the trigger event may be set to meet the other condition. The trigger event can be set under the condition in which, for example, more than the predetermined number of specific symbols other than the FREE GAME symbol FS are rearranged, or a specific symbol, such as the SEVEN RUSH symbol SS, the FREE GAME symbol FS, or the three seven symbol TS, stops at the third reel M3*c*.

As can be seen in FIG. 24, the normal game is the game that is repeated until the FREE GAME symbol FS (or a bonus symbol BS) appears. In the normal game, the game result is displayed by rearranging the FREE GAME symbol FS, the BONUS symbol BS, a big dragon symbol BDS, a triple dragon symbol TDS, a double dragon symbol DDS, and a single dragon symbol SDS. Then, if the combination of the symbols rearranged in the pay line corresponds to the winning combination indicated in the payout table, the dividend in accordance with the combination is paid out.

The present embodiment shows the FREE GAME symbol FS and the three seven symbol TS arranged to be overlapped with each other, and the backlight device M7 is controlled so that the FREE GAME symbol FS which is a trigger to the free game is selectively displayed in the normal game (in this case, the light emission is controlled to be green).

On the other hand, the free game is the game that is executed without consuming the gaming media such as a medal. The displaying of a specific symbol induces the addition of some games, and the free game continues until the remaining free game is "0".

As described above, the game shifts to the free game when the FREE GAME symbol appears in the normal game, and a predetermined number of free games is acquired at that time. 10 free games can be acquired in the present embodiment. Therefore, when the normal game shifts to the free game upon appearing the FREE GAME symbol FS in the normal game, at least 10 free games can be carried out.

In the free game, the three seven symbol TS and the SEVEN RUSH symbol SS basically appear, and the other symbols does not appear or at least are not rearranged in the payout line as the winning combination. Although the present embodiment describes as if there are only two types of winning combinations, the present invention is not limited to this, but more than two winning patterns may be used.

In the reel belt M32, the FREE GAME symbol FS and the three seven symbol TS are arranged to be overlapped with each other, and the smoke layer M325 is formed in the part except for the three seven symbol TS (the FREE GAME symbol FS) and the SEVEN RUSH symbol SS (refer to FIGS. 9 and 10). Thus, in the free game, the backlight device M7 is controlled so that the three seven symbol SS indicating that there is a payout is selectively displayed in addition to the adding of the number of free games (the light emission is controlled to be red in this case). Furthermore, the smoke layer M325 makes the three seven symbol TS and the SEVEN RUSH symbol SS noticeable while making the other symbol unnoticeable, so that the game element is achieved in which only the three seven symbol TS and the SEVEN RUSH symbol SS appear or the winning combination is not displayed (or difficult to be viewed) in the pay line.

When the three seven symbol TS appears in the free game, a predetermined number of free games are added to the remaining free games. In the present embodiment, one free game is added upon the three seven symbol TS being appeared. Furthermore, the appearance of the three seven symbol TS involves a predetermined payout, as shown in FIG. 23. In the present embodiment, the payout of the three seven symbol TS is set to be 20 credit per one bet. Furthermore, when a plurality of three seven symbols TS appears, the amount of credit obtained by multiplying the credit for one bet by the number of the three seven symbols may be paid out. For example, when three three seven symbols TS appear, the amount of credit is derived by 20 credits for one bet ×3=60 credits. Of course, the combination of the plurality of three seven symbols TS may be defined as the winning combination to determine the payout in response to the winning combination. Furthermore, the number of adding free game when a plurality of three seven symbols TS appears may be set to be "1" irrespective of the number of appeared symbols, or may be set the number obtained by multiplying the number of games by the number of appearance to be the adding number.

When the SEVEN RUSH symbol SS appears in the free game, the number of games determined by lottery is added to the remaining free games. As shown in FIG. 23. However, the appearance of the SEVEN RUSH symbol SS generates no pay out. Of course, the appearance of the SEVEN RUSH symbol SS may induce the payout. In this case, the payout at the time a plurality of SEVEN RUSH symbols SS appears can be set variously in the similar way to the case of the three seven symbols TS.

Adding of the free game is carried out in the free game, so that a feeling of expectation to the continuation of the free game can be given to a player. Furthermore, since the pattern of adding the free games at the time the three seven symbol TS appears is different from that at the time the SEVEN RUSH symbol appears, the different expectations can be provided with regard to each of the rearrangements of the symbols. An enhanced game element thus can be provided for the free game.

Here, in the present embodiment, the appurtenance of the three seven symbol TS determines the number of adding free games using the table shown in FIG. 25.

The table shown in FIG. 25 includes an adding table, a small time game number lottery table and a big time game number lottery table.

The adding table is for determining which of the small time game number lottery table and a big time game number lottery table is used to determine the number of adding free games. More specifically, when the SEVEN RUSH symbol SS appears in the free game, the adding table is firstly used to determine the lottery table for use in the determination of the number of adding games. In the present embodiment, the adding table includes the probability of determining the small time game number lottery table that is set to be 95%, and the probability of determining the big time game number lottery table that is set to be 5%.

The small time game number lottery table is used when the number of adding free games is determined upon winning the small in the adding table, which is the lottery table including relatively small number of adding free games. As seen from the adding table, the number of adding games is determined in the free game basically using the small time game number lottery table. The small time game number lottery table includes the numbers of adding games obtained thereby, i.e., five games, seven games and 10 games. The probabilities of obtaining the adding games for each number of games are 50.0% (1/2.0), 30.0% (1/3.3), and 20.0% (1/5.0), and the expectation value of the number of adding games is 5.6 games.

The big time game number lottery table is used when the number of adding free games is determined upon winning the big in the adding table, which is the lottery table including relatively large number of adding free games. As seen from the adding table, it is significantly difficult to win the big time game number lottery table in the free game compared to the small time game number lottery table, while the larger number of adding games is determined thereby. The big time game number lottery table includes the numbers of adding games obtained thereby, i.e., 15 games, 20 games and 30 games. More specifically, the minimum value of the number of adding games in the big time game number lottery table is 15 games, which is set to be higher than the maximum value of the number of adding games in the small time game number lottery table, i.e., 10 games. The probabilities of obtaining the adding games for each number of games are 50.0% (1/2.0), 20.0% (1/5.0), 20.0% (1/5.0), and 10.0% (1/10.0). The expectation value of the number of adding games is thus 19.5 games in the big time game number lottery table, which is significantly higher than the expectation value in the small time game number lottery table.

As described above, when the SEVEN RUSH symbol SS appears in the free game, the number of adding games is determined using two lottery tables having the expectation values of the number of adding games and the selection probabilities different from each other. In addition thereto, the appearance of the three seven symbol TS in the free game induces the addition of the predetermined number of free games (one game in the present embodiment). Therefore, it is possible to create a variation in adding (continuing) the free games in the progress of the free game. As a result, a player can be provided with an increasing feeling of expectation with regard to the continuation of the free game when entering into the free game. Furthermore, since at least the appearance of the three seven symbol TS can provide a player with a benefit of a payout, the continuation of the free game leads to the amount of the payout. Therefore, the expectation for the large amount of the payout based on the continuation of the free game can provide a player with an enhanced feeling of excitement.

In this way, since the lottery based on the first lottery table certainly provides the larger number of adding free games than that provided based on the second lottery table, the expectation is raised with regard to the adding of the free game by the lottery based on the first lottery table. The game element is thus enhanced in the progress of the free game.

In the free game described above, at least more than one remaining free game is required for continuing the free game. The game forcedly shifts to the normal game when the end condition is satisfied.

The end condition is, for example, the case where the remaining free game is "0". When such an end condition is set, the game in which the three seven symbol TS and the SEVEN RUSH SS do not appear is regarded as a losing game in the free game, and the remaining number of free games is subtracted due to the losing game.

The end condition may be the one which forcedly terminates the game even if more than one free game remains. The end condition as described above includes, for example, (1) completing the defined number of games, (2) appearance of an end trigger, or (3) termination utilizing the adding lottery at the time the SEVEN RUSH symbol appears, etc.

The end condition (1) limits the number of continuation of the free game. In this case, the maximum number of continuing free games may be a preset constant value, or may be determined by lottery at the time of entering into the free game (at the time the FREE GAME symbol FS appears).

The end condition (2) carries out the free game ending lottery in the free game to terminate the free game when winning the end lottery. The end lottery may be carried out for each game, or for each predetermined number of game. Furthermore, a two-step lottery may be employed in which the lottery is carried out regarding whether the end lottery should be carried out, and then the end lottery is carried out when winning the former lottery.

The end condition (3) carries out the end lotteries of the free games simultaneously in the determination of the number of games using the lottery table shown in FIG. 25. More specifically, the assignment of the number of adding game of the free game as well as the assignment of the termination of the free game are added to one of or both the small time game number lottery table and the big time game number lottery table.

[Operation of Slot Machine]

The operation of the gaming machine 10 will be described with reference to FIGS. 26 to 31.

Figure 26:
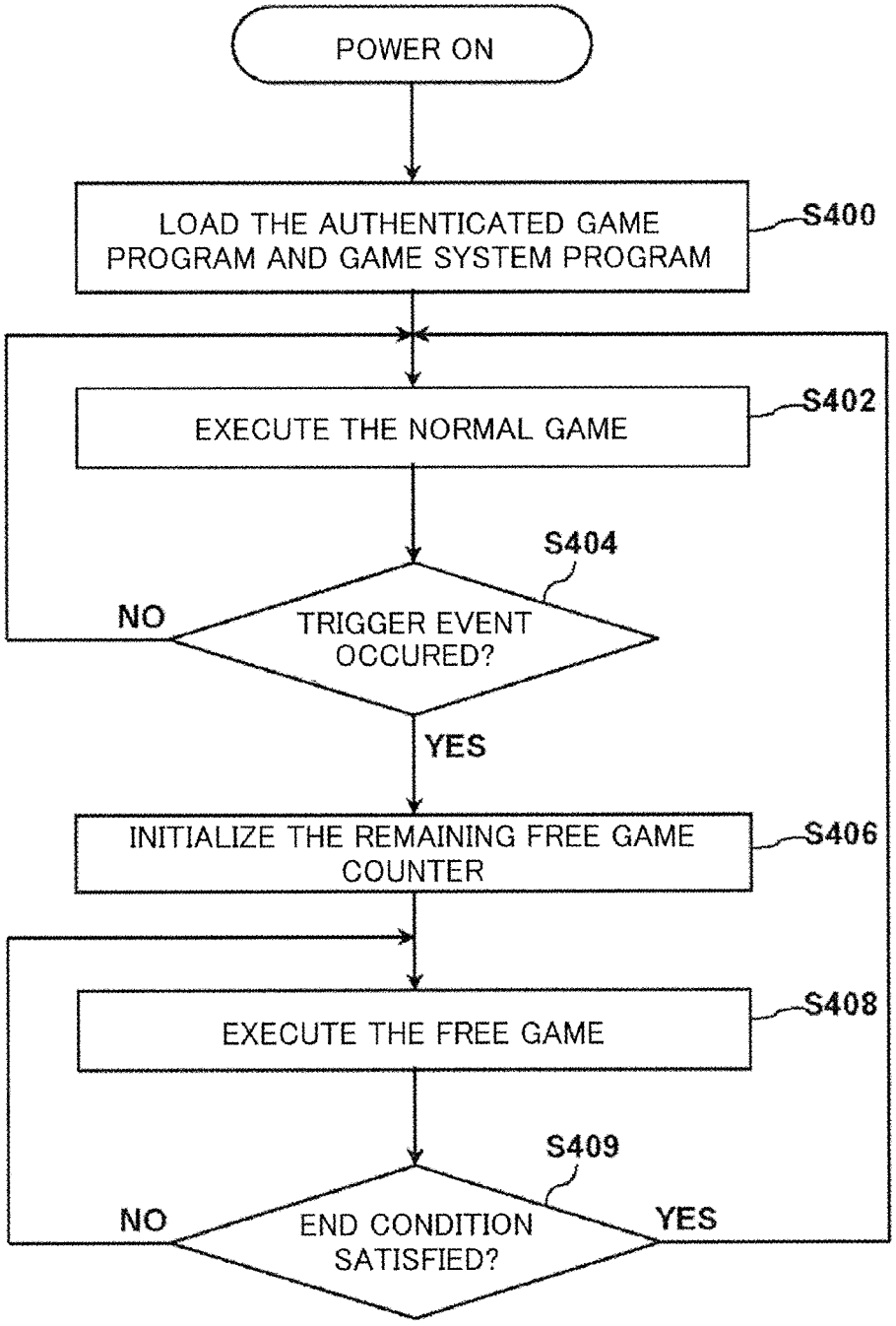
FIG. 26 is a flowchart showing a general process executed in the gaming machine according to the present embodiment.

FIG. 26 shows the process executed in the gaming machine 10.

When the power is supplied to the gaming machine 10, the main CPU loads the authenticated game program and game system program by reading the programs from the memory card 210 through the game board 200 and writing them into the RAM 226 (step S400). Subsequently, the main CPU 222 executes the game program and the game system program.

When the unit game is started by inserting the IC card into the IC card reader 60 or inserting coins into the coin insertion unit 80, the player can execute a new game based on the inserted coins or the stored bets. When the unit game is initially played after starting up the gaming machine 10, the game goes into the normal game. Thus, the main CPU 222 executes the normal game process for the initial unit game (step S402).

Whenever the normal game is completed, the game mode determination process part 316 executed by the main CPU 222 determines whether or not the trigger event occurs (step S404). Unless the trigger event occurs, the subsequent unit game is executed as the normal game. Thus, the main CPU 222 returns the process to step S402 to execute the subsequent unit game as the normal game.

If, however, determining in the determination process at step S404 that trigger event has occurred, the main CPU 222 executes the subsequent unit game as the free game (step S408).

The free game is executed by the appearance of the FREE GAME symbol FS, and the number of remaining free games is initially set to be 10. The main CPU 222 thus initializes a free game remaining number counter to be 10 when executing the first free game (step S406). The free game remaining number counter decrements each time the unit game is executed.

Each time the unit game in the chance mode is completed, the game mode determination process part 316 determines whether or not the end condition is satisfied (step S409).

Unless the end condition is satisfied, the subsequent unit game is executed as the free game (step S409).

If determining in the determination process at step S409 that the end condition is satisfied, the main CPU 222 executes the subsequent unit game as the normal game (step S402).

(Normal Game Execution Process)

Figure 27:
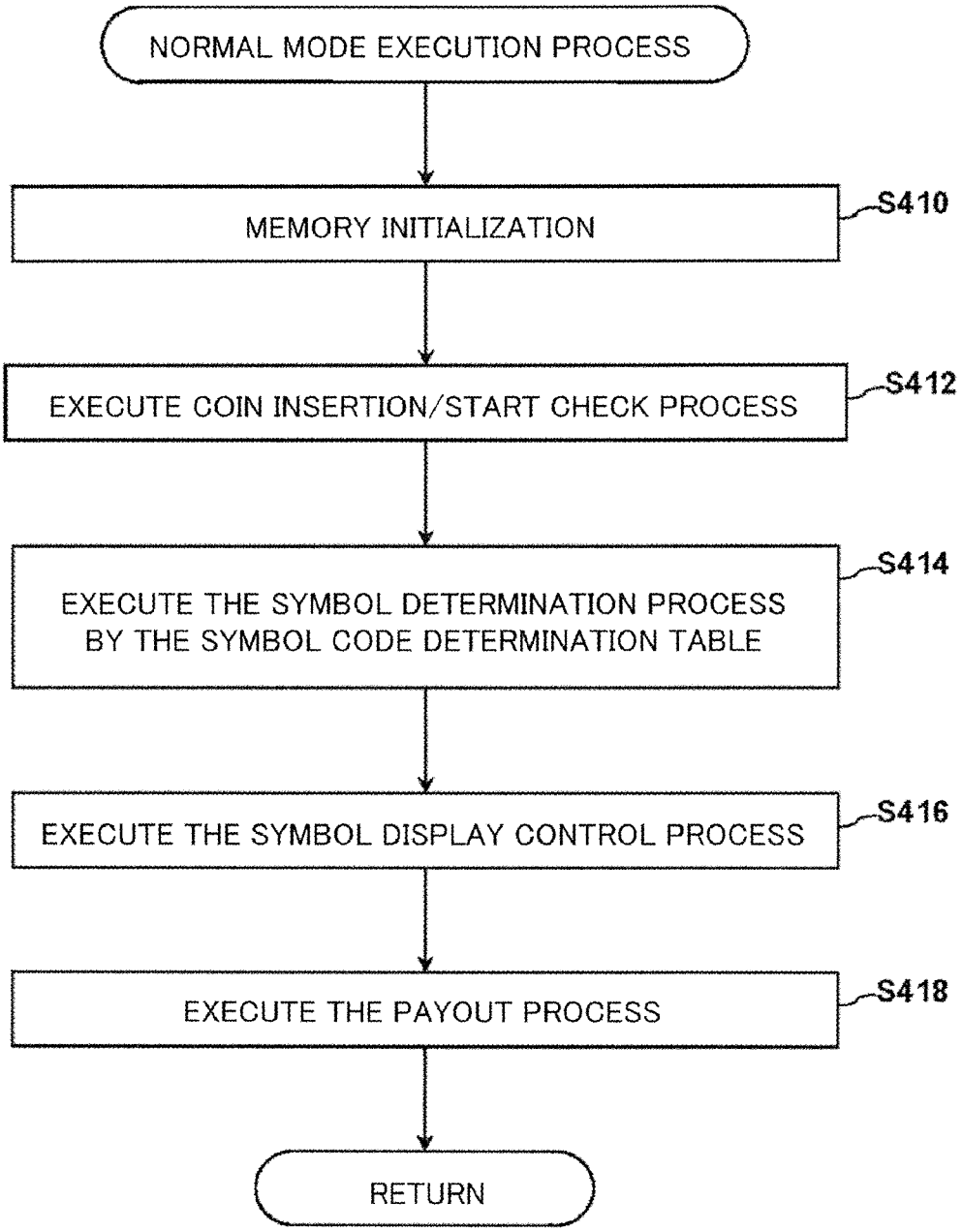
FIG. 27 is a flowchart showing the normal game execution process shown in FIG. 26.

FIG. 27 shows the execution process of the normal game at step S402 shown in FIG. 26 in detail.

Each time a unit game is completed, the main CPU 222 executes memory initialization process (step S410). In this initialization process, the main CPU 222 clears unnecessary data and information from the temporary working area in the RAM 226. The unnecessary data and information includes the payout data, awarding or failure information, and the to-be-stopped symbol information determined in the previous unit game.

Subsequently, the main CPU 222 executes coin-insertion/start-check process (step S412). In this process, the main CPU 222 checks the entry of coins or bills, and scans inputs from the BET buttons 74 to 78 and the START button 79.

After the START button 79 is pressed by the player, the main CPU 222 executes symbol determination process (step S414). In this process, the main CPU 222 generates five random numbers and determines five symbol codes of five to-be-stopped symbols corresponding to the random numbers with reference to the symbol code determination table 340. The main CPU 222 determines whether or not any winning combination is achieved by the rearranged symbol matrix that is formed of the rearranged symbols.

At step S416, the main CPU 222 executes symbol display control process. In this process, the main CPU 222 controls the reel assembly M1 to rotate the reels M3*a* to M3*e*, and then to stop rotating the reels M3*a* to M3*e* in order to rearrange the symbols in accordance with the symbol determination result to form the symbol matrix in the display window 56.

Then, at step S418, the main CPU 222 determines the payout amount, and executes the payout process to provide the player with the determined payout amount.

(Coin-Insertion/Start-Check Process)

Figure 28:
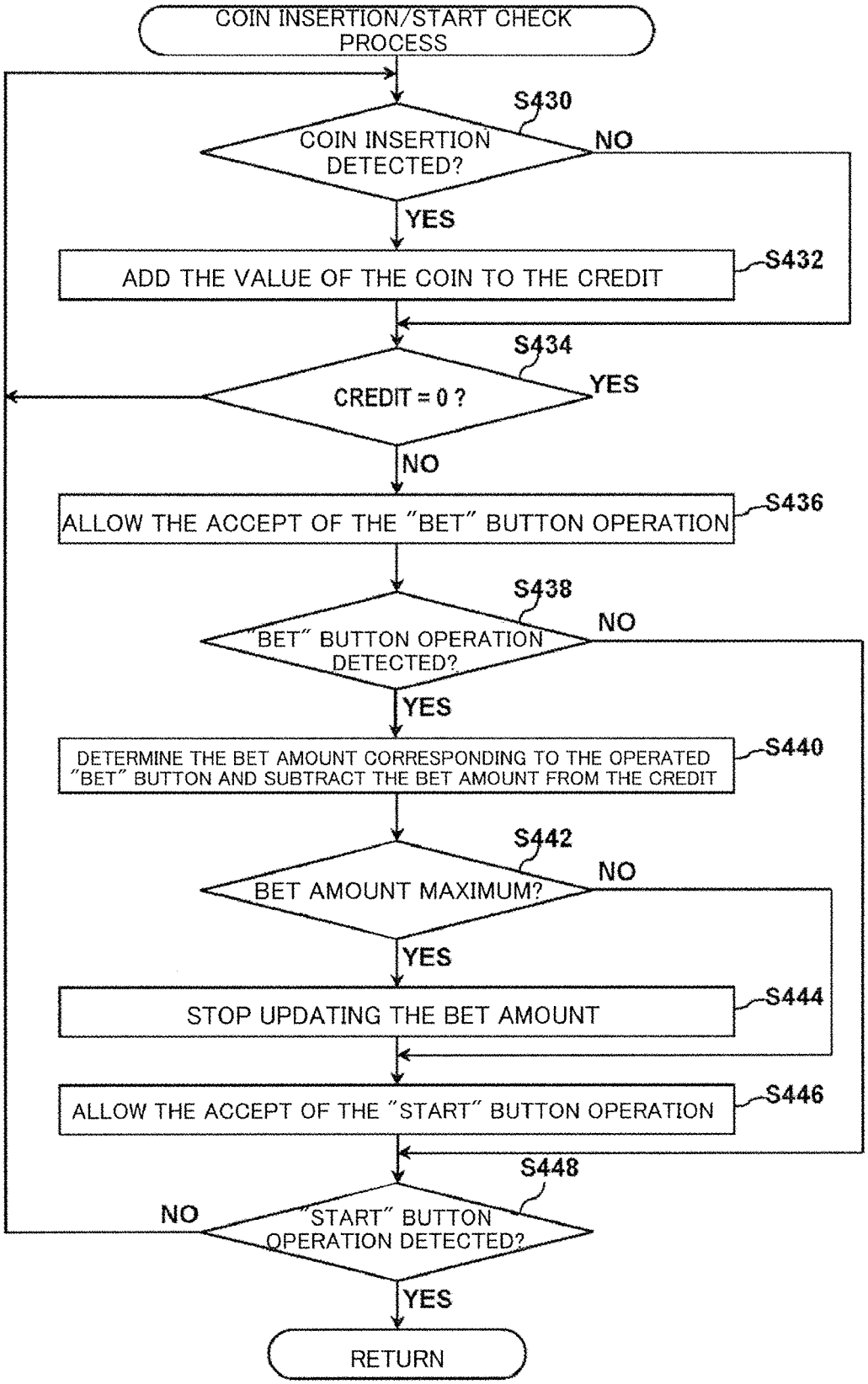
FIG. 28 is a flowchart showing the coin insertion/start check process shown in FIG. 27 in detail.

FIG. 28 shows the coin-insertion/start-check process at step S412 shown in FIG. 27 in detail.

First, the main CPU 222 determines, by means of the input/credit checking process part 300 executed in the main CPU 222, whether or not the coin counter 232 detects insertion of a coin (step S430). When determining at step S430 that a coin has been inserted, the main CPU 222 adds the value of the inserted coin to the credits stored in the RAM 226 (step S432). At this stage, the main CPU 222 may further determine whether or not the bill validator 246 detects insertion of a bill. When determining that a bill has been inserted, the main CPU 222 adds the value of the inserted bill to the credits.

When the process at step S432 has been completed or when it is determined at step S430 that no coin has been inserted, the main CPU 222 determines whether or not the credit amount is zero (step S434). If determining in the determination process at step S434 that there remains some credits, the main CPU 222 allows the bet setting inputs through the BET buttons 74 to 78 up to the remaining credits (step S436). If determining in the determination process at step S434 that there remains no credit, the main CPU 222 returns the process to step S430.

Afterwards, main CPU 222 monitors the bet setting input through the BET buttons 74 to 78 based on bet setting input signals output from the bet switches 74S to 78S (step S438). If the main CPU 222 determines that any of the BET buttons 74 to 78 has been pressed by the user, the main CPU 222 adjusts the betting amount value stored in the RAM 226 according to the pressed BET button, and subtracts the betting amount from the credit value stored in the RAM 226 (step S440). If determining in the determination process at step S434 that there is no BET button input for a predetermined time, the main CPU 222 proceeds the process to step S448.

During the increase of the betting amount, the main CPU 222 determines whether or not the betting amount reaches a predetermined maximum value (step S442). When the betting amount has reached the predetermined maximum value, the main CPU 222 prohibits any further increase of the betting amount (step S444).

Upon completing the process at step S444 or determining that betting amount has not reached the maximum value in the process at step S442 and the betting amount is adjusted, the main CPU 222 allows the operation input through the START button 79 (step S446). At this stage, the main CPU 222 can display the set pay lines the symbol display unit.

In the process at step S448, the main CPU 222 determines whether or not the input through the START button 79 is detected (step S448). When the input from the START button 79 has not been detected for a predetermined standby time, the main CPU 222 returns the process to step S430. If determining in the process at step S448 that the input from the START button 79 has been detected, the main CPU 222 terminates the coin-insertion/start-check process.

(Symbol Determination Process)

Figure 29:
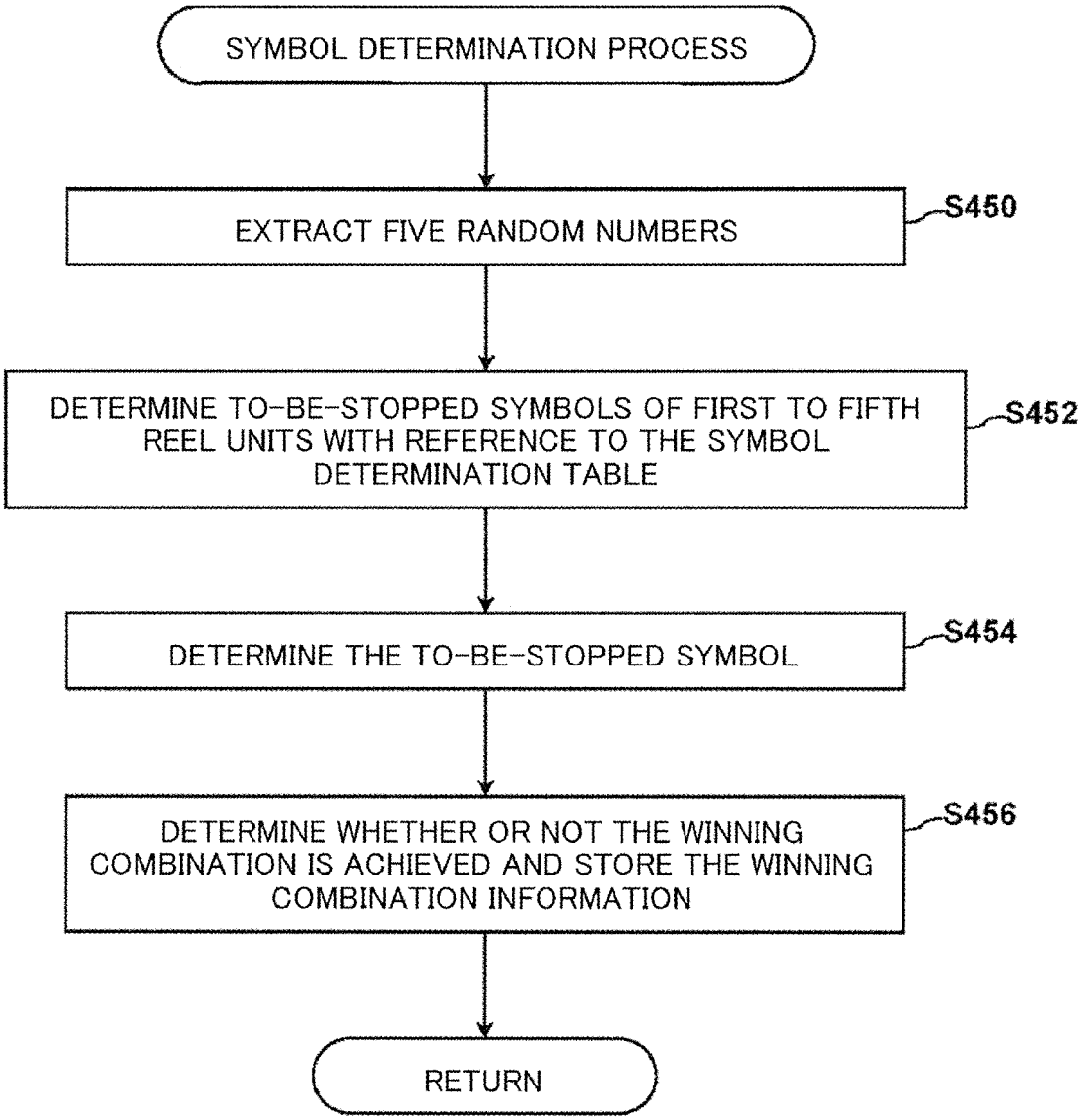
FIG. 29 is a flowchart showing the symbol determination process shown in FIG. 27 in detail.

FIG. 29 shows the symbol determination process at step S414 shown in FIG. 27 in detail.

First, the random number generation process part 302 executed by the main CPU 222 extracts five random numbers (step S450).

Subsequently, the symbol determination process part 304 executed by the main CPU 222 determines first to fifth symbol codes using the first to fifth random numbers, respectively, with reference to the symbol code determination table (step S452). Then, the main CPU 222 determines first to fifth to-be-stopped symbols corresponding to the first to the fifth symbol codes, respectively, with reference to the symbol code table (step S454). As a result, the five to-be-stopped symbols are determined by use of the five random numbers. Upon determination of the first to fifth to-be-stopped symbols, the main CPU 222 stores the symbols or symbol codes in the RAM 226.

The five to-be-stopped symbols are symbols to be stopped at the second row of each column of the symbol matrix shown in FIG. 9. Since the symbol alignments constituting the first to fifth symbol columns are fixed corresponding to each of the reels M3*a* to M3*e*, determining the to-be-stopped symbols determines all the symbols constituting the symbol matrix. The main CPU 222 determines all the symbols constituting the symbol matrix based on the to-be-stopped symbols with reference to the symbol code table of FIG. 7.

Afterwards, the winning determination process part 310 executed by the main CPU 222 determines whether or not any winning combination is achieved by the symbols constituting the symbol matrix determined in the process at step S456 (step S456). In case that a winning combination is achieved by the symbols constituting the symbol matrix, the winning determination process part 310 stores the winning combination in the RAM 226 (step S456). In addition, the main CPU 222 may determine whether or not the winning combination is achieved from the symbol codes of to-be-stopped symbols without determining whether or not the winning combination is achieved using the symbol matrix.

Finally, the symbol determination process terminates and the execution flow returns to the main process (not shown).

(Symbol Display Control Process)

Figure 30:
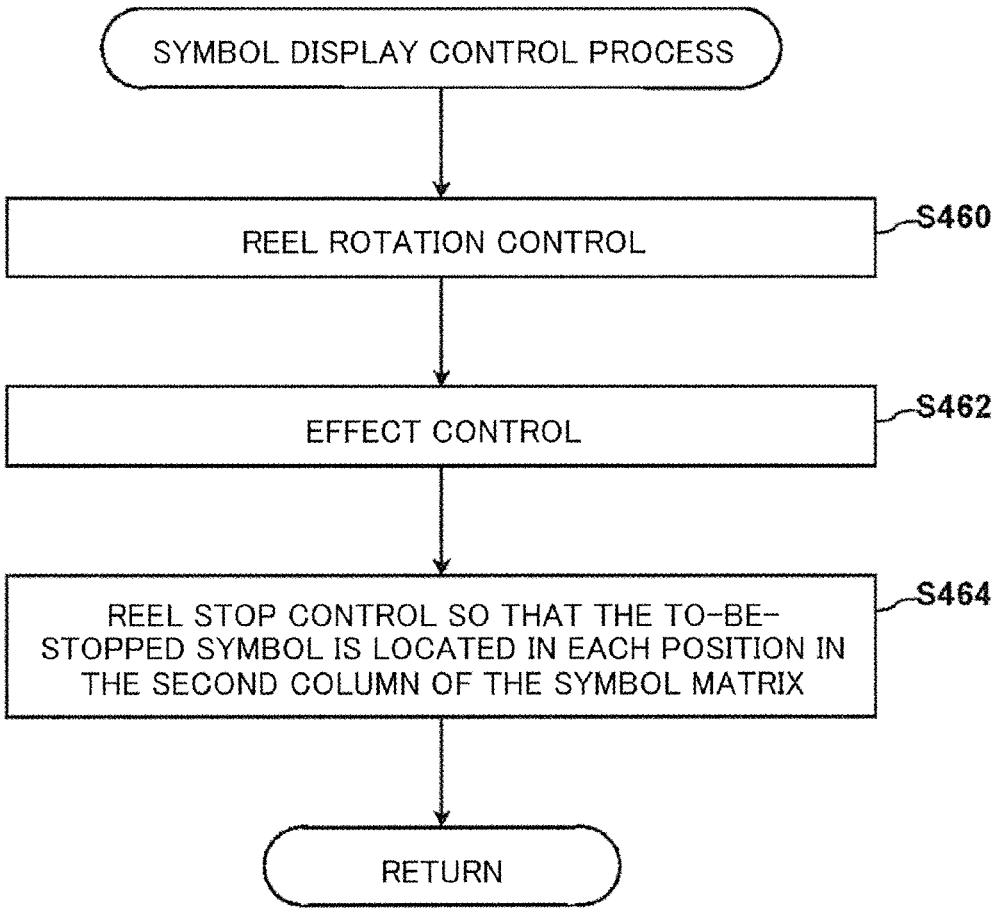
FIG. 30 is a flowchart showing the symbol display control shown in FIG. 27 in detail.

FIG. 30 shows the symbol display control process at step S416 shown in FIG. 27 in detail.

First, the reel control process part 308 executed by the main CPU 222 transmits a spin control signal to the reel assembly M1 so that the reel driver 264 of the first to fifth reels M3*a* to M3*e* supplies power to the reel motor 272 to spin the reels. Each of the first to fifth reels M3*a* to M3*e* rotates at the speed different from one another, and the symbol alignment provided on the reels M3*a* to M3*e* scrolls in the display window 56 of the symbol display unit 40 (step S460).

While the first to fifth reels M3*a* to M3*e* rotates, the backlight driver 266 supplies power to the light sources M71 of the backlight device M7 and the effect illumination driver 268 supplies power to the light source 292 of the effect light illumination device 290 to execute the effect from behind the reel surfaces.

The spin control signal contains information of stop positions of the first to fifth reels M3*a* to M3*e*. The reel driver 264 of the first to fifth reels M3*a* to M3*e* controls the reel motors 272 to stop the first to fifth reels M3*a* to M3*e* at the position indicated by the spin control signal. Thus, the reel motors 272 composed of stepping motors is stopped at desired positions, and the scroll of the symbol columns is stopped so that the to-be-stopped symbols are arranged in the second row of the symbol matrix formed in the display window 56 (step S464).

Finally, the symbol display control process terminates and the execution flow returns to the main function.

(Irradiation Control Routine)

Figure 31:
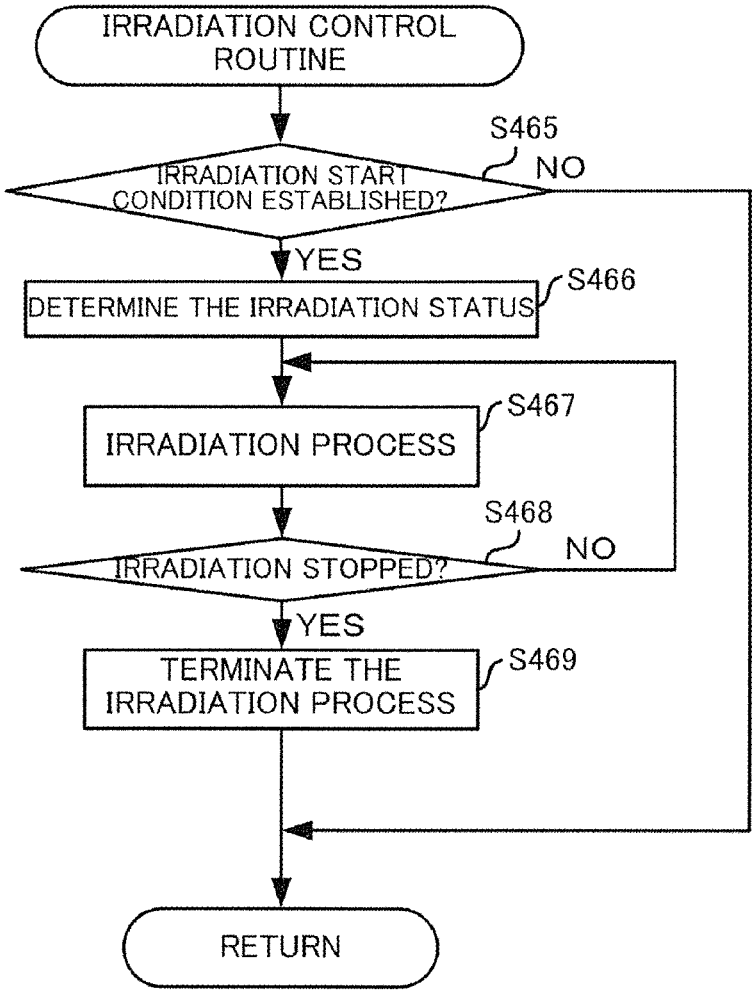
FIG. 31 is a flowchart showing an irradiation control routine as a symbol display control in FIG. 30.

FIG. 31 shows an example of the control of the backlight device M7 at step S460 in FIG. 30.

The main CPU 222 determines whether the irradiation start condition is established (step S465), and determines the irradiation pattern if the condition is established (step S466). In this process, the determination is made before the reels M3*a* to M3*e* start rotating, during the rotation of the reels M3*a* to M3*e*, and after the reels M3*a* to M3*e* stop rotating, respectively.

Here, the determination process of the irradiation pattern after the reels M3*a* to M3*e* stop rotating is executed as follows with regard to a specific.

In the case where the unit game to be executed is the normal game, when the FREE GAME symbol FS is rearranged to appear in the display window 56, it is determined that green light is irradiated by the light source device M71 corresponding to the FREE GAME symbol FS. On the other hand, in the case where the unit game to be executed is the free game, when the three seven symbol TS is rearranged to appear in the display window 56, it is determined that red light is irradiated by the light source device M71 corresponding to the three seven symbol TS.

Then, the main CPU 222 executes the irradiation process in accordance with the determined irradiation pattern (step S467). For example, when it is determined that green light is irradiated from the light source M71 corresponding to the FREE GAME symbol FS after the reels M3*a* to M3*e* stop rotating, the process is executed in which green light is irradiated from the light source M71 to the FREE GAME symbol FS. Thus, the letter symbols "FREE GAME" (the FREE GAME symbol FG) are displayed in green. On the other hand, when it is determined that red light is irradiated from the light source M71 corresponding to the three seven symbol TS after the reels M3*a* to M3*e* stop rotating, the process is executed in which red light is irradiated from the light source M71 to the three seven symbol TS. Thus, the number symbols "777" (the three seven symbol TS) are displayed in red.

The irradiation process continues until the main CPU 222 determines the termination of the irradiation (step S468).

(Payout Process)

Figure 32:
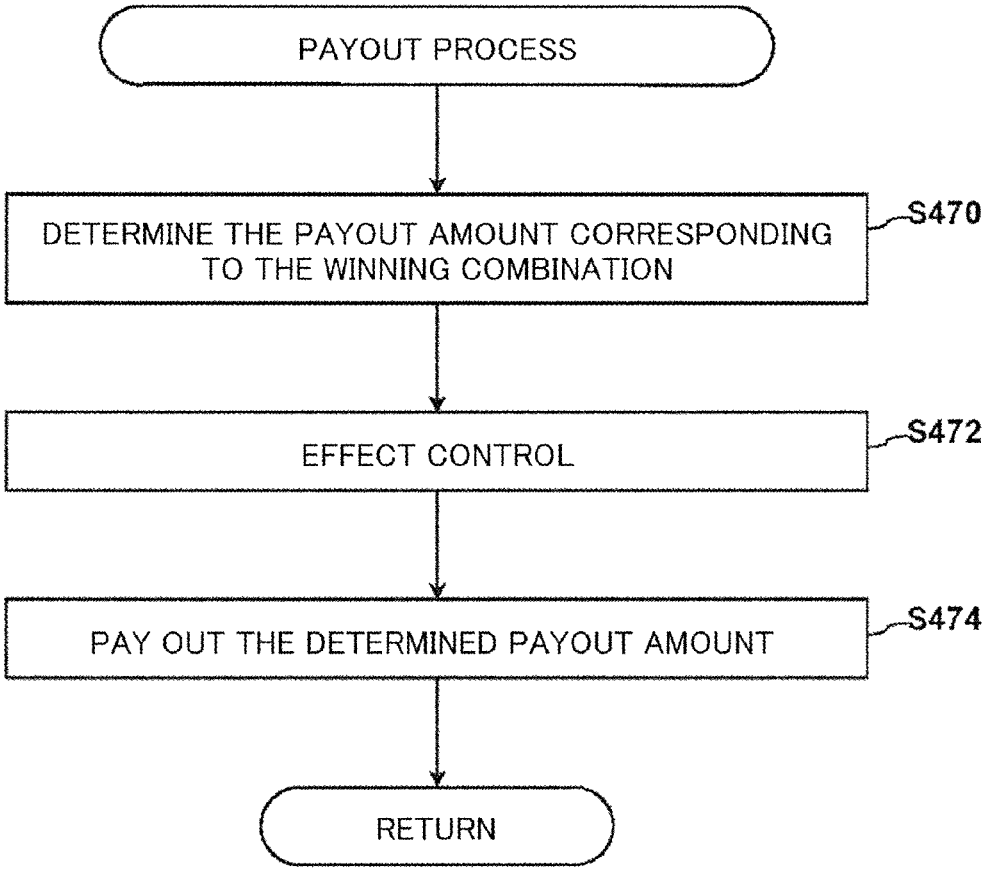
FIG. 32 is a flowchart showing the payout process shown in FIG. 27 in detail.

FIG. 32 illustrates the payout process at step S418 shown in FIG. 27 in detail.

When a winning combination is achieved, the winning determination process part 310 or the payout process part 314 executed by the main CPU 222 determines the payout amount corresponding to the winning combination and stores the amount in the RAM 226 (step S470).

As soon as the first to fifth reels M3*a* to M3*e* stop, the effect control process part 312 executed by the main CPU 222 controls the symbol display unit 40 and the other devices, such as the speaker 112, the lamp 114 and the video display unit 110, to execute the effects (step S472). The production effect includes video, audio effect, backlight change, and illumination effect.

Afterwards, the payout process part 314 pays out the determined amount by increasing the credits or discharging coins to the coin tray 92 (step S474).

(Free Game Execution Process)

Figure 33:
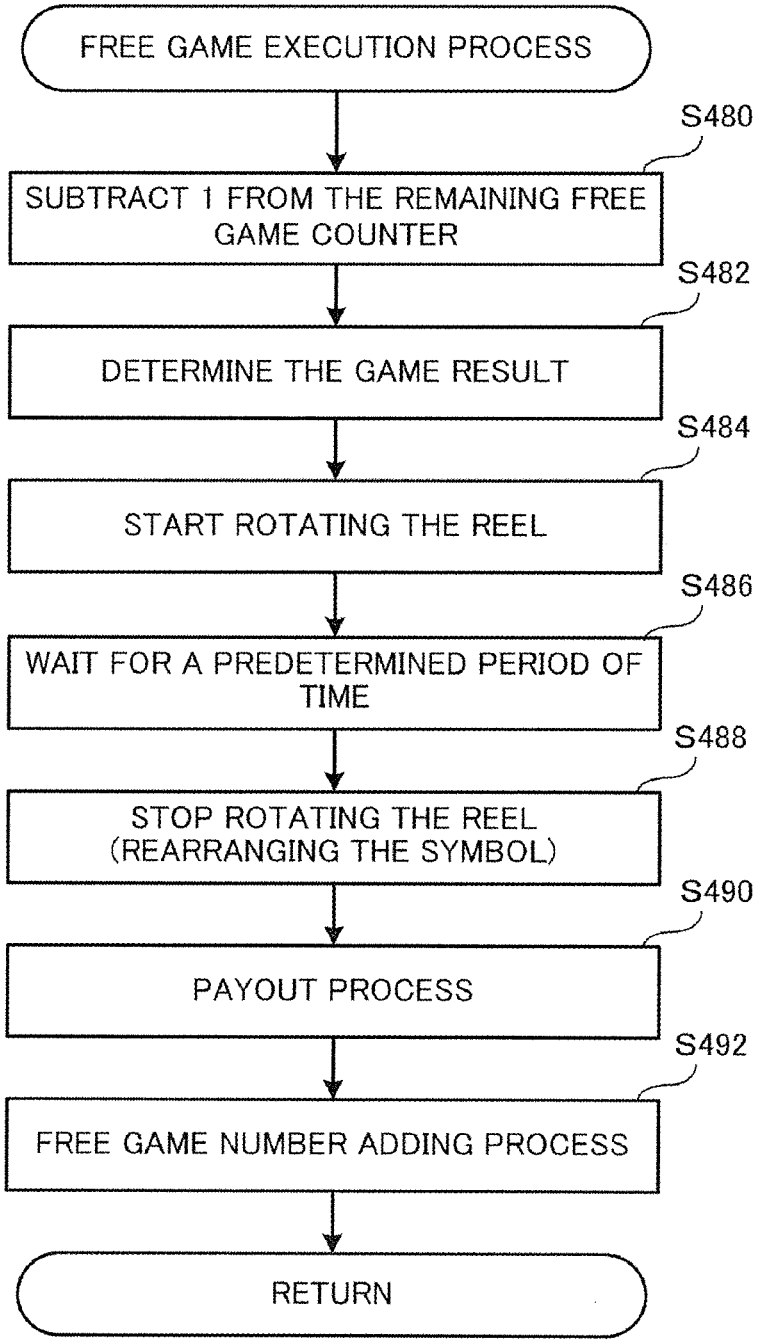
FIG. 33 is a flowchart showing the free game execution process shown in FIG. 26.

FIG. 33 illustrates the payout process at step S408 shown in FIG. 26 in detail.

The term "free game" herein refers to the game in which a player can have a chance to acquire the game value without paying or consuming the game value such as a medal. For example, that is the game in which the unit game can be executed without inserting a coin or a credit into the gaming machine 10, so that the coin and the credit cannot be consumed even if the game resultingly ends in failure. In this manner, the game in the chance mode being as the free game enables the player to get a chance to acquire the game values without consuming the game values such as coins and credits.

In the free game process, the main CPU 222 decrements the remaining free game counter by one (step S480).

Then, the main CPU 222 executes the process for determining the game result (step S482). In this process, the main CPU 222 first generates five, namely first to fifth, random numbers. Then, the main CPU 222 determines first to fifth symbol codes using the first to fifth random numbers with reference to the selected symbol code determination tables 341 to 348, respectively.

The first random number is the random number for determining a symbol code of a to-be-stopped symbol in the first symbol column. The second random number is the random number for determining a symbol code of a to-be-stopped symbol in the second symbol column. The third random number is the random number for determining a symbol code of a to-be-stopped symbol in the third symbol column. The fourth random number is the random number for determining a symbol code of a to-be-stopped symbol in the fourth symbol column. The fifth random number is the random number for determining a symbol code of a to-be-stopped symbol in the fifth symbol column The main CPU 222 starts rotating the reels M3*a* to M3*e* (step S484), and stops rotating the reels after a predetermined period of time has elapsed (step S486). More specifically, the main CPU 222 executes the process to rearrange the symbols. The process of rearranging the symbols causes the scroll of the first to fifth symbol columns to be started, and then stops the scroll of the first to fifth symbol columns after a predetermined period of time has elapsed. At that time, the symbol matrix of three rows and five columns is rearranged in the display window 56 so that the symbols of five symbol codes (to-be-stopped symbols) determined in the process at step S482 appear in the second column in the display window 56 (the second column in the symbol matrix formed in the display window 56).

Then, the main CPU 222 executes the payout process (step S490). This process is executed in the same manner as the payout process in the normal game executed at step S418 in FIG. 27. More specifically, at step S490, the payout process shown in FIG. 32 is executed in which it is determined whether or not a predetermined winning combination is achieved by the rearranged symbol matrix, and pays out the payout amount corresponding to the achieved winning combination when the predetermined winning combination is achieved.

Then, the main CPU 222 executes the free game adding process, which will be described below with reference to FIG. 34, to terminate the subroutine.

(Free Game Number Adding Process)

Figure 34:
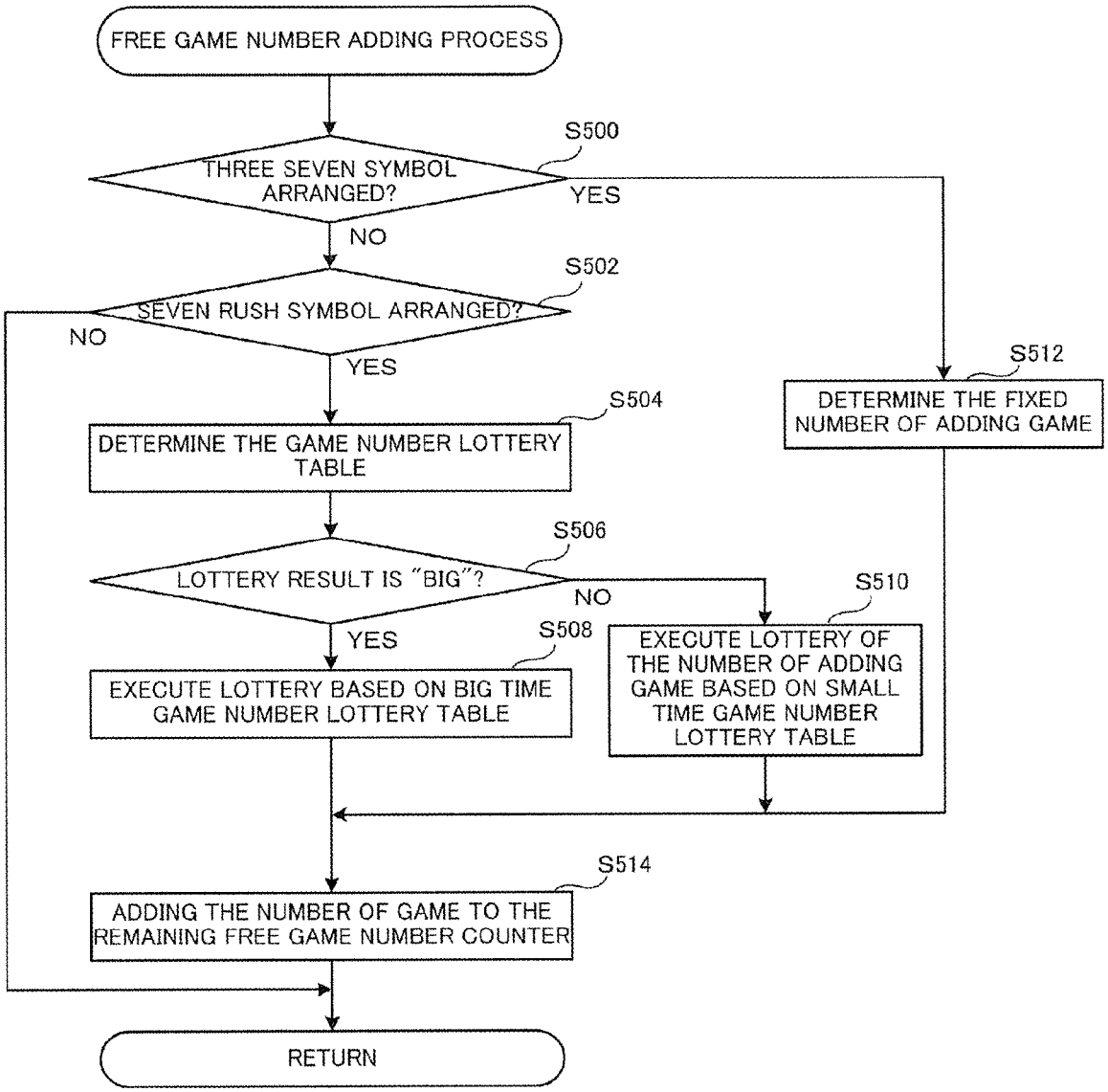
FIG. 34 is a flowchart showing the free game number adding process shown in FIG. 33.

FIG. 34 shows the free game number adding process executed at step S492 in FIG. 33 in detail.

The main CPU 222 determines whether the three seven symbol TS is arranged (step S500), and moves the process to step S504 upon determining that the three seven symbol TS is arranged.

On the other hand, upon determining that the three seven symbol TS is not arranged, the main CPU 222 determines whether the SEVEN RUSH symbol SS is arranged (step S502). Upon determining that the SEVEN RUSH symbol SS is arranged, the main CPU 222 decides the preset fixed number of adding game (such as one) (step S512), and adds the fixed number of adding game to the remaining free game counter to terminate the subroutine (step S514).

Upon determining that the SEVEN RUSH symbol SS is not arranged, which can be determine that none of the three seven symbol TS and the SEVEN RUSH symbol SS is arranged, the main CPU 222 terminates the subroutine without adding the number of free game.

At step S504, the main CPU 222 determines the game number lottery table for use in the lottery of the number of adding free games using the game number lottery table. This process is executed by deciding which of the small time game number lottery table and the big time game number lottery table is used using the adding table shown in FIG. 25.

Upon deciding the adding table, the main CPU 222 determines whether the adding table to be used is the big time game number lottery table (step S506), and then carries out the lottery of the number of adding game using the big time game number lottery table upon determining that the table to be used is the big time game number lottery table (step S508).

Upon determining that the table to be used is not the big time game number lottery table, the main CPU 222 uses the small time game number lottery table to carry out the lottery of the number of adding game (step S510).

When the number of adding game of the free game is decided by lottery at step S508 or step S510, the determined number of adding game is added to the remaining free game number counter and then the subroutine is terminated (step S514).

(Modification)

FIG. 35A, FIG. 35B, FIG. 36A, FIG. 36B, FIG. 36C, FIG. 36D, FIG. 36E, FIG. 36F, FIG. 36G, and FIG. 36H show schematic diagrams for explaining the control of the lighting of the light source device R12 which operates in synchronization with the rotary of a specific symbol.

Figure 35A:
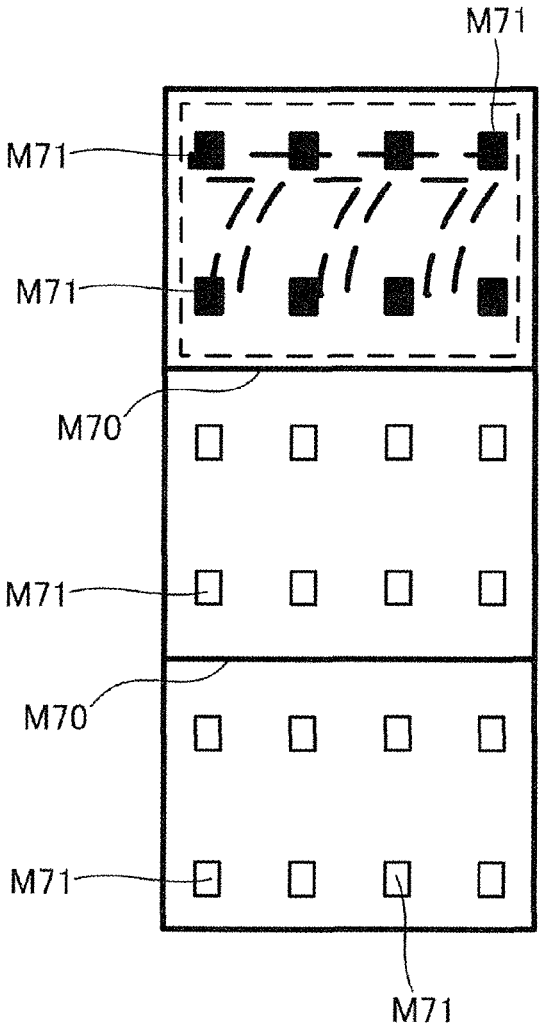
FIG. 35A and FIG. 35B are schematic diagrams for explaining the control of a light source device in a modification.
Figure 35B:
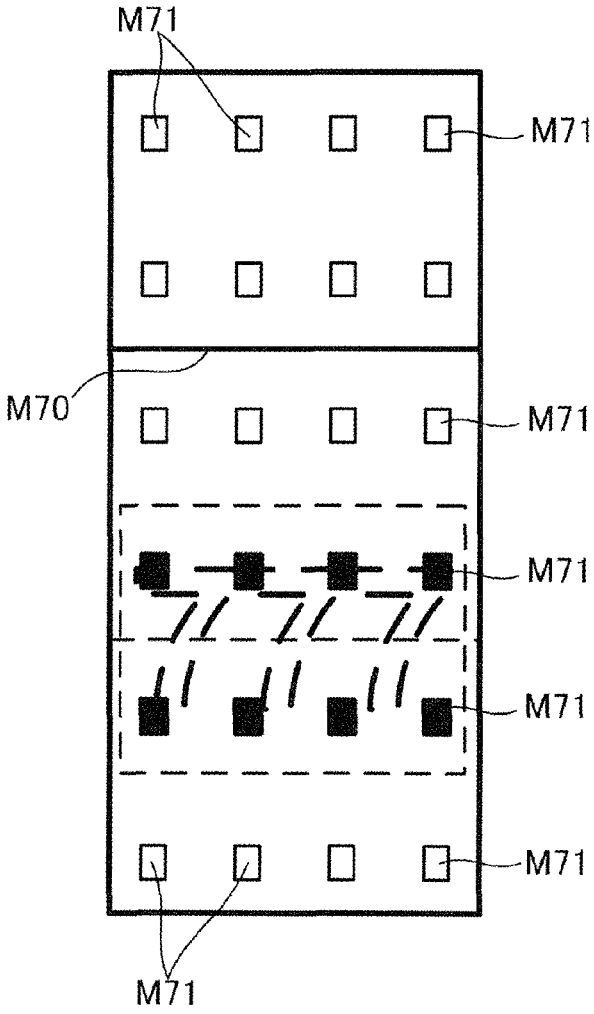
Figure 36A:
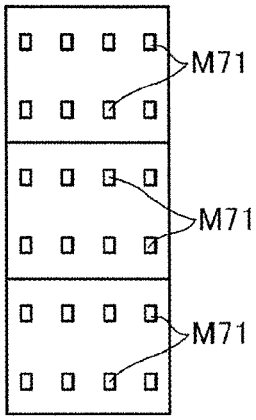
FIG. 36A, FIG. 36B, FIG. 36C, FIG. 36D, FIG. 36E, FIG. 36F, FIG. 36G, and FIG. 36H are schematic diagrams for explaining the control of the light source device in a modification.
Figure 36B:
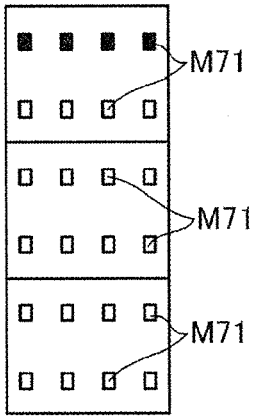
Figure 36C:
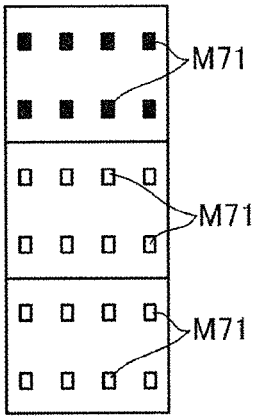
Figure 36D:
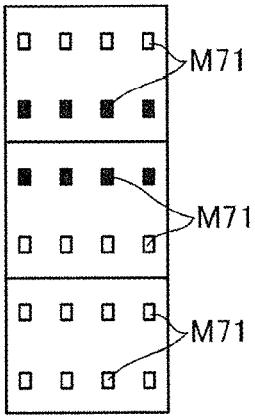
Figure 36E:
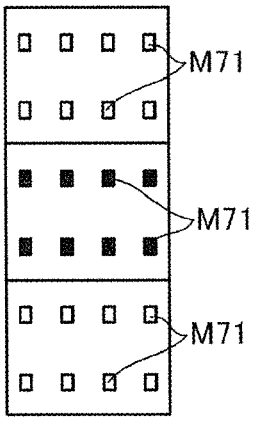
Figure 36F:
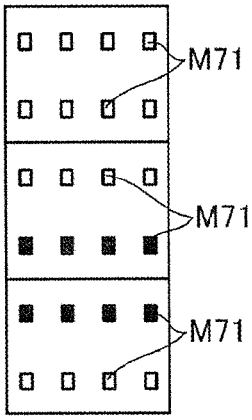
Figure 36G:
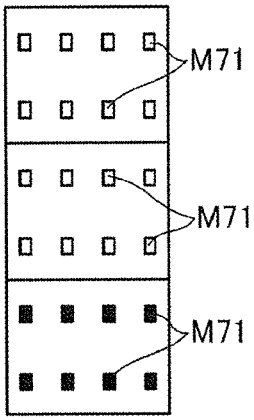
Figure 36H:
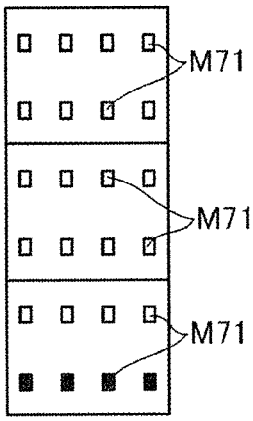

As shown in FIGS. 35A and 35B, in the modification, when a specific symbol passes in front of the backlight device M7, the light source device M71 arranged behind the specific symbol is lighted and the other light source M71 is extinguished. As shown in FIG. 36A, FIG. 36B, FIG. 36C, FIG. 36D, FIG. 36E, FIG. 36F, FIG. 36G, and FIG. 36H, the light source device M71 to be lighted can be changed with the rotational movement of the specific symbol.

In this way, the light source device M71 is controlled in synchronization with the rotational movement of the specific symbol, so that only the specific symbol is illuminated by the backlight device M7 and the specific symbol is made more noticeable than the other symbols.

Although the specific symbol is the three seven symbol TS in the illustrated example, the specific symbol may be the other symbol, such as the FREE GAME symbol FS, the SEVEN RUSH symbol SS, or the BONUS symbol BS.

Figure 37:
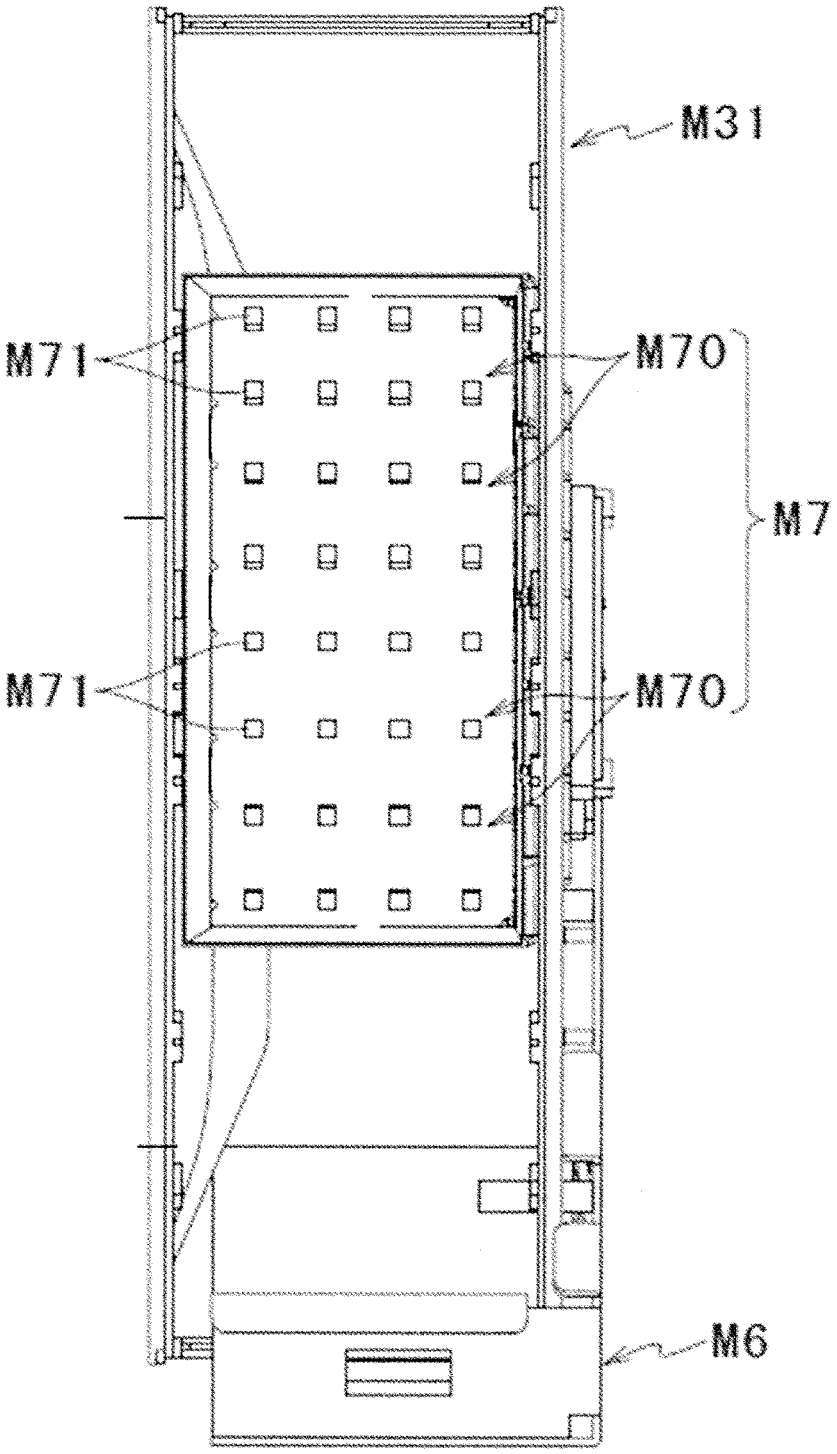
FIG. 37 is a front view of the light source device in the other modification.
Figure 38A:
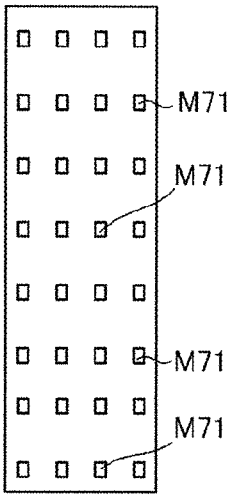
FIG. 38A, FIG. 38B, FIG. 38C, FIG. 38D, FIG. 38E, FIG. 38F, FIG. 38G, FIG. 38H, FIG. 38I, and FIG. 38J are schematic diagrams for explaining the control of a light source device in the other modification.
Figure 38B:
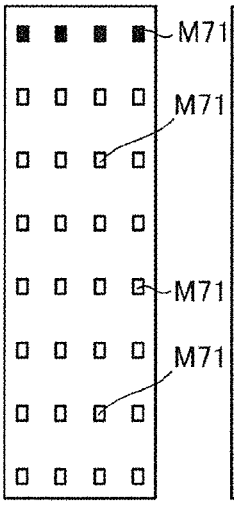
Figure 38C:
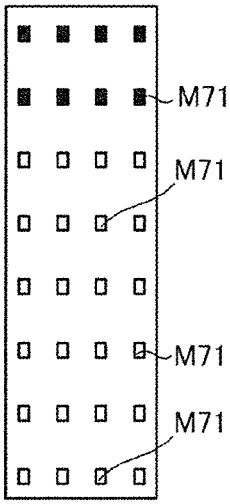
Figure 38D:
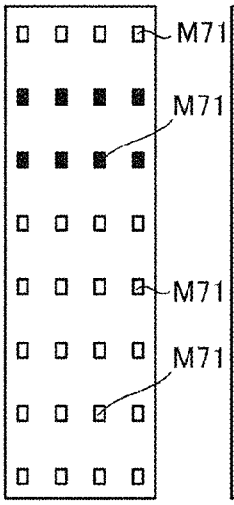
Figure 38E:
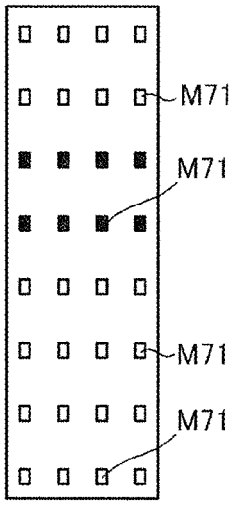
Figure 38F:
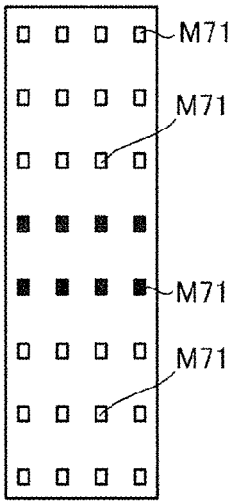
Figure 38G:
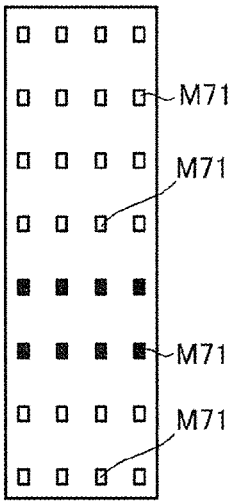
Figure 38H:
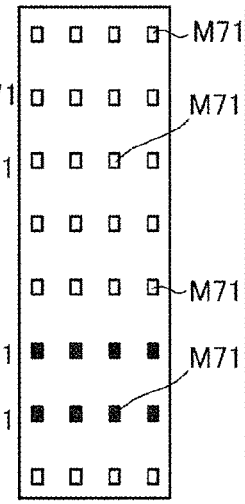
Figure 38I:
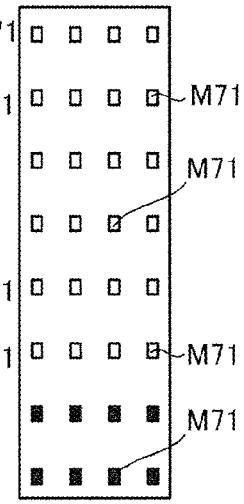
Figure 38J:
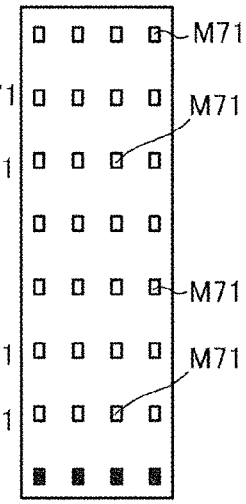

As shown in FIG. 37, the backlight device M7 without a partition plate M70 may be used. Also in this case, as shown in FIG. 38A, FIG. 38B, FIG. 38C, FIG. 38D, FIG. 38E, FIG. 38F, FIG. 38G, FIG. 38H, FIG. 38I, and FIG. 38J, only the light source device M71 located behind the specific symbol is successively lighted in synchronization with the rotational movement of the specific symbol, so that the specific symbol can be made noticeable. When the backlight device M7 without a partition plate M70 is used, the light emitted from the light source device M71 is not blocked by the partition plate. The specific symbol thus can be made noticeable more appropriately.

<<Second Embodiment>>

The gaming machine 10' according to the second embodiment includes the structures of the reels M3*a*' to M3*e*' and the game contents that are different from those of the gaming machine 10 according to the first embodiment.

The gaming machine 10' according to the second embodiment is provided with five reels M3*a*' to M3*e*'. Likewise the reels of the conventional gaming machine, always the same symbol appears on each of four reels, i.e., a first reel M3*a*' to a fourth reel M3*d*', of the gaming machine 10' irrespective of color of light irradiated by means of the light source devices M71 of the backlight device M7. In contrast, a fifth reel M3*e*' is structured so that various symbols appear thereon depending on color of light irradiated by means of the light source devices M71 of the backlight device M7.

Furthermore, the game executed by the gaming machine 10' according to the second embodiment includes a game in a normal game mode (a normal game) and a game in a free game mode (a free game). In the gaming machine 10' according to the second embodiment, the dividend is determined based on the symbols rearranged by the first to fourth reels M3*a*' to M3*d*' both in the normal game and the free game, and the multiplying factor is determined based on the symbol rearranged by the fifth reel M3*e*'. The payout is determined based on the divident and the multiplying factor to be given to a player. In addition, in the free game, the number of adding game is also determined based on the symbol rearranged by the fifth reel M3*e'*.

Furthermore, in the gaming machine 10' according to the second embodiment, the symbol rearranged by the fifth reel M3*e*' determines the initial value of the number of free game when the mode shifts from the normal game mode to the free game mode.

The structure of the gaming machine 10' and the processes executed thereby are the same as those of the gaming machine 10 according to the first embodiment except for those described below. For example, with regard to FIGS. 2, 3, 4, 5, 6, 7, 8, 18, 19, 20, and 21, the gaming machine 10' has the same structure as the gaming machine 10 according to the first embodiment and executes the same processes as those executed by the gaming machine 10. Therefore, like reference numerals are used for explaining the structure and the processes thereof which are in common with the gaming machine 10 according to the first embodiment.

<Structure of Fifth Reel M3*e'*>

FIG. 40(*a*) is a diagram showing an alignment of symbols arranged on the fifth reel M3*e'* of the gaming machine according to the second embodiment.

The fifth reel M3*e'* has a first surface and a second surface. Each of the first and second surfaces bears a symbol. The first and second surfaces are overlapped with each other to constitute the fifth reel M3*e'*.

As shown in FIG. 40(*a*), the first surface bears symbols including a first symbol "Chance", a second symbol "Lose", a third symbol "Ex_B", a fourth symbol "×10", a fifth symbol "×7", a sixth symbol "×5", a seventh symbol "×3", an eighth symbol "×2", a ninth symbol "×4", a tenth symbol "×3", and an eleventh symbol "×2" which are arranged in that order. In addition, "Blank_2" acts as not a symbol but a blank herein, and thus the explanation with regard thereto is omitted.

The second surface bears symbols including a first symbol "Chance", a second symbol "Lose", a third symbol "Ex_B", a fourth symbol "×10", a fifth symbol "×7", a sixth symbol "12FG", a seventh symbol "10FG", an eighth symbol "8FG", a ninth symbol "6FG", a tenth symbol "FG_2", and an eleventh symbol "FG_1" which are arranged in that order. Also in the second surface, "Blank_2" acts as not a symbol but a blank that fills a space between symbols, and thus the explanation with regard thereto is omitted.

The first and second surfaces include the arrangements of the symbols in common with each other, i.e., the first symbol "Chance", the second symbol "Lose", the third symbol "Ex_B", the fourth symbol "×10", and the fifth symbol "×7". Consequently, the same symbols always appear on both surfaces when the light source device M71 of the backlight device M7 emits light with an arbitrary color. More specifically, even if the light with an arbitrary color is emitted from the light source device M71, the "Chance" symbol, the "Lose" symbol, the "Ex_B" symbol, the "×10" symbol, and the "×7" symbol always appear as the first, second, third, fourth, and fifth symbols, respectively.

On the other hand, with regard to sixth to eleventh symbols, the first and second surfaces display symbols different from each other. More specifically, as the sixth symbol, the "×5" symbol is arranged on the first surface whereas the "12FG" symbol is arranged on the second surface. As the seventh symbol, the "×3" symbol is arranged on the first surface whereas the "10FG" symbol is arranged on the second surface. As the eighth symbol, the "×2" symbol is arranged on the first surface whereas the "8FG" symbol is arranged on the second surface. As the ninth symbol, the "×4" symbol is arranged on the first surface whereas the "6FG" symbol is arranged on the second surface. As the tenth symbol, the "×3" symbol is arranged on the first surface whereas the "2FG" symbol is arranged on the second surface. As the eleventh symbol, the "×2" symbol is arranged on the first surface whereas the "FG_1" symbol is arranged on the second surface.

The sixth to eleventh symbols on the first surface have the same structure as the numeral symbol "777" (the three seven symbol TS) in the first embodiment. More specifically, the sixth to eleventh symbols appear in red on the first surface when irradiated with red light (the first emission light color) by means of the light source device M71 of the backlight device M7.

Furthermore, the sixth to eleventh symbols on the second surface have the same structure as the numeral symbol "FREE GAME" (the FREE GAME symbol FS) in the first embodiment. The sixth to eleventh symbols appear in green on the second surface when irradiated with green light (the second emission light color) by means of the light source device M71 of the backlight device M7.

As described above, the structure of the sixth to eleventh symbols of the fifth reel M3*e'* with regard to the first and second surfaces can be achieved as described above with reference to FIGS. 9 to 14 in the first embodiment. The structure in this way enables the sixth to eleventh symbols to visibly appear on the first surface when irradiated with red light (the first color), while enabling the sixth to eleventh symbols to visibly appear on the second surface when irradiated with green light (the second color).

In addition, as described above, with regard to the first to fifth symbols of the fifth reel M3*e'*, it is structured so that the same symbols are overlapped both on the first surface and on the second surface. Therefore, the same symbols visibly appear in both cases where the first to fifth symbols of the fifth reel M3*e'* are irradiated with red light (the first color), green light (the second color), or light with the other color.

The color of light emitted to the fifth reel M3*e'* is changed, so that the symbol to be appeared can be switched among the cases where the fifth reel M3*e'* is used in the normal game mode, in the free game mode, and the a game number determination mode. The processes thereof will be described below.

In addition, no symbol appears on the first and second surfaces when the light source device M71 of the backlight device M7 is extinguished. The symbols do not fulfill their role as symbols in this case. For example, the third symbol shown in FIG. 40(*b*-2), and the first to fifth symbols and the tenth and eleventh symbols shown in FIG. 40(*b*-3) do not appear. In this case, the symbols do not fulfill their role as symbols, but serves as blanks which fill spaces between symbols.

Furthermore, in the gaming machine 10' according to the second embodiment, each of the reels except the fifth reel M3*e'*, i.e., the first to fourth reels M3*a'* to M3*d'*, bears the symbol on a single surface thereof, similar to the conventional gaming machine. The same symbols thus always appear irrespective of color of light emitted from the light source device M71 of the backlight device M7

The alignments of symbols on the first and second surfaces, which are arranged on the fifth reel M3*e'*, shown in FIG. 40(*a*) are stored in the symbol code table. The symbol code table stores, with regard to each of the first and second surfaces, the relationship between the symbol number and the symbol code corresponding to the symbol number. Furthermore, the symbol code table similarly stores, also with regard to the symbols arranged on the first to fourth reels M3*a'* to M3*d'*, the relationship between the symbol number and the symbol code corresponding to the symbol number. In this way, the symbol code table is the table for defining the symbol columns that are arranged on the first to fourth reels M3*a'* to M3*d'*, and the symbol column that is arranged on each of the first and second surfaces of the fifth reel M3*e'*.

The symbol code table is referenced by using the symbol number, so that the symbol code corresponding to the symbol number can be determined. For example, the symbol code table is referenced when the first to fifth reels M3*a'* to M3*e'* stop, so that the symbol code of the symbol rearranged in the display window 56 can be determined <<Main Processes in the Gaming Machine 10' According to the Second Embodiment>>

The main processes in the gaming machine 10' according to the second embodiment will be described below. In addition, the processes similar to those in the gaming machine 10 according to the first embodiment are executed except for those described below. For example, the gaming machine 10' according to the second embodiment similarly executes the processes such as a coin insertion/start check process shown in FIG. 28, an irradiation control process shown in FIG. 31, and a payout process shown in FIG. 32. As described above, like reference numerals are used for explaining the structure and the processes which are in common with the gaming machine 10 according to the first embodiment.

<Process at Turn-On>

Figure 41:
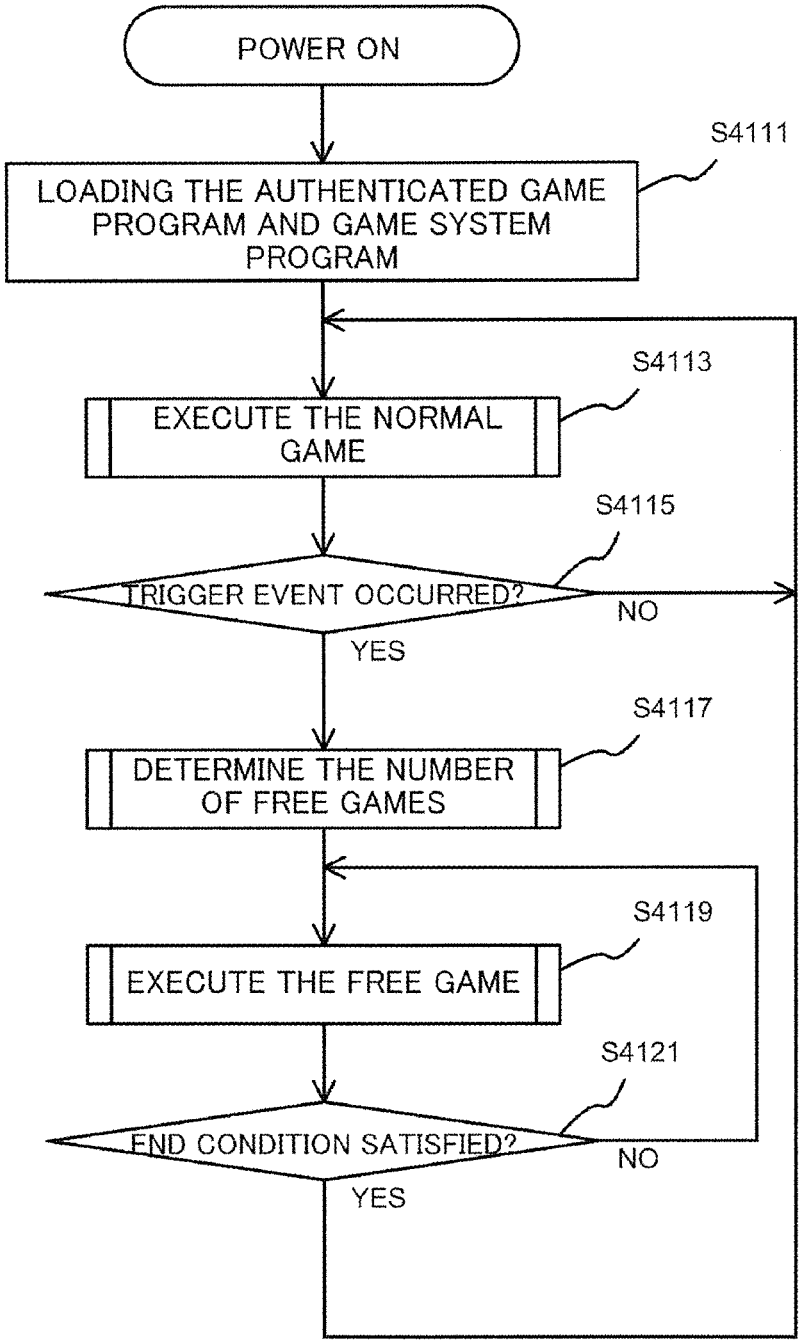

FIG. 41 is a flowchart showing the process when the gaming machine 10' according to the second embodiment is turned on.

First, when the gaming machine 10' is turned on, the main CPU 222 reads out a program from the memory card 210 via the game board 200 to write it in the RAM 226, thereby loading the authenticated game program and game system program (step S4111). Then, the main CPU 222 executes the game program and game system program. In addition, this process is the same as that executed at step S400 in FIG. 26 described above.

Figure 42:
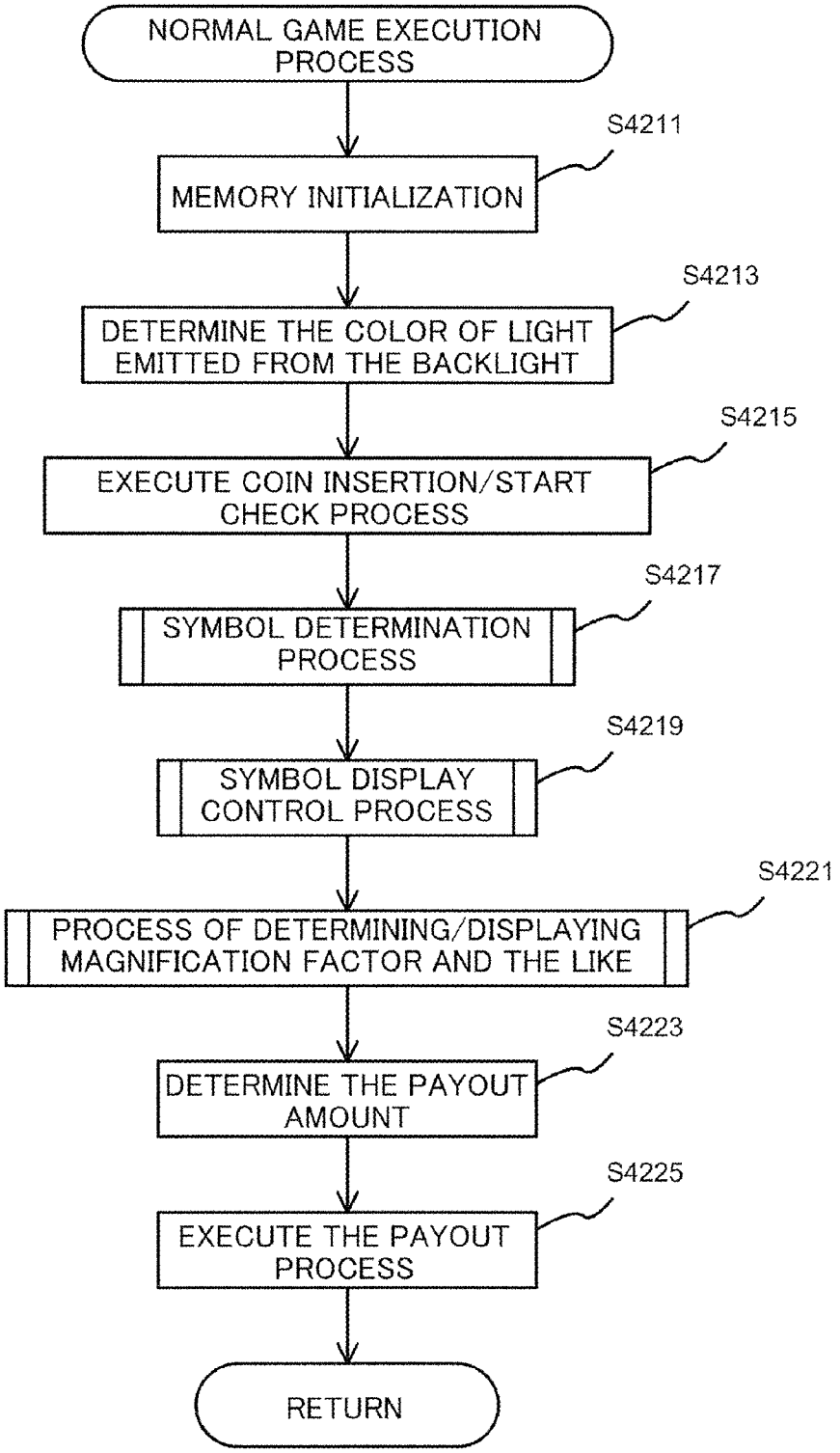
FIG. 42 is a subroutine for a normal game execution process.

A player can execute a new unit game based on an inserted coin and a stored betting when starting the unit game by inserting the IC card into the IC card reader 60 or inserting the coin into the coin insertion unit 80. A normal game initially starts when the gaming machine 10' is actuated to execute the unit game. In this way, the main CPU 222 calls and executes a subroutine for a normal game execution process as shown in FIG. 42 described below for the first unit game (step S4113).

In the second embodiment, the normal game is at least a single unit game in the normal game mode. The game mode includes both the normal game mode and the free game mode. The normal game mode is the game mode in which the unit game can be started by operating the BET buttons 74 to 78. More specifically, the normal game mode is the game mode in which the unit game cannot be started without betting.

The free game is at least a single unit game in the free game mode. The free game mode is the game mode in which the unit game can be started without operating the BET buttons 74 to 78. More specifically, the free game mode is the game mode in which the unit game can be started without betting.

Each time the normal game (the unit game in the normal game mode) is completed, the game mode determination process part 316 executed by the main CPU 222 determines whether or not the trigger event occurs (step S4115). Unless the trigger event occurs, the subsequent unit game is executed as the game in the normal mode. More specifically, upon determining that the trigger event does not occur (NO), the main CPU 222 returns the process to step S4113 to execute the subsequent unit game as the normal game.

Then, upon determining that the trigger event occurs (YES), the main CPU 222 calls the subroutine for a free game number determination process shown in FIG. 46 described below so as to determine the number of unit games in the free game mode (step S4117).

The trigger event at step S4115 is that three bonus symbols are rearranged on the first to fourth reels M3*a*' to M3*d*' when the first to fourth reels M3*a*' to M3*d*' stop in the normal game. More specifically, in the gaming machine 10' according to the second embodiment, the mode shifts to the free game mode after the free game number determination process (FIG. 46) when the first to fourth reels M3*a*' to M3*d*' stop in the normal game to rearrange three bonus symbols.

Then, the main CPU 222 calls a subroutine for a free game execution process shown in FIG. 47 described below to start the unit game in the free game mode (step S4119).

Then, the main CPU 222 determines whether or not the end condition of the free game mode is satisfied (step S4121). The end condition of the free game mode in the second embodiment is that the unit games have been executed until the number of free games reaches the determined number of times.

Upon determining that the end condition of the free game mode is not satisfied (NO), the main CPU 222 returns the process to step S4119. More specifically, the subsequent unit game is executed as the free game unless the end condition is satisfied.

In contrast, upon determining that the end condition of the free game mode is satisfied (YES), the main CPU 222 returns the process to step S4113. More specifically, the subsequent unit game is executed as the normal game when the end condition is satisfied.

<Normal Game Execution Process>

FIG. 42 is a subroutine for a normal game execution process which is called in the process at step S4113 shown in FIG. 41.

First, the main CPU 222 executes memory initialization process (step S4211). In this way, the memory is initialized each time the unit game is completed in the normal game mode. In the initialization process, the main CPU 222 clears unnecessary data and information from the temporary working area in the RAM 226. The unnecessary data and information includes the payout data, awarding or failure information, and the to-be-stopped symbol information determined in the previous unit game. The process at step S4211 is the same as that executed at step S410 in FIG. 27 described above.

Then, the main CPU 222 determines color of light emitted from the backlight device M7 in the normal game mode. Specifically, it is determined that the light with an arbitrary color is emitted to the first symbol "Chance", the second symbol "Lose", the third symbol "Ex_B", the fourth symbol "×10", and the fifth symbol "×7", whereas the red light is emitted to the sixth symbol "×5", the seventh symbol "×3", the eighth symbol "×2", the ninth symbol "×4", the tenth symbol "×3", and the eleventh symbol "×2" (refer to FIG. 40(*b*-1)). This enables the first symbol "Chance", the second symbol "Lose", the third symbol "Ex_B", the fourth symbol "×10", the fifth symbol "×7", the sixth symbol "×5", the seventh symbol "×3", the eighth symbol "×2", the ninth symbol "×4", the tenth symbol "×3", and the eleventh symbol "×2" to appear on the fifth reel M3*e*' in the normal mode game.

Then, the main CPU 222 calls and executes the subroutine for the coin insertion/start check process shown in FIG. 28 (step S4215). This process is the process similar to that executed in the gaming machine 10 according to the first embodiment. In this process, the main CPU 222 checks the entry of coins or bills, and scans inputs from the BET buttons 74 to 78 and the START button 79.

After the START button 79 is pressed by a player, the main CPU 222 executes the subroutine for a symbol determination process shown in FIG. 43 described below (step S4217). In this process, the main CPU 222 generates four random numbers and determines four symbol codes of four to-be-stopped symbols corresponding to the random numbers with reference to the symbol code determination table, as described below. Then, the main CPU 222 determines whether or not any winning combination is achieved by the symbol matrix formed of the rearranged symbols.

Figure 44:
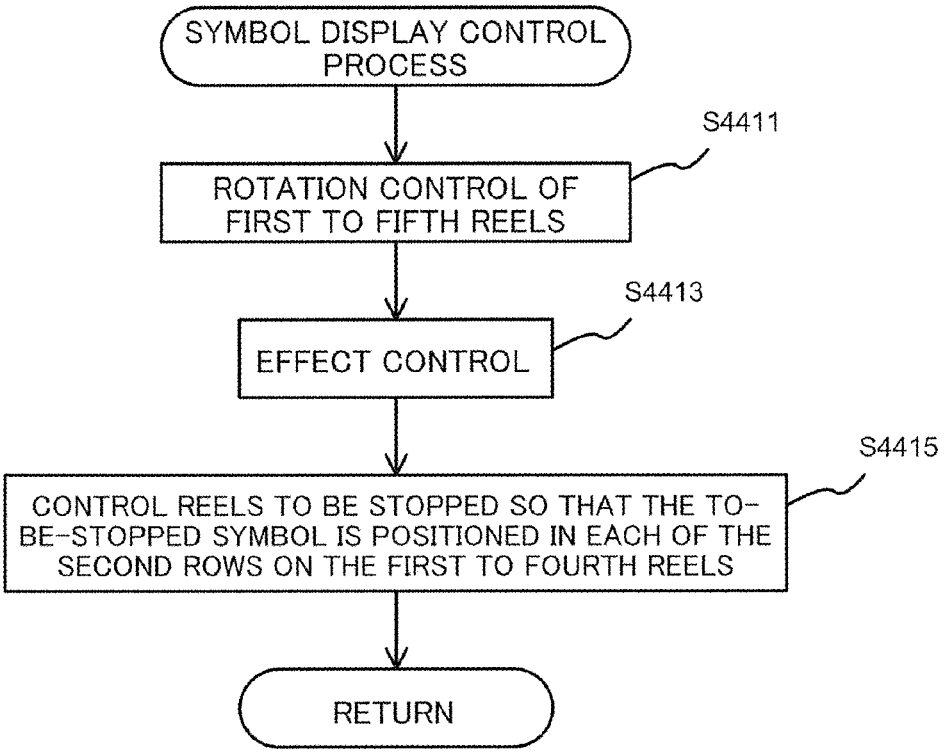
FIG. 44 is a subroutine for a symbol determination process.

Then, the main CPU 222 executes a symbol display control process shown in FIG. 44 (step S4219). In this process, the main CPU 222 controls the reel assembly M1 to rotate the five reels M3*a*' to M3*e*', and then to stop rotating the four reels M3*a*' to M3*d*' in order to rearrange the symbols in accordance with the result of the symbol determination process to form the symbol matrix in the display window 56. In this way, in the gaming machine 10' according to the second embodiment, the rotation control rotates all of the five reels M3*a*' to M3*e*', whereas the stop control stops the four reels M3*a*' to M3*d*'. Only the fifth reel M3*e*' is resultingly rotating when the symbol display control process has been completed.

Then, the main CPU 222 calls and executes a subroutine for the process of determining/displaying magnification factor and the like (step S4221). In this process, the main CPU 222 controls the reel assembly M1 to stop rotating the fifth reel M3*e*' in order to display the symbols in the display window 56 in accordance with the result of the symbol determination process. This process determines the magnification factor and the like. As described above, the fifth reel M3*e*' is rotating when the symbol display control process at step S4219 has been completed. Therefore, the process of determining/displaying magnification factor and the like at step S4221 is the control for stopping the rotating fifth reel M3*e*' in accordance with the result of the symbol determination process.

Then, the main CPU 222 determines the payout amount (step S4223). Here, the payout amount is determined by multiplying the dividend by the magnification factor. The dividend is determined by the symbol determined in the symbol determination process at step S4217. Furthermore, the magnification factor is determined in the process of determining/displaying magnification factor and the like at step S4219.

Then, the main CPU 222 executes the payout process in order to provide a player with the payout amount determined in the process as step S4223 (step S4225), and then terminates the subroutine.

<Symbol Determination Process>

Figure 43:
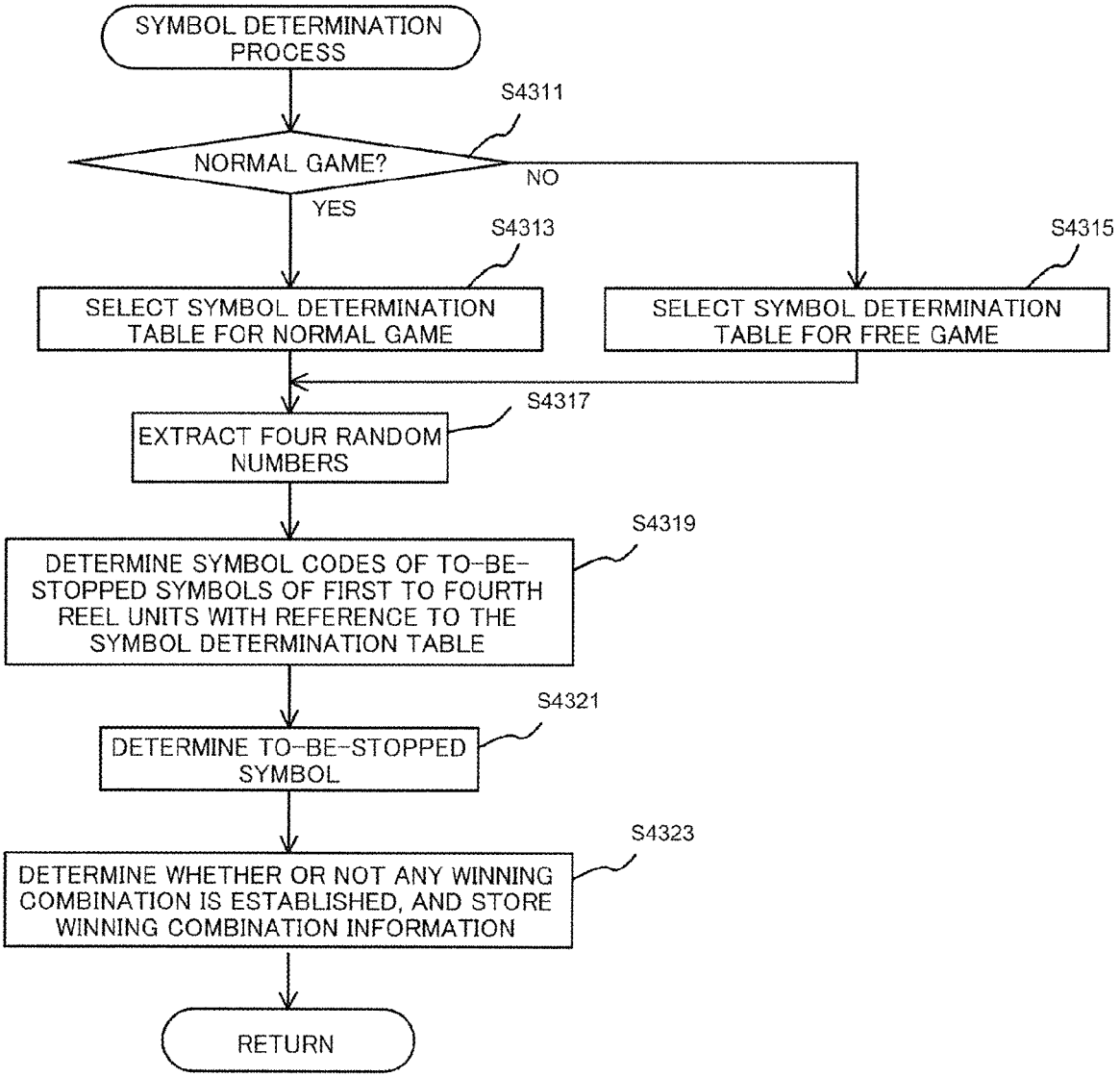
FIG. 43 is a subroutine for a symbol determination process.

FIG. 43 is a subroutine for the symbol determination process. This process is called in the process at step S4217 in FIG. 42.

First, the main CPU 222 determines whether or not the game mode is the normal game mode (step S4311).

Upon determining that the game mode is the normal game mode (YES), the main CPU 222 selects the symbol determination table for the normal game (step S4313). In contrast, upon determining that the game mode is not the normal game mode, i.e., that the game mode is the free game mode (NO), the main CPU 222 selects the symbol determination table for the free game (step S4315).

The symbol determination table for the normal game is the table for determining a single symbol among the symbols which can be selected based on the random number in the normal game. The symbol code determination table for the normal game stores mapping information between the selectable symbol code and the random number. The symbol code determination table for the normal game is stored in the ROM 224, the RAM 226, and the like.

With reference to the symbol code determination table for the normal game, any one of the symbols can be determined from among the "Chance" symbol, the "Lose" symbol, the "Ex_B" symbol, the "×10" symbol, the "×7" symbol, the "×5" symbol, the "×3" symbol, the "×2" symbol, the "×4" symbol, the "×3" symbol, and the "×2" symbol (refer to FIG. 40(*b*-1)). With reference to the symbol code determination table for the normal game, any one of the symbols can be determined from thereamong in accordance with the random numbers defined in the symbol code determination table for the normal game.

The symbol determination table for the free game is the table for determining a single symbol among the symbols which can be selected based on the random number in the free game. The symbol code determination table for the free game stores mapping information between the selectable symbol code and the random number. The symbol code determination table for the free game is also stored in the ROM 224, the RAM 226, and the like.

With reference to the symbol code determination table for the free game, any one of the symbols can be determined from among the "Chance" symbol, the "Lose" symbol, the "×10" symbol, the "×7" symbol, the "×5" symbol, the "×3" symbol, the "×2" symbol, the "×4" symbol, the "FG_2" symbol, and the "FG_1" symbol (refer to FIG. 40(*b*-2)). With reference to the symbol code determination table for the free game, any one of the symbols can be determined from thereamong in accordance with the random numbers defined in the symbol code determination table for the free game.

In addition, as shown in FIG. 40(*b*-2), the light source device M71 of the backlight device M7 is extinguished with regard to the third symbol (the "Ex_B" symbol) in the free game. Therefore, the "Ex_B" symbol does not appear in the free game.

Then, the main CPU 222 extracts four random numbers (step S4317). This process is the same process as that executed at step S450 shown in FIG. 29. Five random numbers are extracted at step S450, whereas four random numbers are extracted at step S4317. The extraction process may be executed similarly to that executed at step S450 although the numbers of random numbers to be extracted are different from each other.

Then, the main CPU 222 determines the symbol code for each of the to-be-stopped symbols on the first to fourth reels M3*a*' to M3*d*', using the four random numbers extracted in the process at step S4317, respectively, with reference to the symbol code determination table selected in the process at step S4313 or S4315 (step S4319). This process is the same process as that executed at step S452 shown in FIG. 29. Specifically, the symbol determination process part 304 executed by the main CPU 222 determines first to fourth symbol codes using the first to fourth random numbers, respectively, with reference to the symbol code determination table.

The process at step S4319 determines the first to fourth symbol codes for the normal game in the normal game mode with reference to the symbol code determination table for the normal game, while determining the first to fourth symbol codes for the free game in the free game mode with reference to the symbol code determination table for the free game.

Then, the main CPU 222 uses each of the first to the fourth symbol codes with reference to the symbol code table to determine first to fourth to-be-stopped symbols corresponding thereto (step S4321). This process is the same process as that executed at step S454 shown in FIG. 29. In this way, each of the to-be-stopped symbols on the first to fourth reels M3*a*' to M3*d*' are determined by use of the four random numbers. Upon determination of the first to fourth to-be-stopped symbols, the main CPU 222 stores the symbol codes (symbols) in the RAM 226.

The four to-be-stopped symbols are symbols to be stopped at the second row of each column of the symbol matrix. Since the symbol alignments constituting the first to fourth symbol columns are fixed corresponding to each of the reels M3*a*' to M3*e*', determining the to-be-stopped symbols can determine all the symbols constituting the symbol matrix. The main CPU 222 determines all the symbols constituting the symbol matrix based on the to-be-stopped symbols with reference to the symbol code table.

Then, the main CPU 222 determines whether or not any winning combination is achieved by the symbols constituting the symbol matrix determined in the process at step S4321. In case that a winning combination is achieved by the symbols constituting the symbol matrix, the winning combination is stored in the RAM 226 (step S4323) and then the subroutine is terminated. In addition, the main CPU 222 may determine whether or not the winning combination is achieved from the symbol codes of to-be-stopped symbols without determining whether or not the winning combination is achieved using the symbol matrix.

<Symbol Display Control Process>

FIG. 44 is a subroutine for a symbol determination process. This process is called in the process at step S4219 in FIG. 42. This process is the same as that shown in FIG. 30 in the first embodiment. In the process shown in FIG. 30, all of the five reels M3*a*' to M3*e*' are controlled to be rotated and stopped. In contrast, in the process shown in FIG. 44, the five reels M3*a*' to M3*e*' are controlled to be rotated and the four reels M3*a*' to M3*d*' are controlled to be stopped. The fifth reel M3*e*' is resultingly rotating when the symbol display control process has been completed.

First, the main CPU 222 transmits a spin control signal to the reel assembly M1 so that the reel driver 264 of the first to fifth reels M3*a*' to M3*e*' supplies power to the reel motor 272 to spin the first to fifth reels M3*a*' to M3*e*'. Each of the first to fifth reels M3*a*' to M3*e*' rotates at a predetermined speed, and the symbol alignment provided on the first to fifth reels M3*a*' to M3*e*' scrolls in the display window 56 of the symbol display unit 40 (step S4411).

While the first to fifth reels M3*a*' to M3*e*' rotates, the backlight driver 266 supplies power to the light sources M71 of the backlight device M7 and the effect illumination driver 268 supplies power to the light source 292 of the effect light illumination device 290 to execute the effect from behind the reel surfaces (step S4413). In this process, the timing of the lighting is controlled so that a predetermined symbol is irradiated with light with a predetermined color.

The spin control signal contains information of stop positions of the first to fourth reels M3*a*' to M3*d*'. The reel driver 264 of the first to fourth reels M3*a*' to M3*e*' controls the reel motors 272 to stop the first to fourth reels M3*a*' to M3*d*' at the position indicated by the spin control signal. Thus, the reel motors 272 composed of stepping motors is stopped at desired positions, and the scroll of the symbol columns is stopped so that the to-be-stopped symbols are positioned in the second row of the symbol matrix formed in the display window 56 (step S4415).

The control executed as described above makes it possible to rotate all of the first to fifth reels M3*a*' to M3*e*' and to stop the first to fourth reels M3*a*' to M3*d*' after a predetermined period of time has elapsed. The dividend is determined by the symbol rearranged by stopping the first to fourth reels M3*a*' to M3*d*'. The symbol display control process does not control the fifth reel M3*e*' to be stopped, so that the fifth reel M3*e*' is rotating when the symbol display control process has been completed.

<Process of Determining/Displaying Magnification Factor and the Like>

Figure 45:
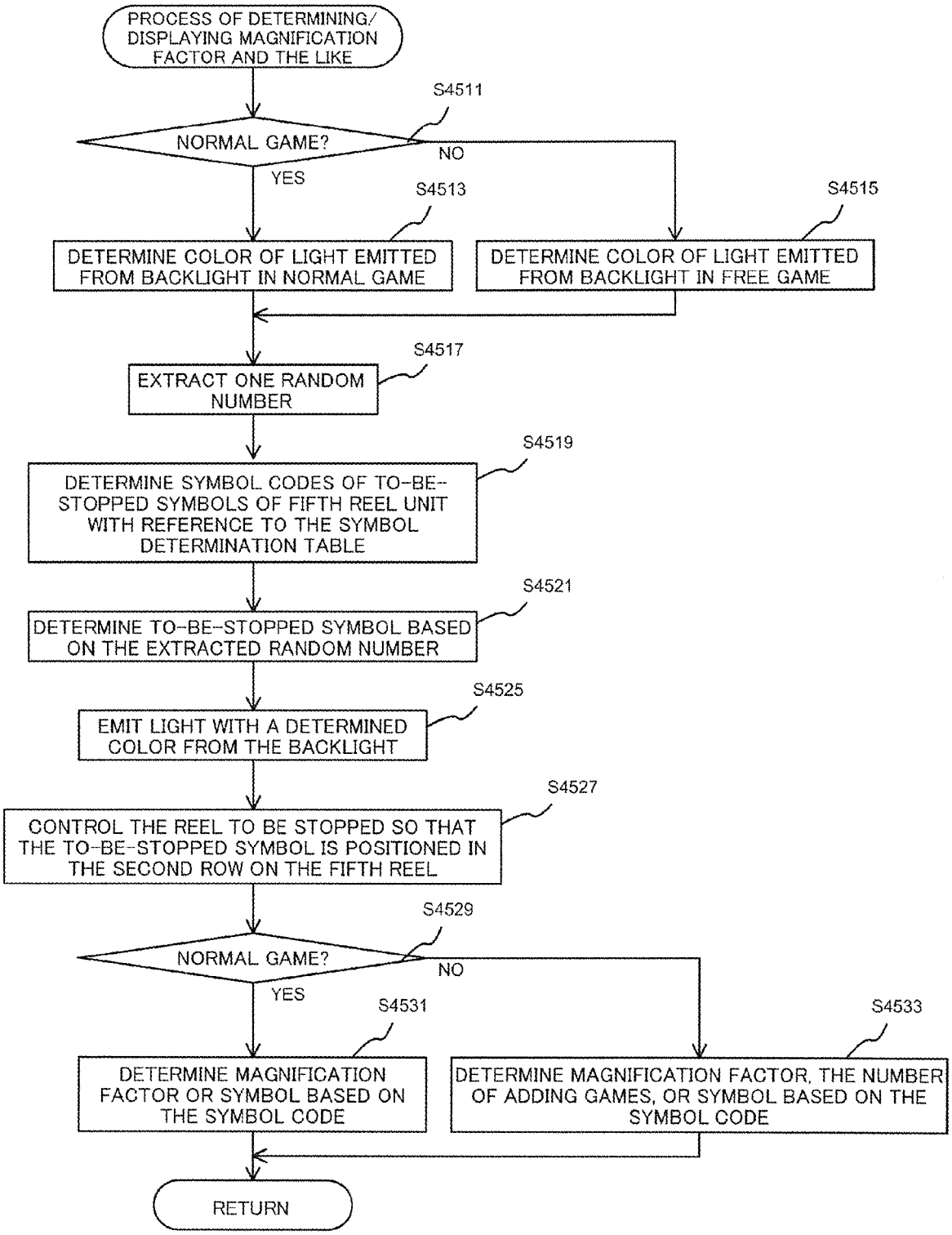

FIG. 45 is a subroutine for a process of determining/displaying magnification factor and the like. This process is called in the process at step S4221 in FIG. 42. This process is the control mainly regarding the stop of the fifth reel M3*e*'. The subroutine is the process common to both the case where the game mode is the normal mode and the case where the game mode is the free game mode.

First, the main CPU 222 determines whether or not the game mode is the normal game mode (step S4511). Upon determining that the game mode is the normal game mode (YES), the main CPU 222 determines the color of light emitted from the backlight in the normal game (step S4513). On the other hand, upon determining that the game mode is not the normal game mode (NO), i.e., upon determining that the game mode is the free game mode, the main CPU 222 determines the color of light emitted from the backlight in the free game (step S4515).

Then, the main CPU 222 extracts one random number (step S4517). This process may be executed similarly to that executed at step S4317 in FIG. 43 described above although the number of random numbers to be extracted is different from that extracted at step S4317.

Then, the main CPU 222 determines the symbol code for each of the to-be-stopped symbols on the first to fourth reels M3*a*' to M3*d*', using the one random number extracted in the process at step S4517, respectively, with reference to the symbol code determination table selected in the process at step S4513 or S4515 (step S4519). This process is the same process as that executed at step S4319 shown in FIG. 43. Specifically, the symbol determination process part 304 executed by the main CPU 222 determines the fifth symbol code using the fifth random number with reference to the symbol code determination table.

In addition, when the game mode is the free game mode, the random number is extracted so that the third symbol "Ex_B" which serves as the blank (Blank_2) is not selected. In this way, the third symbol "Ex_B" which serves as the blank (Blank_2) can be prevented from being selected.

Then, the main CPU 222 uses the fifth symbol code with reference to the symbol code table to determine fifth to-be-stopped symbol corresponding thereto (step S4521). This process is the same process as that executed at step S4321 shown in FIG. 43. In this way, the to-be-stopped symbols on the fifth reel M3*e*' is determined by use of the one random number. Upon determination of the fifth to-be-stopped symbol, the main CPU 222 stores the symbol code (symbol) in the RAM 226.

While the fifth reel M3*e*' rotates, the main CPU 222 makes the backlight driver 266 supply power to the light sources M71 of the backlight device M7, and makes the effect illumination driver 268 supply power to the light source 292 of the effect light illumination device 290 to execute the effect from behind the reel surfaces (step S4525).

More specifically, in the normal game mode, the control is executed so that the first to fifth symbols are irradiated with light with an arbitrary color, whereas the sixth to eleventh symbols are irradiated with red light. The fifth reel M3*e*' is rotating, so that the timing to switch the lighting is determined associated with the number of rotation of the fifth reel M3*e*', and the color of light emitted from the light source device M71 of the backlight device M7 is controlled. In addition, light with a single color, for example, may be emitted without being controlled while the fifth reel M3*e*' is rotating, and then the emission light color may be controlled as described above when the fifth reel M3*e*' stops. This makes it possible to simplify and facilitate the control process.

The control executed in this way enables the first symbol "Chance", the second symbol "Lose", the third symbol "Ex_B", the fourth symbol "×10", and the fifth symbol "×7", the sixth symbol "×5", the seventh symbol "×3", the eighth symbol "×2", the ninth symbol "×4", the tenth symbol "×3", and the eleventh symbol "×2" to appear on the fifth reel M3*e*' in the normal game mode (refer to FIG. 40(*b*-1)).

Furthermore, in the free game mode, the control is executed so that the first, second, fourth, and fifth symbols are irradiated with light with an arbitrary color, the sixth to ninth symbols are irradiated with red light, and the tenth and eleventh symbols are irradiated with green light. The fifth reel M3*e*' is rotating also in the free game mode, so that the timing to switch the lighting is determined associated with the number of rotation of the fifth reel M3*e*', and the color of light emitted from the light source device M71 of the backlight device M7 is controlled. In addition, also in the free game mode, light with a single color, for example, may be emitted without being controlled while the fifth reel M3*e*' is rotating, and then the emission light color may be controlled as described above when the fifth reel M3*e*' stops. This makes it possible to simplify and facilitate the control process.

The control executed in this way enables the first symbol "Chance", the second symbol "Lose", the fourth symbol "×10", and the fifth symbol "×7", the sixth symbol "×5", the seventh symbol "×3", the eighth symbol "×2", the ninth symbol "×4", the tenth symbol "FG_2", and the eleventh symbol "FG_1" to appear on the fifth reel M3*e*' in the free game mode (refer to FIG. 40(*b*-2)).

In addition, extinguishment of the light to the third symbol in the free game mode provides the third symbol with the function of a blank (Blank_2) in which no symbol appears. Therefore, the third symbol is treated as not the "Ex_B" symbol, but a blank.

The spin control signal contains information of stop positions of the fifth reel M3*e*'. The reel driver 264 of the fifth reel M3*e*' controls the reel motors 272 to stop the fifth reel M3*e*' at the position indicated by the spin control signal. Thus, the reel motors 272 composed of stepping motors is stopped at desired positions, and the scroll of the symbol columns is stopped so that the to-be-stopped symbols are positioned in the second row of the symbol matrix formed in the display window 56 (step S4527).

Then, the main CPU 222 determines whether or not the game mode is the normal game mode (step S4529).

Upon determining that the game mode is the normal game mode (YES), the main CPU 222 determines the magnification factor or the symbol based on the symbol code (step S4513). More specifically, the magnification factor of "×10", "×7", "×5", "×4", "×3", or "×2" indicated by the symbol, or the "Chance", "Lose", or "Ex_B" symbol is determined On the other hand, upon determining that the game mode is not the normal game mode, i.e., that the game mode is the free game mode (NO), the main CPU 222 determines the magnification factor, the number of adding games, or the symbol based on the symbol code (step S4533). More specifically, the magnification factor of "×10", "×7", "×5", "×4", "×3", or "×2" indicated by the symbol, one or two more gadding games, or the "Chance" or "Lose" symbol is determined <Free Game Number Determination Process>

Figure 46:
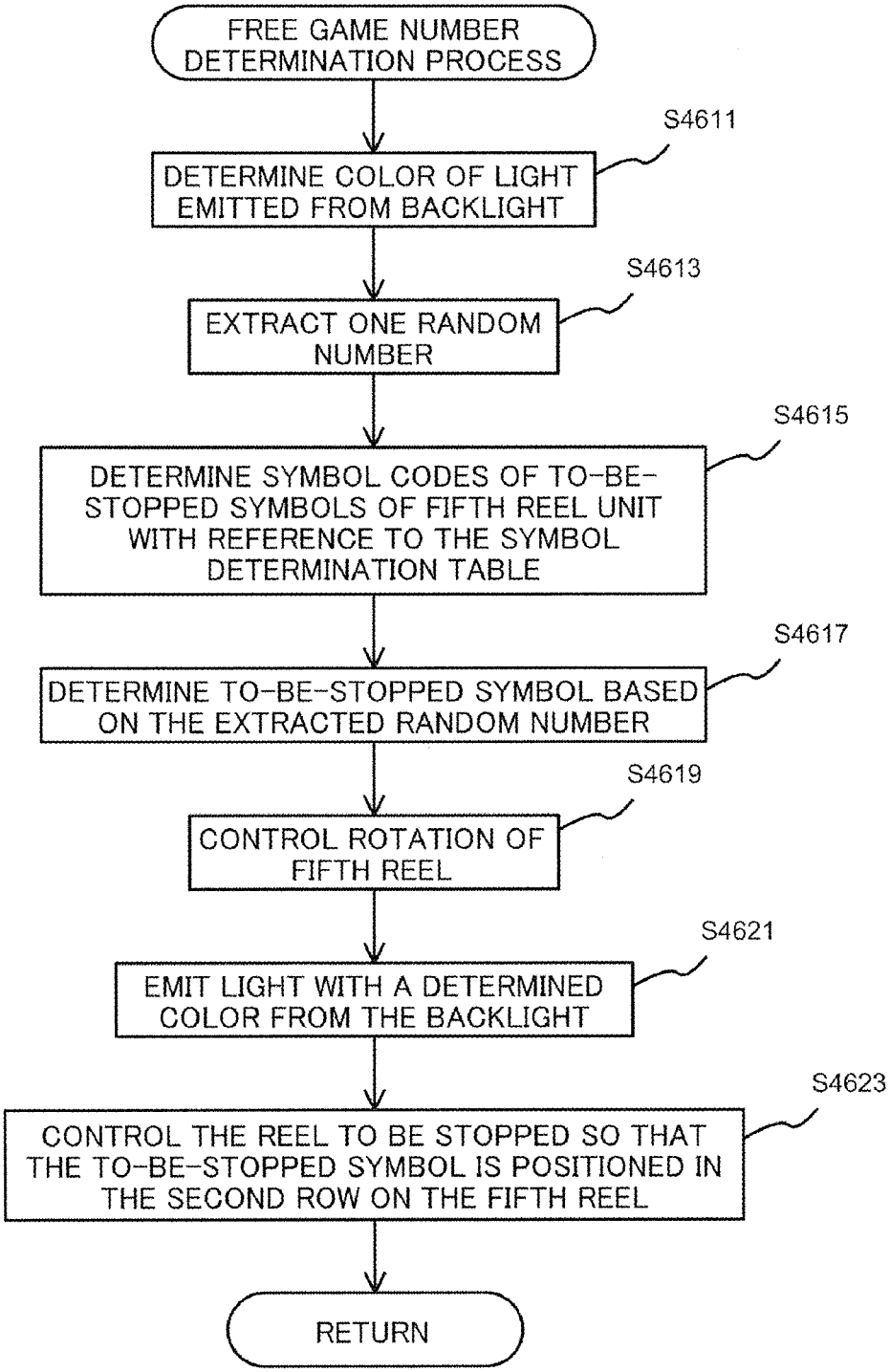
FIG. 46 is a subroutine for a free game number determination process.

FIG. 46 is a subroutine for a free game number determination process. This process is called in the process at step S4117 in FIG. 41. More specifically, it is executed after the trigger event occurs as well as before the free game starts.

First, the main CPU 222 determines color of light emitted from the light source device M71 of the backlight device M7 when determining the number of free games (step S4611).

Then, the main CPU 222 extracts one random number (step S4613). This process may be executed similarly to that executed at step S4517 in FIG. 45 described above although the number of random numbers to be extracted is different from that extracted at step S4517. Here, the random number is extracted so that only any of the sixth symbol "12FG", the seventh symbol "10FG", the eighth symbol "8FG", and the ninth symbol "6FG" is selected. In this way, the first to fifth symbols and the tenth and eleventh symbols which serve as the blanks (Blank_2) can be prevented from being selected.

Then, the main CPU 222 determines the symbol code for each of the to-be-stopped symbols on the fifth reel M3*e*', using the one random number extracted in the process at step S4617 with reference to the symbol code determination table (step S4615). This process is the same process as that executed at step S4519 shown in FIG. 45. Specifically, the symbol determination process part 304 executed by the main CPU 222 determines the fifth symbol code using the fifth random number with reference to the symbol code determination table.

Then, the main CPU 222 uses each of the fifth symbol code with reference to the symbol code table to determine fifth to-be-stopped symbol corresponding thereto (step S4617). This process is the same process as that executed at step S4521 shown in FIG. 45. In this way, each of the to-be-stopped symbols on the fifth reel M3*e*' is determined by use of the one random number. Upon determination of the fifth to-be-stopped symbol, the main CPU 222 stores the symbol code (symbol) in the RAM 226.

In this way, the initial value of the maximum number of unit games of the free game is determined to be 12 when the sixth symbol "12FG" is selected. Furthermore, the initial value of the maximum number of unit games of the free game is determined to be 10 when the seventh symbol "10FG" is selected. The initial value of the maximum number of unit games of the free game is determined to be 8 when the eighth symbol "8FG" is selected. The initial value of the maximum number of unit games of the free game is determined to be 6 when the ninth symbol "6FG" is selected.

Then, the main CPU 222 transmits a spin control signal to the reel assembly M1 so that the reel driver 264 of the fifth reel M3*e*' supplies power to the reel motor 272 to spin the fifth reel M3*e*'. The fifth reel M3*e*' rotates at a predetermined speed, and the symbol alignment provided on the fifth reel M3*e*' scrolls in the display window 56 of the symbol display unit 40 (step S4619).

Then, while the first to fifth reels M3*a*' to M3*e*' rotates, the main CPU 222 makes the backlight driver 266 supply power to the light sources M71 of the backlight device M7, and makes the effect illumination driver 268 supply power to the light source 292 of the effect light illumination device 290 to execute the effect from behind the reel surfaces (step S4621).

More specifically, the control is executed so that the light is extinguished with regard to the first to fifth symbols and the tenth and eleventh symbols, and the sixth to ninth symbols are irradiated with red light. The fifth reel M3*e*' is rotating, so that, in the process at step S4621 described below, the timing to switch the lighting is determined associated with the number of rotation of the fifth reel M3*e*', and the color of light emitted from the light source device M71 of the backlight device M7 is controlled. In addition, light with a single color, for example, may be emitted without being controlled while the fifth reel M3*e*' is rotating, and then the emission light color may be controlled as described above when the fifth reel M3*e*' stops. This makes it possible to simplify and facilitate the control process.

The control executed in this way enables only the sixth symbol "12FG", the seventh symbol "10FG", the eighth symbol "8FG", and the ninth symbol "6FG" to appear on the fifth reel M3*e*' (refer to FIG. 40(*b*-1)). In addition, extinguishment of the light to the first to fifth symbols and the tenth and eleventh symbols provides the symbols with the function of blanks (Blank_2) in which no symbol appears. Therefore, the symbols are treated as merely blanks.

The spin control signal contains information of stop positions of the fifth reel M3*e*'. The reel driver 264 of the fifth reel M3*e*' controls the reel motors 272 to stop the fifth reel M3*e*' at the position indicated by the spin control signal. Thus, the reel motors 272 composed of stepping motors is stopped at desired positions, and the scroll of the symbol columns is stopped so that the to-be-stopped symbols are positioned in the second row of the symbol matrix formed in the display window 56 (step S4623). Then, the subroutine is terminated.

<Free Game Process>

Figure 47:
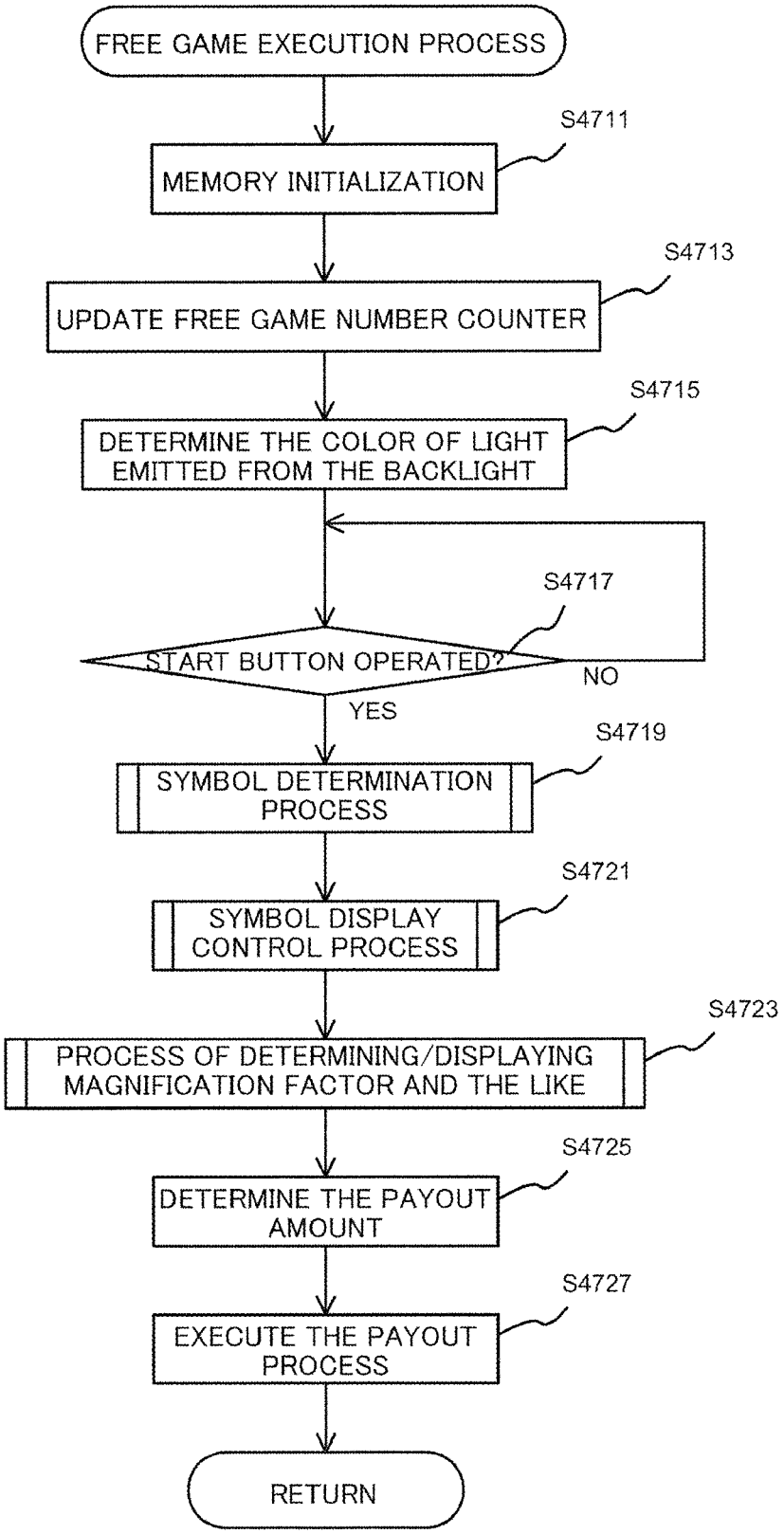
FIG. 47 is a subroutine for a free game process.

FIG. 47 is a subroutine for a free game process. This process is called in the process at step S4121 shown in FIG. 41.

First, the main CPU 222 executes memory initialization process (step S4711). In this way, the memory is initialized each time the unit game is completed in the free game mode. In the initialization process, the main CPU 222 clears unnecessary data and information from the temporary working area in the RAM 226. The unnecessary data and information includes the payout data, awarding or failure information, and the to-be-stopped symbol information determined in the previous unit game. The process at step S4211 is the same as that executed at step S410 in FIG. 27 described above.

Then, the main CPU 222 updates a free game number counter (step S4713). The number of games in the free game mode is managed by the free game number counter. The initial value of the maximum number of the free game is determined by the process shown in FIG. 46 described above. Furthermore, the maximum number of free games may increment by adding some numbers of games by means of the process shown in FIG. 45 (step S4533). In the free game mode, the free game number counter is updated at step S4713. The end condition of the free game mode is satisfied when the number of free games reaches the maximum number. The free game mode is thus terminated and the mode returns to the normal game mode.

Then, the main CPU 222 determines color of light emitted from the backlight device M7 in the free game mode (step S4715). Specifically, it is determined that the light with an arbitrary color is emitted to the first symbol "Chance", the second symbol "Lose", the fourth symbol "×10", and the fifth symbol "×7", the light is extinguished with regard to the third symbol "Ex_B", the red light is emitted to the sixth symbol "×5", the seventh symbol "×3", the eighth symbol "×2", and the ninth symbol "×4", and the green light is emitted to the tenth symbol "FG_2" and the eleventh symbol "FG_1" (refer to FIG. 40(*b*-2)).

This enables the first symbol "Chance", the second symbol "Lose", the fourth symbol "×10", the fifth symbol "×7", the sixth symbol "×5", the seventh symbol "×3", the eighth symbol "×2", the ninth symbol "×4", the tenth symbol "FG_2", and the eleventh symbol "FG_1" to appear on the fifth reel M3*e*' in the free mode game. In addition, the light to the third symbol "Ex_B" is extinguished in the free game mode, and thus the third symbol is treated as a blank.

Then, the main CPU 222 determines whether or not an input from the START button 79 by way of the operation of the START button 79 by a player is detected (step S4717). The determination process can be executed similarly to that executed at step S448 in the first embodiment. Upon determining that no input from the START button 79 is determined (NO), the process returns to step S4717. In the free game mode, the unit game can be started without the BET operation. More specifically, a player can start a unit game without reducing any credit.

Then, upon determining that an input from the START button 79 is detected (YES), the main CPU 222 calls and executes the subroutine for the symbol determination process described above (step S4719). The process at step S4719 is the same process as that executed at step S4217.

Then, the main CPU 222 executes the symbol display control process shown in FIG. 44 (step S4721). The process at step S4721 is the same process as that executed at step S4219. More specifically, the main CPU 222 controls the reel assembly M1 to rotate the five reels M3*a*' to M3*e*', and then to stop rotating the four reels M3*a*' to M3*d*' in order to rearrange the symbols in accordance with the result of the symbol determination process to form the symbol matrix in the display window 56. In this way, in the gaming machine 10' according to the second embodiment, the rotation control rotates all of the five reels M3*a*' to M3*e*', whereas the stop control stops the four reels M3*a*' to M3*d*'. Only the fifth reel M3*e*' is resultingly rotating when the symbol display control process has been completed.

Then, the main CPU 222 calls and executes the subroutine for the process of determining/displaying magnification factor and the like shown in FIG. 45 (step S4723). The process at step S4723 is the same process as that executed at step S4221. More specifically, the main CPU 222 controls the reel assembly M1 to stop rotating the fifth reel M3*e*' in order to display the symbols in the display window 56 in accordance with the result of the symbol determination process. This process determines the magnification factor and the like. As described above, the fifth reel M3*e*' is rotating when the symbol display control process at step S4219 has been completed. Namely, the process of determining/displaying magnification factor and the like at step S4221 is the control for stopping the rotation of the fifth reel M3*e*' in accordance with the result of the symbol determination process.

The processes at steps S4719 and S4721 described above are executed, so that it is possible to rearrange the symbols with regard to the four reels M3*a*' to M3*d*' to form the symbol matrix in the display window 56 by rotating and stopping the four reels M3*a*' to M3*d*' also in the free game mode. The dividend in the unit game can be thus determined based on the rearranged symbols (i.e., the symbols determined in the process at step S4719).

The process at step S4723 described above is executed so that the fifth reel M3*e*' is stopped to rearrange the symbols, and thus the magnification factor and the like can be determined based on the rearranged symbols also in the free game mode.

Then, the main CPU 222 determines the payout amount (step S4725). Here, the payout amount is determined by multiplying the dividend by the magnification factor. The dividend can be determined by the symbol determined in the symbol determination process at step S4719. Furthermore, the magnification factor is determined in the process at step S4723.

In addition, the process for determining/displaying the magnification factor and the like at step 4723 uses the tenth symbol "FG_2" and the eleventh symbol "FG_1" in the free game mode. When the eleventh symbol "FG_1" is determined, the "FG_1" symbol is rearranged in the central position in the vertical direction of the fifth reel M3*e*' in the window 56. In this case, one more game is added to the number of free games. Furthermore, when the eleventh symbol "FG_2" is determined, the "FG_2" symbol is rearranged in the central position in the vertical direction of the fifth reel M3*e*' in the window 56. In this case, two more games are added to the number of free games.

Then, the main CPU 222 executes the payout process in order to provide a player with the payout amount determined in the process as step S4223 (step S4225), and then terminates the subroutine.

<<Modification>>

The examples described above has showed the case where four random numbers are generated for use in the determination of each of the symbols on the first to fourth reels M3*a*' to M3*d*', and then one random number is separately generated for use in the determination of the symbol on the fifth reel M3*e*'. The process is not limited to this, but all of the five random numbers may be generated in advance, and four random numbers may be used in the determination of each of the symbols on the first to fourth reels M3*a*' to M3*d*', while using one random number in the determination of the symbol on the fifth reel M3*e*'.

Furthermore, the example described above has showed the case where, in the symbol display control process, all of the first to fifth reels M3*a*' to M3*e*' are rotated and the first to fourth reels M3*a*' to M3*d*' are stopped while rotating the fifth reel M3*e*', and the fifth reel M3*e*' is stopped in the process for determining/displaying the magnification factor and the like. The processes are not limited to those, but the first to fourth reels M3*a*' to M3*d*' may be rotated and stopped to determine the dividend based on the rearrangement of the symbols in the symbol display control process, and the fifth reel M3*e*' may be rotated and stopped to determine the magnification factor based on the rearrangement of the symbols in the process for determining/displaying the magnification factor and the like.

What is claimed is:

1. A gaming machine, comprising:

a reel assembly including a plurality of mechanical reels bearing a plurality of symbols on the outer surface thereof, and a backlight for illuminating each of the mechanical reels from inside;

a plurality of BET buttons, each configured to be pressed to set a betting amount for a game play; and a controller for controlling color of light emitted from the backlight, wherein:

a game result is displayed by rotating and stopping the plurality of mechanical reels to rearrange the plurality of symbols;

the plurality of symbols includes a variable symbol for representing various symbols in response to the color of light emitted from the backlight;

the variable symbol displays a first symbol upon the backlight emitting first color light, and displays a second symbol upon the backlight emitting second color light;

the variable symbol is made of a first sheet bearing the first symbol and a second sheet bearing the second symbol overlapped with each other; and a vertical part on a periphery of at least one of sheets out of the first sheet or the second sheet is formed in blue.

2. The gaming machine according to claim 1, wherein:

the first color light is red;

the second color light is green;

the first sheet is made of a translucent green base bearing a translucent white or transparent symbol, and displays the symbol in red upon being illuminated by the first color light; and the second sheet is made of a translucent red base bearing a translucent white or transparent symbol, and displays the symbol in green upon being illuminated by the second color light.

3. The gaming machine according to claim 1, wherein one of symbols out of the first symbol and the second symbol is used in a normal game, and the other is used in a game other than the normal game.

4. The gaming machine according to claim 3, wherein the game other than the normal game is a free game.

5. A gaming machine, comprising:

a reel assembly including a plurality of mechanical reels bearing a plurality of symbols on the outer surface thereof, and a backlight for illuminating each of the mechanical reels from inside;

a plurality of BET buttons, each configured to be pressed to set a betting amount for a game play; and a controller for controlling color of light emitted from the backlight, wherein a game result is displayed by rotating and stopping the plurality of mechanical reels to rearrange the plurality of symbols, the plurality of symbols includes a variable symbol for representing various symbols in response to the color of light emitted from the backlight, the various symbols are overlapped with each other on a same mechanical reel among the plurality of mechanical reels, and the variable symbol is made of a first sheet bearing a first symbol and a second sheet bearing a second symbol overlapped with each other.

6. The gaming machine according to claim 5, wherein the variable symbol displays the first symbol upon the backlight emitting first color light, and displays the second symbol upon the backlight emitting second color light.

7. The gaming machine according to claim 6, wherein:

the first color light is red;

the second color light is green;

the first sheet is made of a translucent green base bearing a translucent white or transparent symbol, and displays the symbol in red upon being illuminated by the first color light; and the second sheet is made of a translucent red base bearing a translucent white or transparent symbol, and displays the symbol in green upon being illuminated by the second color light.

8. The gaming machine according to claim 7, wherein a vertical part on a periphery of at least one of sheets out of the first sheet or the second sheet is formed in blue.

9. The gaming machine according to claim 6 wherein one of symbols out of the first symbol and the second symbol is used in a normal game, and the other is used in a game other than the normal game.

10. The gaming machine according to claim 9, wherein the game other than the normal game is a free game.

* * * * *